US009449596B2

(12) United States Patent
Ohashi et al.

(10) Patent No.: US 9,449,596 B2
(45) Date of Patent: Sep. 20, 2016

(54) SOUND GENERATION SYSTEM, SOUND RECORDING SYSTEM, SOUND GENERATION METHOD, SOUND RECORDING METHOD, SOUND ADJUSTING METHOD, SOUND ADJUSTING PROGRAM, SOUND FIELD ADJUSTING SYSTEM, SPEAKER STAND, FURNITURE, SPEAKER CABINET, AND SPEAKER DEVICE

(71) Applicant: NITTOBO ACOUSTIC ENGINEERING CO., LTD, Tokyo (JP)

(72) Inventors: Shinji Ohashi, Tokyo (JP); Koichi Yamashita, Tokyo (JP); Yasushi Satake, Tokyo (JP); Katsuyuki Kanazawa, Tokyo (JP)

(73) Assignee: Nittobo Acoustic Engineering Co., Ltd., Tokyo (JP)

( * ) Notice: Subject to any disclaimer, the term of this patent is extended or adjusted under 35 U.S.C. 154(b) by 125 days.

(21) Appl. No.: 14/279,049

(22) Filed: May 15, 2014

(65) Prior Publication Data

US 2014/0334654 A1 Nov. 13, 2014

Related U.S. Application Data

(62) Division of application No. 13/202,486, filed as application No. PCT/JP2010/000642 on Feb. 3, 2010, now Pat. No. 8,929,580.

(30) Foreign Application Priority Data

| | | |
|---|---|---|
| Feb. 20, 2009 | (JP) | 2009-038426 |
| Mar. 30, 2009 | (JP) | 2009-081442 |
| Jun. 15, 2009 | (JP) | 2009-0142518 |
| Nov. 9, 2009 | (JP) | 2009-255890 |

(51) Int. Cl.
*G10K 11/20* (2006.01)
*H04R 1/20* (2006.01)
(Continued)

(52) U.S. Cl.
CPC ..... *G10K 11/20* (2013.01); *H04R 1/20* (2013.01); *H04R 1/22* (2013.01); *H04R 1/2888* (2013.01); *H04R 1/345* (2013.01); *H04R 1/2876* (2013.01)

(58) Field of Classification Search
CPC ..... G10K 11/20; H04R 1/20; H04R 5/02; H04R 1/025
USPC ..... 381/337, 338, 339, 345, 160, 64; 181/152, 162
See application file for complete search history.

(56) References Cited

U.S. PATENT DOCUMENTS

| | | | | |
|---|---|---|---|---|
| 6,320,971 | B1 | 11/2001 | Tozawa | |
| 2002/0018576 | A1* | 2/2002 | Shima | H04R 1/025 381/396 |

FOREIGN PATENT DOCUMENTS

| | | | |
|---|---|---|---|
| CN | 1113066 | A | 12/1995 |
| JP | 61-77097 | A | 4/1986 |

(Continued)

OTHER PUBLICATIONS ccMixterblog, "DIY Sound Proof Boxes", Mar. 17, 2007.*

(Continued)

*Primary Examiner* — David Ton
(74) *Attorney, Agent, or Firm* — Birch, Stewart, Kolasch & Birch, LLP

(57) ABSTRACT

Provided are a sound generation system and a sound recording system, which are placed in a room to adjust sound. A columnar body is disposed around a sound source to adjust how much sound of a low-tone range, as well as of a middle- and high-tone range, is absorbed and diffused. Moreover, a columnar body is disposed around a recording device to adjust how much sound of a low-tone range, as well as of a middle- and high-tone range, is absorbed and diffused. The columnar bodies may be made of a combination of different diameters and/or lengths. The arrangement distances may be random. With the columnar body disposed at the most appropriate location, it is possible to adjust sound in a wide band.

12 Claims, 64 Drawing Sheets

(51) Int. Cl.

| | |
|---|---|
| ***H04R 1/22*** | (2006.01) |
| ***H04R 1/34*** | (2006.01) |
| *H04R 1/28* | (2006.01) |

(56) References Cited

FOREIGN PATENT DOCUMENTS

| | | | |
|---|---|---|---|
| JP | 63-140788 | | 9/1988 |
| JP | 1-136190 | A | 5/1989 |
| JP | 8-177142 | A | 7/1996 |
| JP | 11-220787 | A | 8/1999 |
| JP | 2000-350277 | A | 12/2000 |
| JP | 2004-242057 | A | 8/2004 |
| JP | 2006-300995 | A | 11/2006 |
| JP | 2007-291804 | A | 11/2007 |
| JP | 2008-131199 | A | 6/2008 |
| JP | 2008-172741 | A | 7/2008 |
| WO | WO 94/03025 | A1 | 2/1994 |

OTHER PUBLICATIONS

Haines and Hinterding, "Telepathy", May 5, 2008.*
International Search Report, dated May 25, 2010, issued in PCT/JP2010/000642.

* cited by examiner

10

SOUND GENERATION SYSTEM, SOUND RECORDING SYSTEM, SOUND GENERATION METHOD, SOUND RECORDING METHOD, SOUND ADJUSTING METHOD, SOUND ADJUSTING PROGRAM, SOUND FIELD ADJUSTING SYSTEM, SPEAKER STAND, FURNITURE, SPEAKER CABINET, AND SPEAKER DEVICE

This application is a divisional of co-pending U.S. application Ser. No. 13/202,486 filed on Aug. 19, 2011 and for which priority is claimed under 35 U.S.C. §120. U.S. application Ser. No. 13/202,486 is the National Phase of PCT International Application No. PCT/JP2010/000642 filed on Feb. 3, 2010 under 35 U.S.C. §371; and these applications claim priority under 35 U.S.C. §119, of JP-2009-038426 filed in Japan on Feb. 20, 2009, of JP-2009-081442 filed in Japan on Mar. 30, 2009, of JP-2009-142518 filed in Japan on Jun. 15, 2009 and of JP-2009-255890 filed in Japan on Nov. 9, 2009. The entire contents of each of the above-identified applications are hereby incorporated by reference into the present application.

TECHNICAL FIELD

The present invention relates to a sound generation system, sound recording system, sound generation method, sound recording method, sound adjusting method, sound adjusting program, sound field adjusting system, speaker stand, furniture, speaker cabinet and speaker device. The present invention relates particularly to a sound generation system, sound recording system, sound generation method and sound recording method that use a sound diffusion body, which is freely disposed in a room to adjust sound, and a sound diffusion method; a sound adjusting method, sound adjusting program, sound field adjusting system, speaker stand and furniture that are aimed at gaining an excellent sound field in various kinds of acoustic room; a speaker cabinet that is aimed at preventing standing waves from emerging; and a speaker device including the speaker cabinet.

BACKGROUND ART

In recent years, HDTV (High Definition Television) resolution has been used in broadcasting, package media and other video sources. At the same time, audio and visual technologies are booming.

For the above HDTV sources, sound is recorded in a more sophisticated way than a conventional one. For example, at a sampling frequency of 96 kHz or 192 kHz and with a dynamic range of 24 bits, sound is more accurately recorded.

However, in the kinds of acoustic room in a normal house, such as a living room, audio room or audio visual room, that have limits in size or design, it has been difficult to obtain an excellent sound field.

The following are among the factors that hamper the creation of an excellent sound field in a living room and other kinds of acoustic room: multiple-diffraction reflection (flutter echo), standing wave, and vibration of a wall caused by excess low-pitched sound. Multiple-diffraction reflection emerges between wall surfaces of a room, which face each other. Standing waves occur in a room for the same reason. The vibration of walls is caused by excessive low-pitched sound.

In designing a living room and other kinds of acoustic room, reducing the above factors that hamper the creation of an excellent sound field is important.

To obtain an excellent sound field, adjusting an early-reflected sound or reverberant sound is also important. That is, what is important is to enable the spreading of sound to be felt even in a room with a limited capacity by adjusting an early-reflected sound or reverberant sound.

To adjust sound in a room, acoustic panels made of a sound-absorption material have been available in the market. Such acoustic panels are placed in a room or attached to a wall or ceiling for use.

What is disclosed in Patent Document 1 as a conventional acoustic panel is a sound diffusion panel that makes it easier to adjust a horizontal sound environment (which is referred to as Conventional Technology 1, hereinafter).

The acoustic panel of Conventional Technology 1 includes two supporting legs, which stand at predetermined intervals, and two acoustic panels, which are supported by the supporting legs. In the acoustic panel, the two acoustic panels are connected together so as to freely open in the horizontal direction. The acoustic panels are each supported by the supporting legs via a slide mechanism that slides in the horizontal direction. On each supporting leg, a rotating mechanism is provided to rotate the acoustic panels in the horizontal direction. On the front sides of the acoustic panels, working faces are formed to reflect and absorb sound, with the back sides of the acoustic panels supported by the supporting legs.

When the acoustic panel of Conventional Technology 1 is used, it is possible to make fine adjustments to the direction of sound absorption and reflection by opening and closing the acoustic panels as if to open and close a folding screen. Since the acoustic panels are supported by the supporting legs via the slide mechanism and the rotating mechanism, the acoustic panels open and close smoothly. Therefore, flutter echoes and standing waves can be reduced by making appropriate adjustments to angles and installation sites.

In the meantime, with reference to a side view shown in FIG. 25 and a top view in FIG. 26, a relationship between direct sound and early-reflected sound in sound fields of various kinds of acoustic room will be described. The early-reflected sound refers to a primary reflected sound from a floor, wall, ceiling or the like. The diagrams each show the relationship between direct sound and early-reflected sound.

A sound wave that occurs at a speaker P (sound generation section) shown in FIG. 25 or 26 reaches a listener L as a direct sound 1200. In addition, an early-reflected sound reaches the listener L after being emitted from the speaker P. The diagrams each show an example of early-reflected sounds: a ceiling reflection sound 1320, a floor reflection sound 1330, a sidewall reflection sound 1350, a front-wall reflection sound 1310, and a rear-wall reflection sound 1340. The ceiling reflection sound 1320 is a primary reflected sound that is reflected off the ceiling. Similarly, the floor reflection sound 1330 is a primary reflected sound that is reflected off the floor. Similarly, the sidewall reflection sound 1350 is a primary reflected sound that is reflected off the left-side and right-side walls. Similarly, the front-wall reflection sound 1310 is a primary reflected sound that is emitted from a bass reflex port or the like and reflected off the wall ahead of the listener L. Similarly, the rear-wall reflection sound 1340 is a primary reflected sound that is reflected off the wall behind the listener L. Besides the above sounds, there are sound waves, called reverberant sound, which occur after the above reflected sounds are further reflected off the walls of the room and attenuated before reaching the listener L.

With reference to FIG. 27, the relationships between the above sound waves will be described.

When compared with the direct sound 1200 that has the highest sound pressure, an early-reflected sound 1300 arrives after going a longer distance due to reflection. Therefore, in terms of time, the early-reflected sound 1300 arrives later than the direct sound. Moreover, a repeatedly-reflected reverberant sound 1400 also arrives.

The listener L listens to the sound waves and can recognize acoustic environments, or sound fields, of various kinds of acoustic rooms consciously or unconsciously.

Accordingly, the listener L may feel the confine of the various kinds of acoustic room by the intensity and direction of the early-reflected sound or the volume of reverberant sound.

Therefore, what is important is to make sure that the listener can feel the spreading of sound even in a room with a limited capacity by adjusting the early-reflected sound or reverberant sound in order to obtain an excellent sound field.

For the above purpose, acoustic panels made of a sound-absorption material have been available in the market: The acoustic panels are placed in a room or attached to a wall or ceiling to adjust sound in the room.

What is disclosed in Patent Document 2 as a conventional acoustic panel is a sound diffusion panel that makes it easier to adjust a horizontal sound environment (which is referred to as Conventional Technology 2, hereinafter).

The acoustic panel of Conventional Technology 2 includes two supporting legs, which stand at predetermined intervals, and two acoustic panels, which are supported by the supporting legs. In the acoustic panel, the two acoustic panels are connected together so as to freely open in the horizontal direction. The acoustic panels are each supported by the supporting legs via a slide mechanism that slides in the horizontal direction. On each supporting leg, a rotating mechanism is provided to rotate the acoustic panels in the horizontal direction. On the front sides of the acoustic panels, working faces are formed to reflect and absorb sound, with the back sides of the acoustic panels supported by the supporting legs.

When the acoustic panel of Conventional Technology 2 is used, it is possible to make fine adjustments to the direction of sound absorption and reflection by opening and closing the acoustic panels as if to open and close a folding screen. Since the acoustic panels are supported by the supporting legs via the slide mechanism and the rotating mechanism, the acoustic panels open and close smoothly.

Therefore, making adjustments to the early-reflected sound or reverberant sound results in an improvement in the sound fields of various kinds of acoustic rooms. Moreover, it is possible to reduce multiple-diffraction reflection (flutter echo), which occurs between the wall surfaces of a room that face each other, standing waves, vibration of the walls, and the like.

Meanwhile, from the back side of a speaker, such as a dynamic speaker that outputs sound with the help of vibration of a diaphragm, a sound wave is emitted in such a way that the phase difference between the sound wave and a sound wave emitted from the front side of the speaker is one-half of the wavelength. If the back-side sound wave goes around the speaker to the front side and interferes with the speaker's front-side sound wave, the intensity of sound from the speaker is attenuated.

In general, to prevent the front-side sound from being attenuated by the speaker's back-side sound wave, the speaker is attached to one surface of a speaker cabinet that is in the shape of a rectangular parallelepiped, so that the speaker's back-side sound is contained in the cabinet, preventing the back-side sound wave from going around to the front side of the speaker.

However, if the speaker's back-side sound is emitted into the cabinet, the sound wave reflects off the inner surfaces of the wall portions of the cabinet. The reflection of the reflected sound wave between the following inner surfaces causes a standing wave whose antinodes of vibration are positioned at the inner surfaces of the wall portions facing each other: the inner surfaces of a front-wall portion (baffle board) to which the speaker is attached and a rear-wall portion that faces the front-wall portion, the inner surfaces of upper- and lower-wall portions, and the inner surfaces of right-side and left-side wall portions.

Therefore, the problem is that the standing wave hampers the vibration of the diaphragm of the speaker. The intensity of the standing wave varies according to the frequency. Because of the standing wave, the speaker has a "flaw" in the frequency characteristics, i.e., only a specific frequency is amplified or attenuated. Thus, the frequency characteristics become worse.

A simple, conventional way to address the above problem is to put a sound-absorption material, such as glass wool, onto the inner surfaces of the wall portions of the cabinet in order to reduce the standing wave. However, at the same time, the sound-absorption material could damage natural tone of the sound and cause other unpleasant effects.

What is disclosed in Patent Document 3 is a technique of removing standing waves by placing a plurality of flat or curved division plates in a speaker cabinet and disposing the division plates on the inner surfaces, which face each other, of the upper, lower, left-hand, right-hand, front and rear wall portions of the cabinet in such a way that the division plates do not run parallel to the inner surfaces (which is referred to as Conventional Technology 3, hereinafter).

PRIOR ART DOCUMENTS

Patent Documents

Patent Document 1: JP-A-2006-300995
Patent Document 2: JP-A-2007-291804
Patent Document 3: JP-A-2008-172741

DISCLOSURE OF THE INVENTION

Problems to be Solved by the Invention

However, according to the acoustic panel of Conventional Technology 1, the characteristics of a high-tone range, middle-tone range, and low-tone range are determined from the material, shape and dimensions of the material. The problem is that the acoustic panel of Conventional Technology 1 cannot support at a time when the positions in a room associated with flutter echoes or standing waves for high-pitched sound are different from those for low-pitched sound. Accordingly, only insufficient sound improvement effects can be obtained when only one acoustic panel is used. Therefore, the problem is that a number of acoustic panels for high-pitched and low-pitched sounds need to be placed in a room to adjust the sound field, resulting in increased costs.

According to the acoustic panel of Conventional Technology 2, as shown in FIG. 27, it is possible to absorb an early-reflected sound or reverberant sound to adjust the volume thereof. However, a listener may feel something unnatural as the early-reflected sound or reverberant sound is absorbed. The problem is that the sound field becomes one that feels choked.

Moreover, according to the acoustic panel of Conventional Technology 2, it is possible to somewhat adjust a delay in time by changing the direction of reflection. However, there is a difference in time between the direct sound and early-reflected sound. Therefore, the problem is that it is difficult to make a listener feel the spreading of sound greater than the sizes of various kinds of acoustic rooms.

Moreover, according to the technique proposed by the above Conventional Technology 3, the sound emitted toward the back side of the speaker is reflected off the division plate so that the sound pass in a direction leaning with respect to the wall portion of the cabinet, thereby reducing standing waves caused by the reflection of sound between the inner surfaces of the upper, lower, left-hand, right-hand, front and rear wall portions, which face each other, of the cabinet.

However, according to the technique of the Conventional Technology 3, as for the standing waves unique to the cabinet that is in the shape of a rectangular parallelepiped, there is the effect of removing the surfaces parallel to each other. Therefore, it is possible to reduce existing standing waves. However, the problem is that new standing waves occur because of the division plates placed in the box.

The present invention has been made in view of the above circumstances. The object of the present invention is to solve the above problems.

Means for Solving the Problems

To achieve the above object, the present invention employs the following means. That is, A sound generation system of the present invention includes: a sound source that generates a sound; and a columnar body that adjusts an amount of the sound is diffused and absorbed around the columnar body.

In the sound generation system of the present invention, the columnar body is plurals.

In the sound generation system of the present invention, the columnar body is fixed to or incorporated into the sound source.

In the sound generation system of the present invention, the columnar bodies are in combination of different diameters and/or lengths.

In the sound generation system of the present invention, the arrangement distances of the columnar bodies are random.

In the sound generation system of the present invention, the columnar bodies are arranged so as to be concentrated in a direction in which the columnar bodies move away from the sound source.

In the sound generation system of the present invention, the columnar bodies are disposed so as to become thicker in diameter in a direction in which the columnar bodies move away from the sound source.

A sound recording system of the present invention includes: a recording device that records a sound; and a columnar body that adjusts an amount of the sound is diffused and absorbed around the columnar body.

In the sound recording system of the present invention, the columnar body is plurals.

In the sound recording system of the present invention, the columnar body is fixed to or incorporated into the recording device.

In the sound recording system of the present invention, the columnar bodies are in combination of different diameters and/or lengths.

In the sound recording system of the present invention, the arrangement distances of the columnar bodies are random.

In the sound recording system of the present invention, the columnar bodies are arranged so as to be concentrated in a direction in which the columnar bodies move away from the recording device.

In the sound recording system of the present invention, the columnar bodies are disposed so as to become thicker in diameter in a direction in which the columnar bodies move away from the recording device.

A sound generation method of the present invention includes: a step of placing a columnar body around a sound source; and a step of adjusting how much a sound is diffused and absorbed.

A sound recording method of the present invention includes: a step of placing a columnar body around a recording device; and a step of adjusting how much a sound is diffused and absorbed.

A sound adjusting method of the present invention for adjusting sound fields of various kinds of acoustic room includes a step of generating a diffusion reflected sound in a section between a direct sound reaches a sound-reception point from a sound source and an early-reflected sound.

In the sound adjusting method of the present invention, the diffusion reflected sound is further generated in a section of the early-reflected sound.

In the sound adjusting method of the present invention, the diffusion reflected sound is generated by disposing a diffused-reflection body next to a sound source and/or sound-reception point; the diffused-reflection body is so formed as to have a gap and cause multilayer diffused reflection; and the density of the diffused-reflection body increases as the diffused-reflection body moves away from the sound source and/or sound-reception, and the diffused-reflection body is so disposed as to generate the diffusion reflected sound in the section.

In the sound adjusting method of the present invention, the diffused-reflection body is arranged randomly.

In the sound adjusting method of the present invention, the diffused-reflection bodies are columnar diffusion bodies that are substantially in the shape of a circular column, prismatic column or elliptic column and are different in diameter.

In the sound adjusting method of the present invention, the columnar diffusion bodies are skewered state.

In the sound adjusting method of the present invention, the diffused-reflection bodies are in the shape of a ball, an elliptic ball or a rugged object skewered.

A sound adjusting program of the present invention causes a computer to execute the sound adjusting method.

A sound field adjusting system of the present invention includes the computer that executes the sound adjusting program.

In a speaker stand of the present invention, the arrangement of the diffused-reflection bodies is calculated by the sound adjusting method.

In furniture of the present invention, the arrangement of the diffused-reflection bodies is calculated by the sound adjusting method.

A speaker cabinet of the present invention includes a plurality of bar bodies that are provided so as to project from a wall into an inner part.

In the speaker cabinet of the present invention, the bar bodies are provided so as to run parallel to an inner surface of the cabinet.

In the speaker cabinet of the present invention, at least some of the bar bodies are provided so as not to run parallel to an inner surface of the cabinet.

In the speaker cabinet of the present invention, a plurality of the bar bodies includes various bar bodies whose cross-sectional surfaces are different in shape.

In the speaker cabinet of the present invention, the bar bodies are made of wood.

In the speaker cabinet of the present invention, the bar bodies are solid bar bodies.

In the speaker cabinet of the present invention, the bar bodies are hollow bar bodies having an air inlet and outlet.

In the speaker cabinet of the present invention, the bar bodies are hollow bar bodies having an air inlet and outlet, with a sound-absorption material put into an internal part.

In the speaker cabinet of the present invention, the bar bodies are placed at locations where the particle velocity of a standing wave is high in the cabinet.

In the speaker cabinet of the present invention, for the bar bodies, bar bodies of a diameter corresponding to a frequency of a location where the particle velocity is high are placed.

A speaker device of the present invention includes the speaker cabinet.

Advantages of the Invention

According to the present invention, due to a sound source that generates a sound, and a columnar body that adjusts an amount of the sound is diffused and absorbed around the columnar body, it is possible to provide a sound generation system and a sound recording system that use a sound diffusion body and can adjust sound in a room in the most appropriate manner.

Moreover, according to the present invention, a diffusion reflected sound is generated in an effective manner between a direct sound and an early-reflected sound. Therefore, it is possible to provide a sound adjusting method by which good sound fields of various kinds of acoustic room are created.

Moreover, according to the present invention, a plurality of bar bodies are provided in a cabinet of a speaker device so as to project from a wall portion into an internal part. Therefore, a sound emitted from the back side of the speaker into the cabinet is diffused on a surface of the bar body. It is possible to reduce standing waves in a wide band, which could occur at a time when a sound is reflected between internal surfaces of wall portions facing each other of the cabinet.

BEST MODE FOR CARRYING OUT THE INVENTION

Sound Generation System, Sound Recording System, Sound Generation Method, Sound Recording Method

First Embodiment

Figure 1:
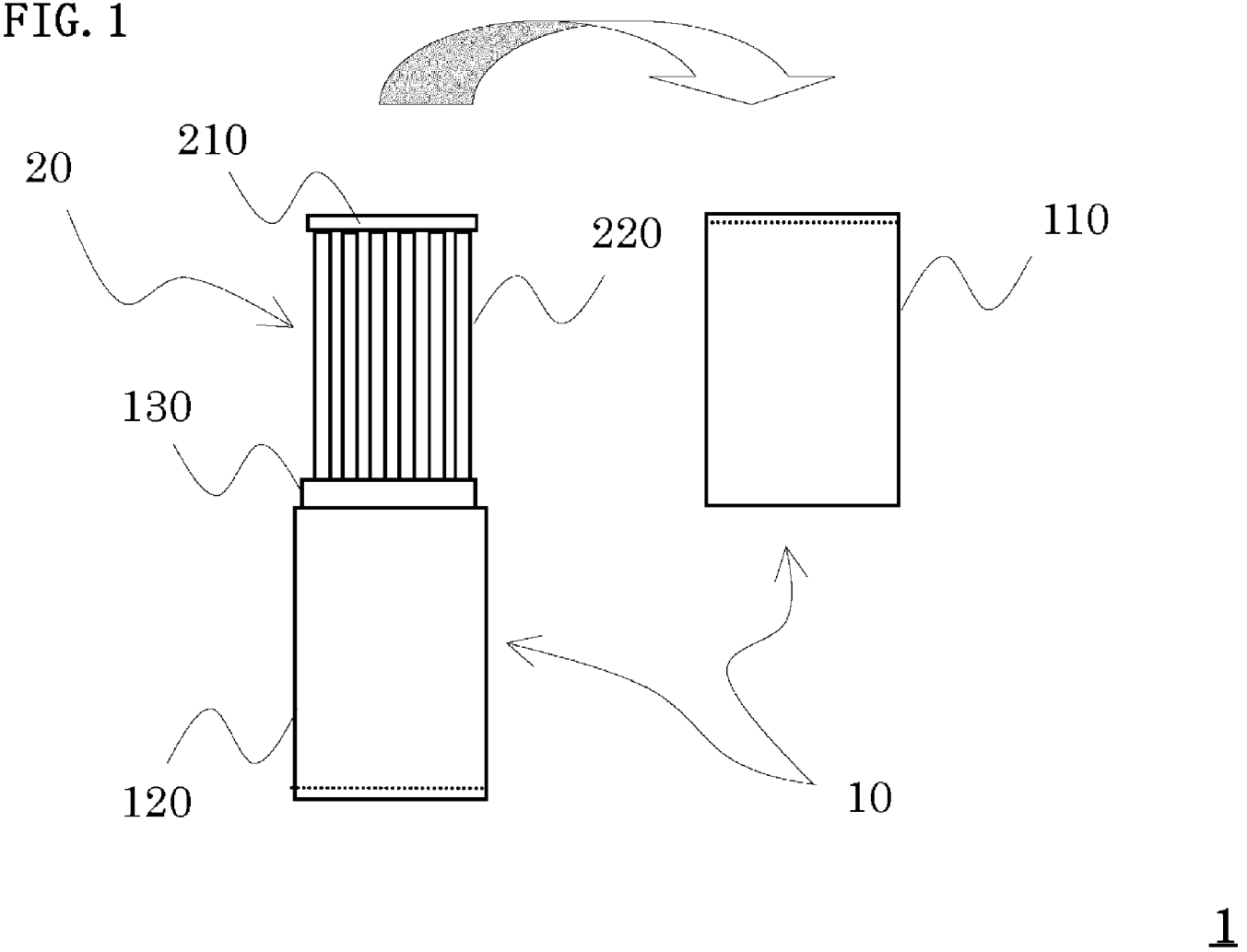
FIG. 1 is a conceptual diagram showing a tubular diffusion body 10 and a columnar diffusion body 20 in a sound diffusion body 1 according to a first embodiment of the present invention.
Figure 2:
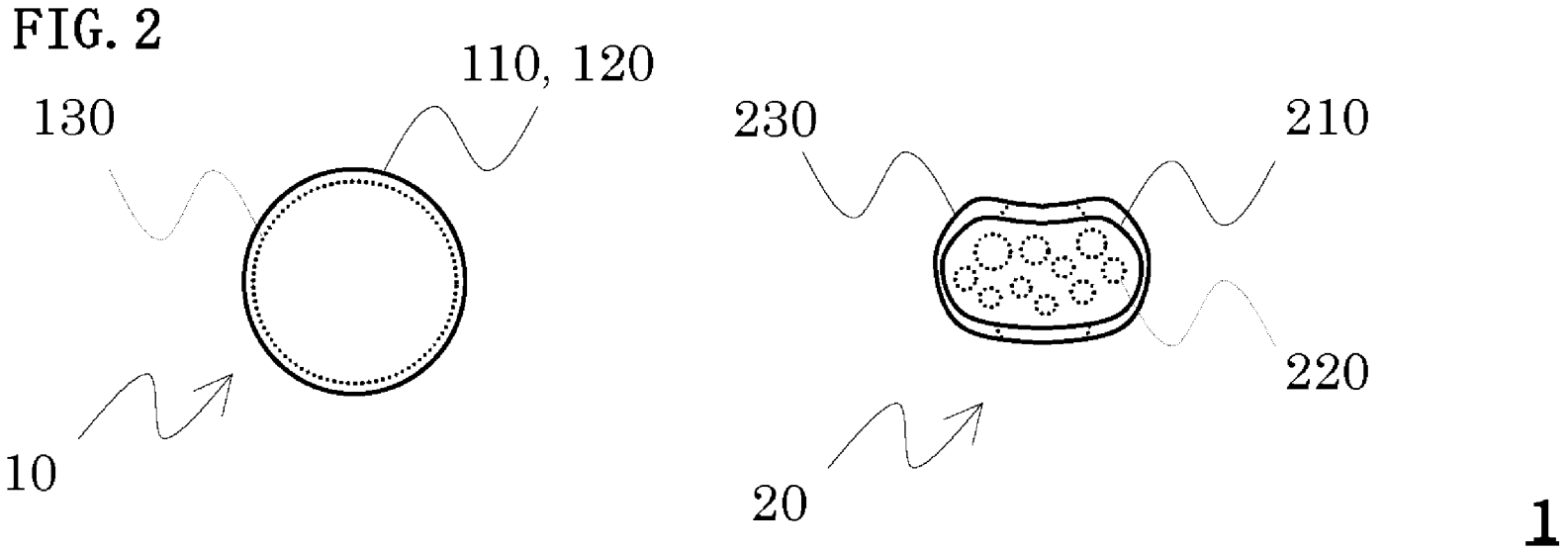
FIG. 2 is a top view showing the tubular diffusion body 10 and the columnar diffusion body 20 in the sound diffusion body 1 according to the first embodiment of the present invention.
Figure 3:
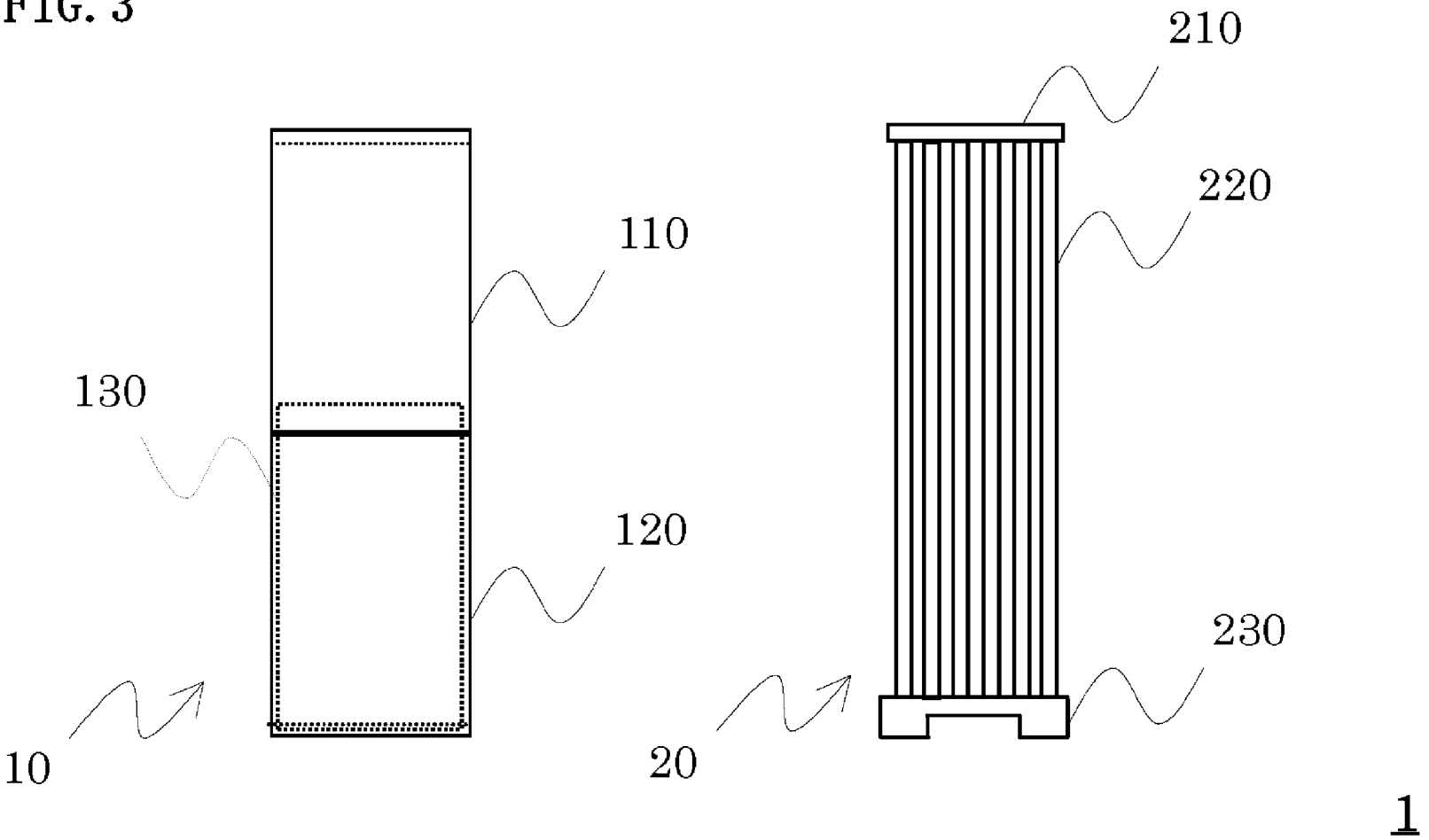
FIG. 3 is a front view showing the tubular diffusion body 10 and the columnar diffusion body 20 in the sound diffusion body 1 according to the first embodiment of the present invention.
Figure 4:
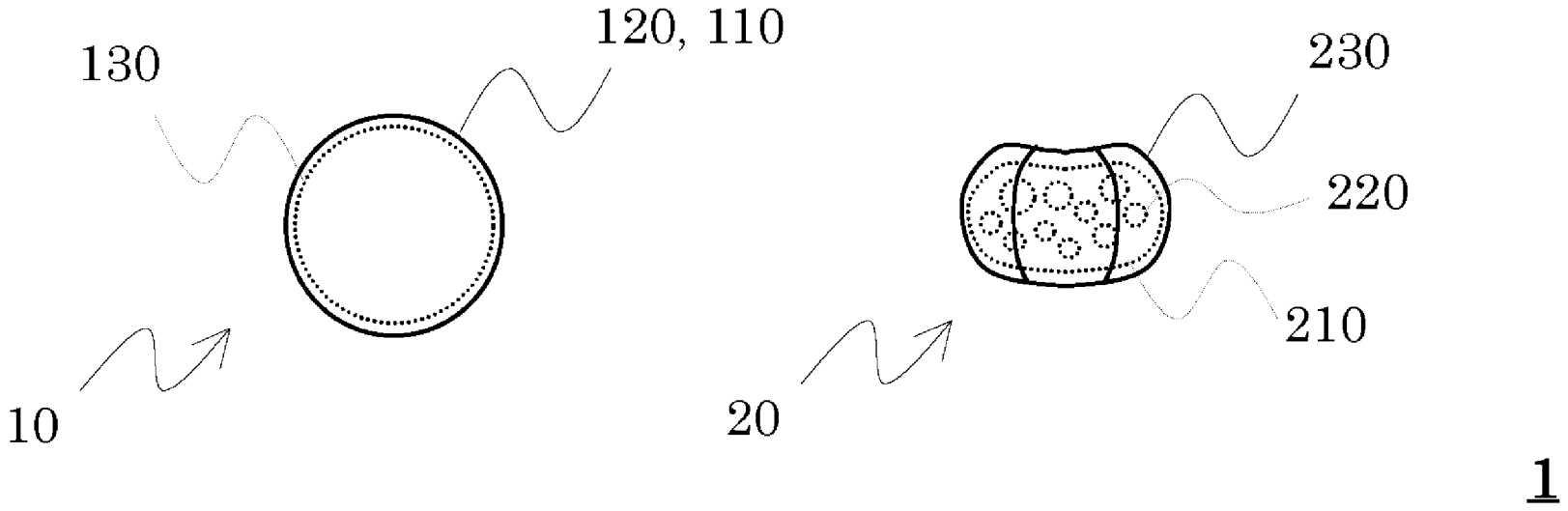
FIG. 4 is a bottom view showing the tubular diffusion body 10 and the columnar diffusion body 20 in the sound diffusion body 1 according to the first embodiment of the present invention.

Firstly, the configuration of a sound diffusion body 1 of a first embodiment of the present invention will be outlined with reference to a conceptual diagram of FIG. 1.

The sound diffusion body 1 of the first embodiment of the present invention includes the following main components: a tubular diffusion body 10 and a columnar diffusion body 20.

The tubular diffusion body 10 can adjust primarily a sound field of a low-tone range with a frequency of several hundred Hz or less. The columnar diffusion body 20 is used in adjusting primarily a sound field of a middle-tone to a high-tone range (a middle-to-high tone range) with a frequency of about 1,000 Hz or more.

More specifically, the sound diffusion body 1 of the first embodiment of the present invention can be used, with the columnar diffusion body 20 placed into the tubular diffusion body 10.

Moreover, as shown in FIG. 1, it is possible to separate the tubular diffusion body 10 from the columnar diffusion body 20; the tubular diffusion body 10 and the columnar diffusion body 20 can be separately placed in a room. It is also possible to dispose an upper column 110 and lower column 120 of the tubular diffusion body 10 separately in a room.

Moreover, the tubular diffusion body 10 and the columnar diffusion body 20 are not only combined but also are designed to optimize an adjustable frequency band, enabling one device to adjust sound of each frequency band of the room in the most appropriate manner.

The following provides a more detailed description of the configuration of the sound diffusion body 1 with reference to the drawings.

Figure 5:
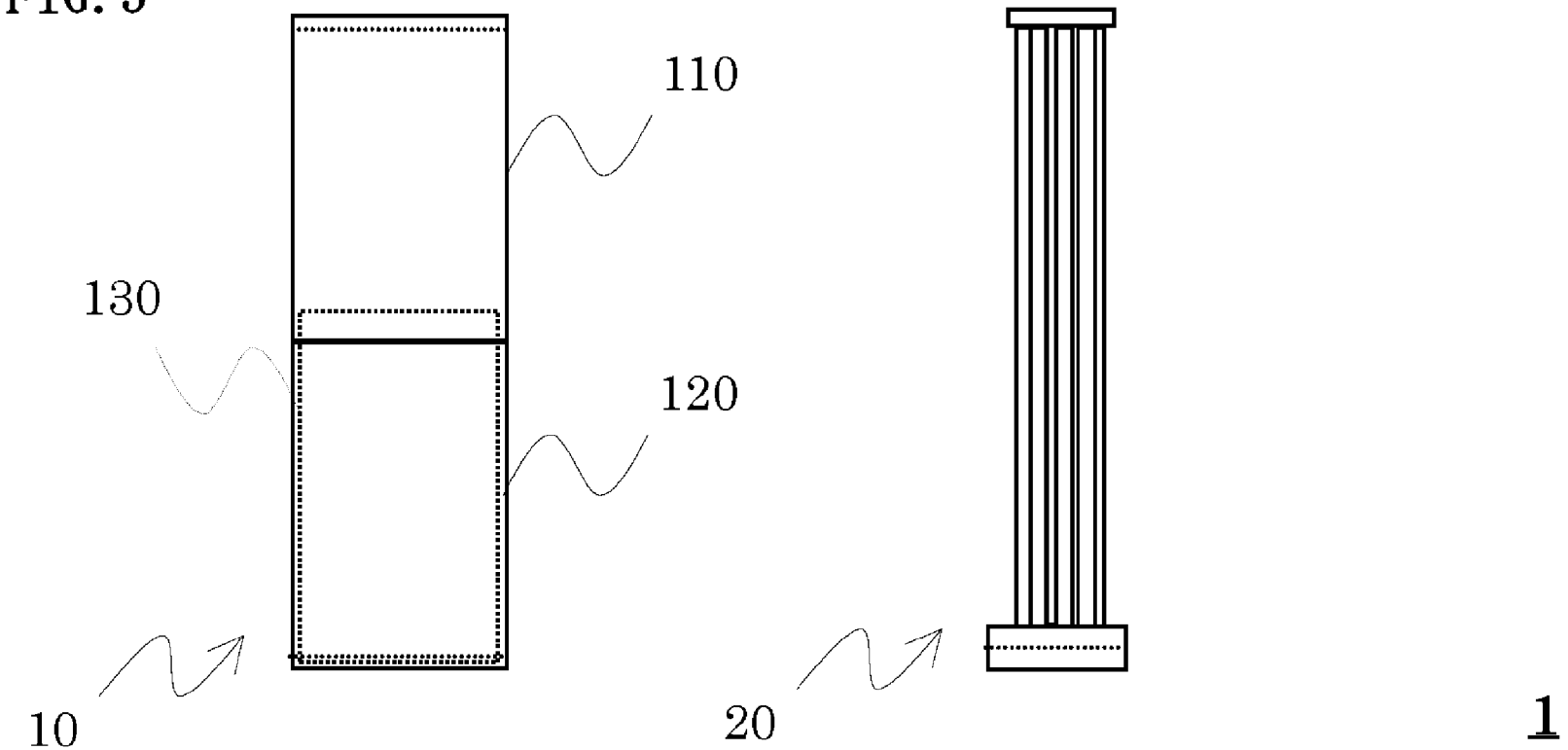
FIG. 5 is a side view showing the tubular diffusion body 10 and the columnar diffusion body 20 in the sound diffusion body 1 according to the first embodiment of the present invention.

With reference to FIGS. 2 to 5, the following diagrams will be described at a time when the sound diffusion body 1 is divided into the tubular diffusion body 10 and the columnar diffusion body 20: a top view (FIG. 2), a front view (FIG. 3), a bottom view (FIG. 4), and a side view (FIG. 5). Incidentally, the right side view and the left side view are in a symmetrical relation; therefore, only the right side view is shown with the left side view omitted.

[Configuration of Tubular Diffusion Body 10]

The tubular diffusion body 10 is a cylindrical sound diffusion body that can be divided, and includes the upper column 110, the lower column 120 and an adjustment section 130.

As for the dimensions of the tubular diffusion body 10, the upper or lower surface is, for example, formed so as to have a diameter of about 43 cm. The height of the entire tubular diffusion body 10 can be about 146 cm. The upper column 110 can be 73 cm in height, and the lower column 120 about 73 cm in height as well.

With such a large diameter, the cylindrical diffusion body has reflection and sound-absorption performance sufficient enough for a low-tone range of around several Hz to several hundred Hz.

The tubular diffusion body 10 is, for example, made of a relatively lightweight material with sound-wave losses at a sufficient surface or with internal loss, such as tubular recycled paper like cardboard, recycled paper solidified by resin, nonwoven fabric, or glass wool. For example, for the tubular diffusion body 10, in the case of cardboard, a paper tube made of cardboard with a thickness about 2.5 mm can be used. Incidentally, as described below, the paper tube may be different in thickness between the upper column 110 and the lower column 120.

The tube is produced using such a material. Therefore, the cost of producing the tubular diffusion body 10 is lower than that of the columnar diffusion body 20.

When being delivered, the tubular diffusion body 10 serves as a packing material, with the columnar diffusion body 20 placed therein. When the tubular diffusion body 10 is used as a packing material, the sound-absorption and reflection performance remains almost unchanged even if the tubular diffusion body 10 is somewhat damaged or distorted because a low-pitched sound has a long wavelength. Moreover, the tubular diffusion body 10 can be easily returned or replaced because the tubular diffusion body 10 is not expensive.

Furthermore, if the columnar diffusion body 20 is placed into the tubular diffusion body 10, it is easy to store, move or transport the sound diffusion body 1 at a time when the sound diffusion body 1 is not in use.

Incidentally, the tubular diffusion body 10 is not necessarily in the shape of a cylindrical column. The tubular diffusion body 10 that is in the shape of an elliptic, bow-shaped or star-shaped column may be used.

Here, each component of the tubular diffusion body 10 will be detailed.

The upper column 110 and the lower column 120 are formed into a similar cylindrical column. The upper or bottom surface of each column is capped with a similar material to that of a side surface (peripheral wall). A circular plate may be embedded for reinforcement.

The adjustment section 130 is made of a similar material to that of the upper column 110 and the lower column 120, and is a cylindrical column whose both ends are not closed (open). The adjustment section 130 is about 0.1 to 0.5 mm smaller in diameter than that of the upper column 110 or lower column 120. The adjustment section 130 is reasonably elastic, and come in contact with the upper column 110 and the lower column 120 so as to support the upper column 110 and the lower column 120 from the inside with the help of friction. Incidentally, as for the diameter of the adjustment section 130, all that is required is a clearance (extra space) to the extent that there is no unsteadiness between the upper column 110 and the lower column 120. Moreover, the frictional force of the adjustment section 130 may be raised using elastomer or rubber. With a wedge-shaped locking structure provided, the upper column 110 and the lower column 120 may be connected together.

Moreover, the height of the adjustment section 130 can be set about 10 cm higher than the upper column 110 and the lower column 120, for example at about 740 cm. Therefore, it is possible to fix the adjustment section 130 in such a way that the lower surface of the upper column 110 comes in contact with the upper surface of the lower column 120. Moreover, as described below, the adjustment section 130 can be used to change the frequency of a low-pitched sound, which is to be absorbed or diffused, by adjusting the length for fixing the upper column 110 and the lower column 120.

[Configuration of Columnar Diffusion Body 20]

The columnar diffusion body 20 is made up of a ceiling section 210, a plurality of diffusion columns 220, and a base section 230.

The columnar diffusion body 20 is, for example, made of wood building materials such as flame-resistant wood or natural wood, plastics that reduce vibrations, metal, or other materials. The columnar diffusion body 20 can produce a natural sound field as the diffusion columns 220 diffuse primarily sound waves of the middle-tone and high-tone ranges. For the columnar diffusion body 20, the low-tone range is acoustically "transparent," allowing sound waves of a low-tone range to pass backward without being reflected or diffused. However, even when the low-pitched sound is allowed to pass backward, what is obtained is the effect of breaking the phase of the low-pitched sound. As for the dimensions of the columnar diffusion body 20, for example, the length of a long side can be about 40 cm in the case of the top view of FIG. 2, and the length of a short side about 20 cm. As for the dimensions of the columnar diffusion body 20, the height can be about 130 cm in the case of the front view of FIG. 3.

The columnar diffusion body 20 uses a plurality of diffusion columns 220 that are disposed in a random manner. The sound waves diffused or reflected by the diffusion columns 220 spread in every direction, i.e. in the forward, backward, left-hand and right-hand directions. Therefore, compared with an acoustic panel that mainly absorbs sound and reflect the sound in a predetermined direction as in the acoustic panel of Conventional Technology 1, it is possible to obtain a sound that spreads naturally.

The columnar diffusion body 20 is not a wall material. Each component of the columnar diffusion body 20 is adjusted so that the columnar diffusion body 20 can be mainly placed on the floor, for example, next to a speaker or the like before being used. Therefore, the columnar diffusion body 20 is relatively compact in size. Moreover, the position where the columnar diffusion body 20 is placed can be freely changed according to a sound-field environment of the speaker or room; the sound can be easily adjusted through settings by a user. Therefore, it is possible to achieve a significant improvement in sound effects.

Here, the configuration of each component of the columnar diffusion body 20 will be detailed.

The ceiling section 210 is a portion that supports a plurality of diffusion columns 220 in an upper portion. The ceiling section 210 is formed in the following manner: Holes are made on wood so that a plurality of diffusion columns 220 passes therethrough. The ceiling section 210 is so formed that a plurality of diffusion columns 220 are inserted into the holes. As shown in the top view of FIG. 2, the diffusion columns 220 are disposed in a plurality of lines so as to draw a curved line like an elliptic arc with both ends curved. Therefore, it is possible to give moderate directionality so that more sound waves are diffused in the direction of a convex portion of the curved line, which is for example the front direction. The resulting advantage is that it becomes easier to adjust sound instinctively. Incidentally, if the base section 230 is designed strong enough to fix the diffusion columns 220, it is possible to eliminate the ceiling section 210.

A plurality of diffusion columns 220 is provided on the columnar diffusion body 20. The diffusion columns 220 are in the shape of a cylindrical column and different in diameter. Each of the diffusion columns 220 is able to diffract, diffuse and reflect a sound wave of a frequency corresponding to the diameter of the column. Incidentally, as for the material of the diffusion columns 220, natural wood such as typical pine or cedar, which is similarly used for the ceiling section 210 or base section 230, can be used. What is also used is a lightweight wood piece, such as balsa wood, that is colored with lacquer or the like or impregnated with resin to increase the strength thereof. Therefore, the columnar diffusion body 20 becomes lighter as a whole; it is possible to decrease damage to the floor or goods at a time when the columnar diffusion body 20 falls, and the columnar diffusion body 20 becomes easier to use. Similarly, for the diffusion columns 220, natural bamboos that are different in diameter can be selectively used.

The base section 230 is a portion that supports a plurality of diffusion columns 220 in a lower portion. As in the case of the ceiling section 210, the base section 230 is formed in the following manner: Holes are made on wood so that a plurality of diffusion columns 220 passes therethrough. The shape of the base section 230 is similar to the shape of the ceiling section 210 as shown in the top view of FIG. 2. In order for the base section 230 to become stable when being placed, the base section 230 may be so formed as to have a slightly large area. In order to reduce the adverse effects of vibrations from the floor and curb unsteadiness of the base section 230 being placed, a concave portion, like a notch, can be formed on a bottom surface portion as shown in the front view of FIG. 3 and the bottom view of FIG. 4. In this case, to the portions that come in contact with the floor, a material that reduces vibrations, such as butyl rubber or silicone gel, may be bonded. Furthermore, a cone including zircon sand or the like may be provided on the base section 230. Therefore, it is possible to increase the stability of the columnar diffusion body 20 when the columnar diffusion body 20 is placed.

Furthermore, the arrangement of a plurality of diffusion columns 220 will be detailed.

Basically, the diffusion columns 220 are arranged randomly. However, with respect to primarily an incoming sound wave, columns of smaller diameters are arranged on the near side, and columns of larger diameters are placed behind the smaller-diameter columns.

The reason the columns of smaller diameters are arranged on the near side is as follows: it is not acoustically desirable to place the thick diffusion columns 220 on the near side. The reason is that in the case of the larger-diameter diffusion columns 220, diffusion takes place as described above at a lower frequency, while the diffusion directions are not uniform for a wave surface of a higher-frequency sound with increased directivity.

Accordingly, in the columnar diffusion body 20 of the sound diffusion body 1 of the first embodiment of the present invention, the thin diffusion columns 220 are placed closer to a sound source for a high-tone range to diffuse a sound wave of a high-tone range.

Therefore, it is possible to achieve a moderate change of acoustic resistance (impedance) of the diffusion columns 220 and prevent high-level reflection from occurring on a surface of the columnar diffusion body 20.

The reason that the diffusion columns 220 in each row are placed randomly is that it is possible to prevent coloration (tone-color changes) of a specific frequency associated with orderly arrangement.

Incidentally, the diffusion columns 220 may be in the shape of not only a simple cylindrical column but also "entasis" with a slightly swelled central portion. In this case, it is possible to obtain the effects of diffusing, reflecting and absorbing sound waves not only in the horizontal direction of the room but also in the vertical direction. Therefore, it is possible to obtain a more in artificial sound field. Moreover, the cross-sectional surfaces of the diffusion columns 220 are not necessarily in a circular shape; elliptical or star-shaped cross-sectional surfaces or other shapes can be also used. Moreover, as described above, the diffusion columns 220 may be so formed as to have joints like bamboo joints.

When the diffusion columns 220 are arranged in rows (or in a staircase pattern), the advantage is that it is easy to form the diffusion columns 220.

As for the distances between the diffusion columns 220 in a row, with the use of random numbers and with a random arrangement degree of about 5 to 50%, the distances are randomly set so that the distances are different from each other.

Moreover, when the rows of the diffusion columns 220 of each diameter are arranged in a multistage pattern, the distances between the columns are each adjusted according to a parameter of a rate at which the rear side becomes visible on a projection plane that is perpendicular to a length direction of the diffusion columns 220.

By default (standard settings), for example, it is preferred that, in the vertical direction with respect to the length direction of the columns, the projection area of all the diffusion columns 220 be 95% or more of the entire projection area in order to increase the diffusion performance of the columnar structure. That is, the arrangement is adjusted to the extent that the rear side cannot be seen due to a group of columns.

Therefore, it is possible to reduce the effects of the reflection of the sound waves, which have not been diffused by the diffusion columns 220, from the rear-wall surface. Moreover, even when there is no surface on the rear side, the diffusion columns 220 can serve as dividers to prevent adverse effects on the sound field because the rear side cannot be directly seen because of the diffusion columns 220.

[Adjusting Absorption of Low-Pitched Sound]

The following describes how to adjust a low-tone range using the tubular diffusion body 10.

When the columnar diffusion body 20 is arranged under the above arrangement condition, most of the sound in the middle-and-high-tone range is reflected by the front or middle row of the diffusion columns 220; mainly the sound of a low-tone range goes beyond the back row and passes therethrough. In this case, the resulting sound is a sound of a low-tone range with various phases. Therefore, compared with a conventional acoustic panel that is simply in the shape of a plate, it is possible to give a sense of spreading of a room as well as to obtain an excellent sound field.

In this case, the dimensions of the columnar diffusion body 20 need to be set in such a way that the columnar diffusion body 20 is placed next to a speaker of a room or at other locations. Therefore, it is possible to obtain the diffusion effects of a middle- and high-tone range of for example 1,000 Hz or more. However, the effects of absorbing and diffusing a sound of a low-tone range of for example 300 Hz or less with a long wavelength are not so significant.

Accordingly, in order to reduce standing waves, flutter echoes or the like in a low-tone range particularly at a time when a speaker is placed at a corner of a room, the use of the tubular diffusion body 10, as well as of the columnar diffusion body 20, makes it possible to make more effective adjustments to the sound of the room. That is, with the tubular diffusion body 10, it is possible to solve the problem that a low-pitched sound is muffled.

At this time, what is important is to control the frequency characteristic of a low-pitched sound, the diffusion/absorption relationship, the frequency band, the reflection direction, a reflection-time structure and the like according to the state of the sound in the room. That is, it is necessary to control the ratio of diffusion of sound of a specific frequency to absorption of the sound.

Figure 6:
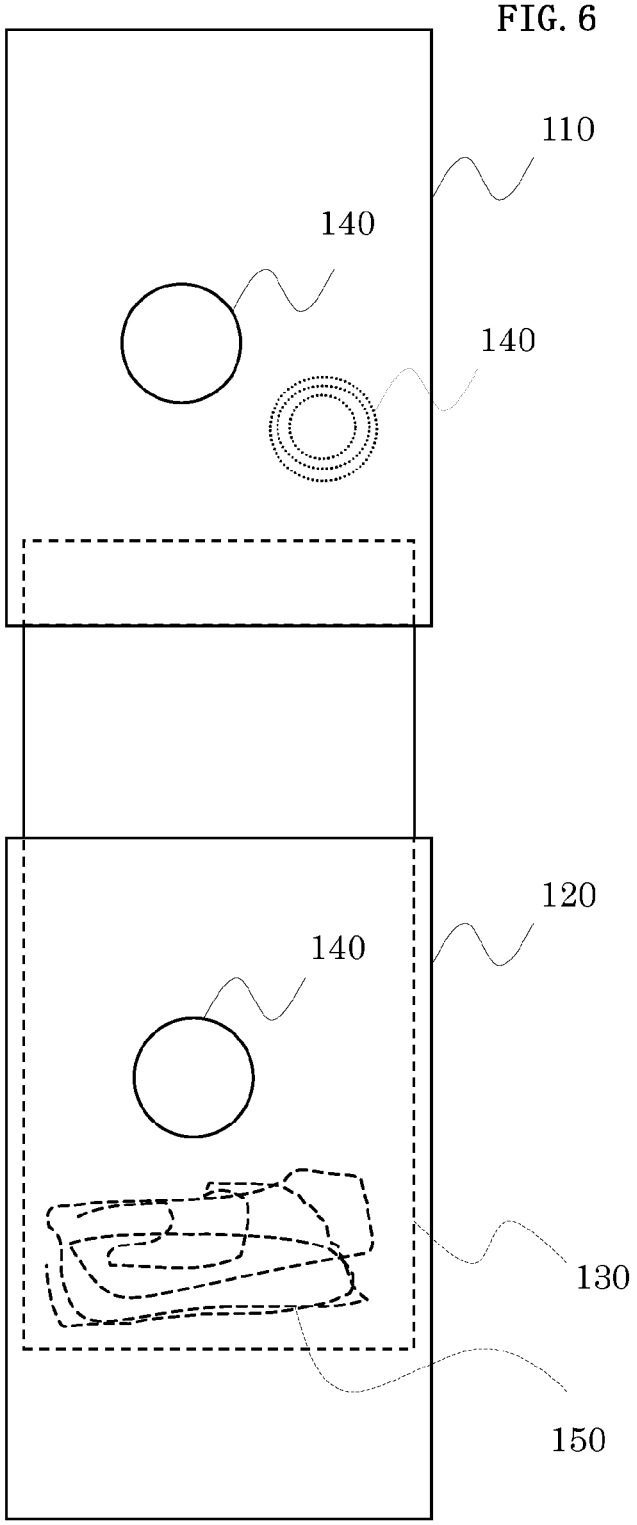
FIG. 6 is a conceptual diagram showing adjustment of a low-pitched sound of the tubular diffusion body 10 according to the first embodiment of the present invention.

The following description is based on FIG. 6. When the upper column 110 and the lower column 120 are used in combination after a lower portion of the upper column 110 is connected to an upper portion of the lower column 120, the use of the adjustment section 130 makes it possible to adjust the height of the entire tubular diffusion body 10.

Therefore, it is possible to adjust the strength of a low-pitched sound that is absorbed and diffused. Incidentally, needless to say, after the height is adjusted as described above, the columnar diffusion body 20 may be provided in the tubular diffusion body 10. In general, it is possible to weaken the diffusion/radiation effects of the middle- and high-tone ranges when the columnar diffusion body 20 is provided in the tubular diffusion body 10. Therefore, the columnar diffusion body 20 provided in the tubular diffusion body 10 is effective in reducing the reverberant sound in the room or in other cases.

Moreover, resonance holes 140 may be made on the upper column 110 and/or lower column 120 of the tubular diffusion body 10. For the diameter of the resonance holes 140, the frequency of a "room resonance" of a listening room that a user uses may be used. That is, by adjusting the diameter of the resonance holes 140 to a projecting point that is in the shape of a frequency band of the room, it is possible to further absorb a low-pitched sound. In addition, since a flexible material such as paper is used for the tubular diffusion body 10, it is easy for a user to process the tubular diffusion body 10. More specifically, on the upper column 110 or the lower column 120, resonance holes corresponding to the frequencies of low-pitched sounds are printed, or printed or processed with perforations, allowing a user to tear and cut a hole corresponding to a frequency thereof with scissors or hands. The holes are formed concentrically. It is possible to obtain the most appropriate resonant frequency by tearing and cutting the holes one after another, from smaller holes for higher frequencies to larger holes for lower frequencies. Incidentally, a plurality of resonance holes 140 may be provided but not formed concentrically; it is possible to provide additional perforations corresponding to the frequencies. Moreover, a large number of resonance holes may be made, and a relatively large opening may be provided; the holes or opening are able to serve as sound-introduction port after being adjusted.

Furthermore, in addition to the above, the upper column 110 or the lower column 120 of the tubular diffusion body 10 may be stuffed with a sound-absorption material 150 with high internal losses such as felt, glass wool, zircon sand or the like. Therefore, it is possible to further improve the effects of absorbing a low-pitched sound. Incidentally, the upper column 110 or the lower column 120 may be stuffed with the sound-absorption material 150 in such a way that the sound-absorption material 150 is attached to the inside of the upper column 110 or the lower column 120. The upper column 110 or the lower column 120 may be stuffed at a time when the upper column 110 is separated from the lower column 120.

In that manner, the middle- and high-tone ranges are diffused by the columnar diffusion body 20, and the absorption and diffusion of sound of a low-tone range is controlled with the use of the tubular diffusion body 10. While providing the strong sound-absorption performance that is aimed at a room resonance frequency of a listening room that a user uses, it is possible to obtain broad diffusion effects, from a low-tone range to a high-tone range.

[Example of Arrangement of Sound Diffusion Body 1]

The following describes an example of the arrangement of the sound diffusion body 1 in a room with reference to FIG. 7.

As described above, without the need to separate the tubular diffusion body 10 from the columnar diffusion body 20, the sound diffusion body 1 can be placed next to a speaker or the like, at a corner of the room, or other locations that are most suitable for adjusting a sound field before being used.

Moreover, as in the example of FIG. 7, the sound diffusion body 1 may be used together with the columnar diffusion body 20 after the tubular diffusion body 10 is separated.

Figure 7A:
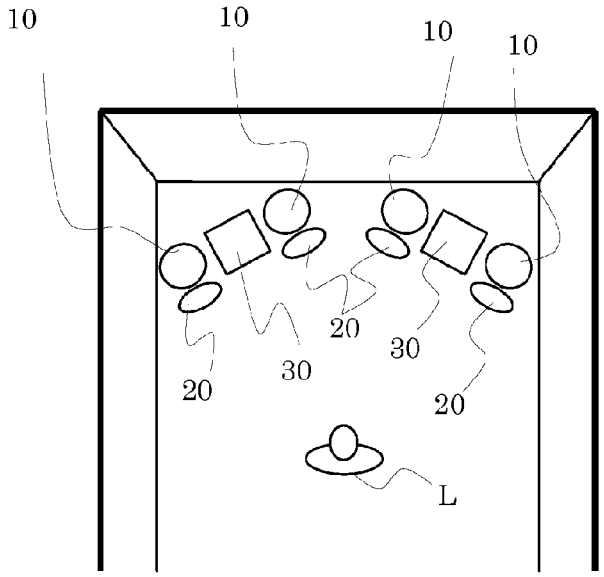
FIG. 7A and FIG. 7B are conceptual diagrams showing a method of arranging the sound diffusion body 1 in a room according to the first embodiment of the present invention.

In the example of FIG. 7A, four sound diffusion bodies 1 are used and placed next to a speaker 30. FIG. 7A shows an example in which the tubular diffusion bodies 10 and columnar diffusion bodies 20 of the sound diffusion bodies 1 of the first embodiment of the present invention are used in combination. In this case, the columnar diffusion bodies 20 are placed on the left and right sides of the corresponding speakers 30 so as to be closer to a listener L. The tubular diffusion bodies 10 are placed behind the corresponding columnar diffusion bodies 20.

According to a Conventional Technology, if a pair of speakers is placed along a short side of the room, a low-pitched sound is reinforced and reflected particularly at the corners of the room, producing muffled sounds with excess low-pitched sounds and, in many cases, damaging the sound field. Moreover, as for a middle-pitched or high-pitched sound, reflected waves are reflected off the walls before directly reaching a user, or listener L. Therefore, it is difficult to obtain a sense of spreading of sound beyond the width of the arrangement of the speakers 30.

On the other hand, in the example of FIG. 7A, among the frequencies of the middle- and high-tone ranges emitted from the speakers 30, which are for example tweeters, squawkers and the like, it is possible to diffuse sound waves that, as spherical waves, spread in the horizontal direction of speaker boxes of the speakers 30. Furthermore, with the use of the tubular diffusion bodies 10, it is possible to absorb and diffuse sound waves of a low-tone range emitted from, for example, a bass reflex port of the speaker 30, and a sound "muffled" at the corners of the room.

Therefore, it is possible to provide a sense of spreading of reflected waves that reach the ears of a user after the waves are reflected off the walls; reduce flutter echoes and the like; improve a feeling of reverberation; and obtain a sound-field environment that is more desirable for the listener L. Thus, it is possible to prevent that the original sound played from the speakers 30 becomes "nasty" sound by excess echoes or the like in the room. Therefore, for example, the advantage obtained is that it is possible to listen to clear vocal sound or clear sound of each musical instrument with a more natural feeling of sound field. Moreover, as desired, the degree of a low-pitched sound being muffled can be adjusted by the arrangement of the tubular diffusion bodies 10, as well as by the resonance holes 140 or the sound-absorption material 150.

Figure 7B:
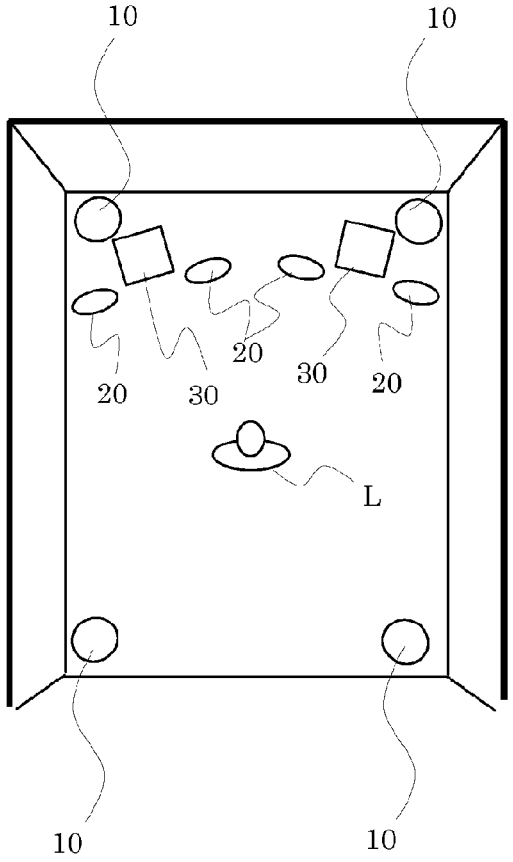

In the example of FIG. 7B, four sound diffusion bodies 1 are similarly used. FIG. 7B shows an example in which the tubular diffusion bodies 10 and columnar diffusion bodies 20 of the sound diffusion bodies 1 of the first embodiment of the present invention are separated before being used. In this example, the columnar diffusion bodies 20 are placed nearby speakers and the like, while the tubular diffusion bodies 10 are placed at the corners of a room.

If a speaker 30 in which a bass reflex port is positioned at a front side is placed at a corner of the room, a low-pitched sound is, in many cases, only slightly "muffled" compared with a speaker in which a bass reflex port is positioned at a back side.

Therefore, when the tubular diffusion bodies 10 are placed at the corners of the room behind the listener L as shown in FIG. 7B, it is possible to further improve a low-tone range and reduce flutter echoes and standing waves of the low-tone range. Moreover, since a low-pitched sound is absorbed, it is possible to reduce a wall resonance, caused by the resonating of the walls, as well as a floor resonance. Thus, it is possible to make sound effects of films and the like more realistic, among other things. Moreover, it is possible to make the tone color of a musical instrument with a large volume of low-pitched sound, such as a bass or timpani, clearer, enabling a listener to listen to vivid sounds.

Incidentally, in addition to those in the example of FIG. 7B, only a plurality of tubular diffusion bodies 10 may be used at any places other than behind the speakers. In this case, since the cost of producing the tubular diffusion bodies 10 is low as described above, a user can easily order and purchase additional tubular diffusion bodies 10.

At least, one sound diffusion body 1 can be used. When two sound diffusion bodies 1 are used, the sound diffusion bodies 1 may be placed only for a left-hand or right-hand speaker 30 that is closer to a left-hand or right-hand wall of the room.

Furthermore, the upper column 110 or the lower column 120 can be separated and placed before being used. That is, the upper column 110 and lower column 120 of the tubular diffusion body 10 can be separated and placed separately at the corners of the room or along the walls. Therefore, the upper column 110 or the lower column 120 can be used as furniture such as a chair or stool, and are rarely obstructive. Moreover, the upper column 110 or the lower column 120 can work as a diffusion/sound-absorption material for a low-tone range and are instrumental in improving the sound in the room.

Moreover, the sound diffusion body 1 can be used not only in a stereo system as shown in the example of FIG. 7 but also in a system having a plurality of speakers, such as a surround-sound system.

Second Embodiment

A sound generation system 2 of a second embodiment of the present invention includes the following main components: a sound generation device 40 and diffusion columns 221, which are columnar reflection objects and sound diffusion bodies placed around the sound generation device 40.

For the sound generation device 40, an arbitrary device can be used, as long as the device can serve as a sound source. For example, the sound generation device 40 can be any of the following devices that are used in reproducing sound: a speaker, exciter, vibrator, mechanical music box, bell, siren, automatic performance instrument, and a device that generates a sound wave by means of air vibration, such as a device that generates a sound wave in a similar way to a singer or musician. Moreover, the sound generation device 40 may be realized by a combination of the above devices.

The diffusion columns 221 may be in an arbitrary shape as in the shape of the diffusion columns 220 of the first embodiment of the present invention. A plurality of diffusion columns 222 may be realized by a combination of an arbitrary length, thickness, material and the like. The diffusion columns 222 may not stand perpendicularly; the diffusion columns 222 may be arranged diagonally or laterally.

With reference to arrangement examples of FIGS. 8A to 8F, FIGS. 9A to 9C, FIGS. 10A and 10B, FIGS. 11A and 11B, and FIGS. 12A and 12B, the configuration of the sound generation system 2 of the second embodiment of the present invention will be described in detail.

FIGS. 8A to 8F show examples of the arrangement of the sound generation device 40 and a plurality of diffusion columns 221 in the sound generation system 2 according to the second embodiment of the present invention.

Figure 8A:
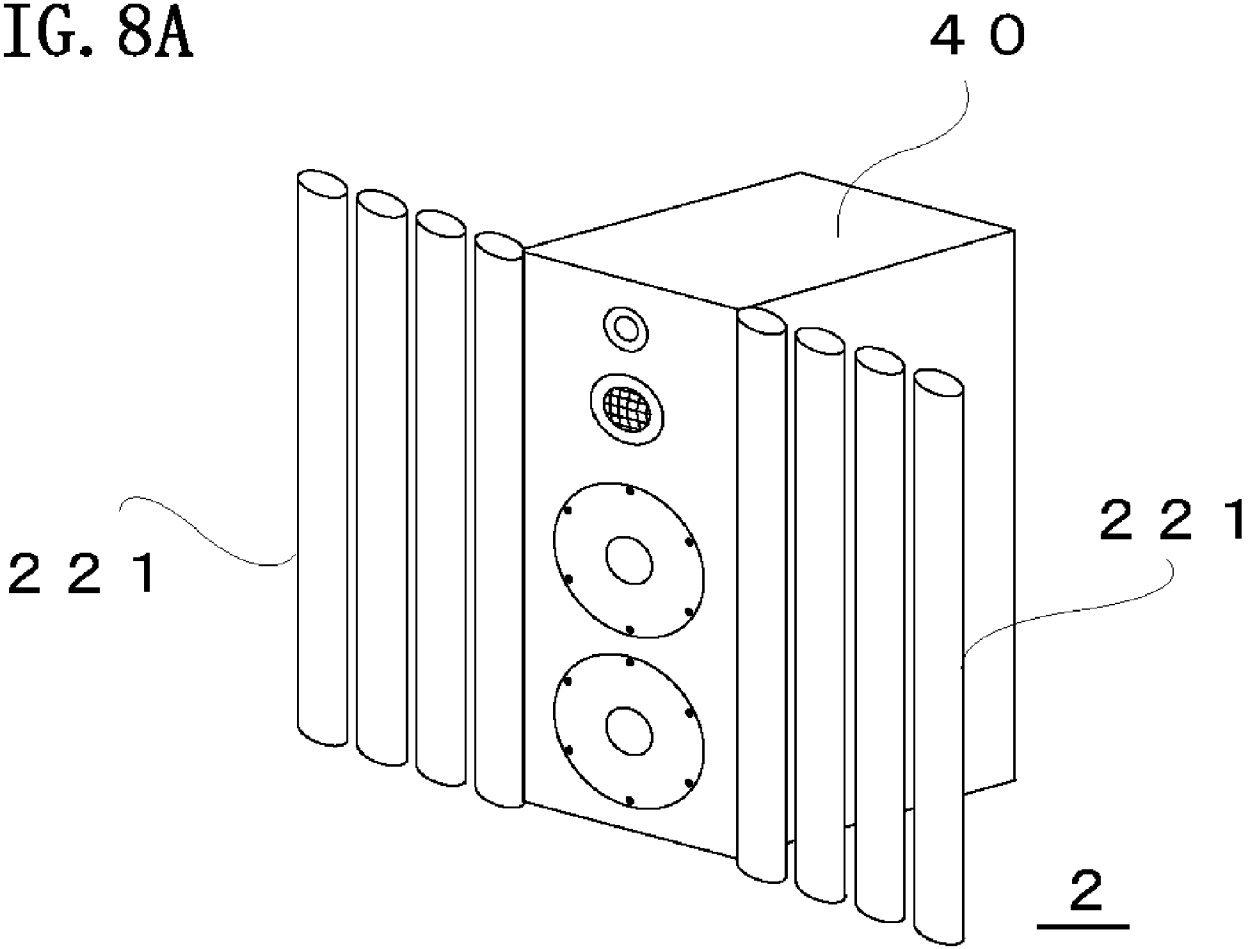
FIG. 8A is a perspective view showing an example of how a sound generation device 40 and a plurality of diffusion columns 221 in a sound generation system 2 are disposed according to a second embodiment of the present invention.
Figure 8B:
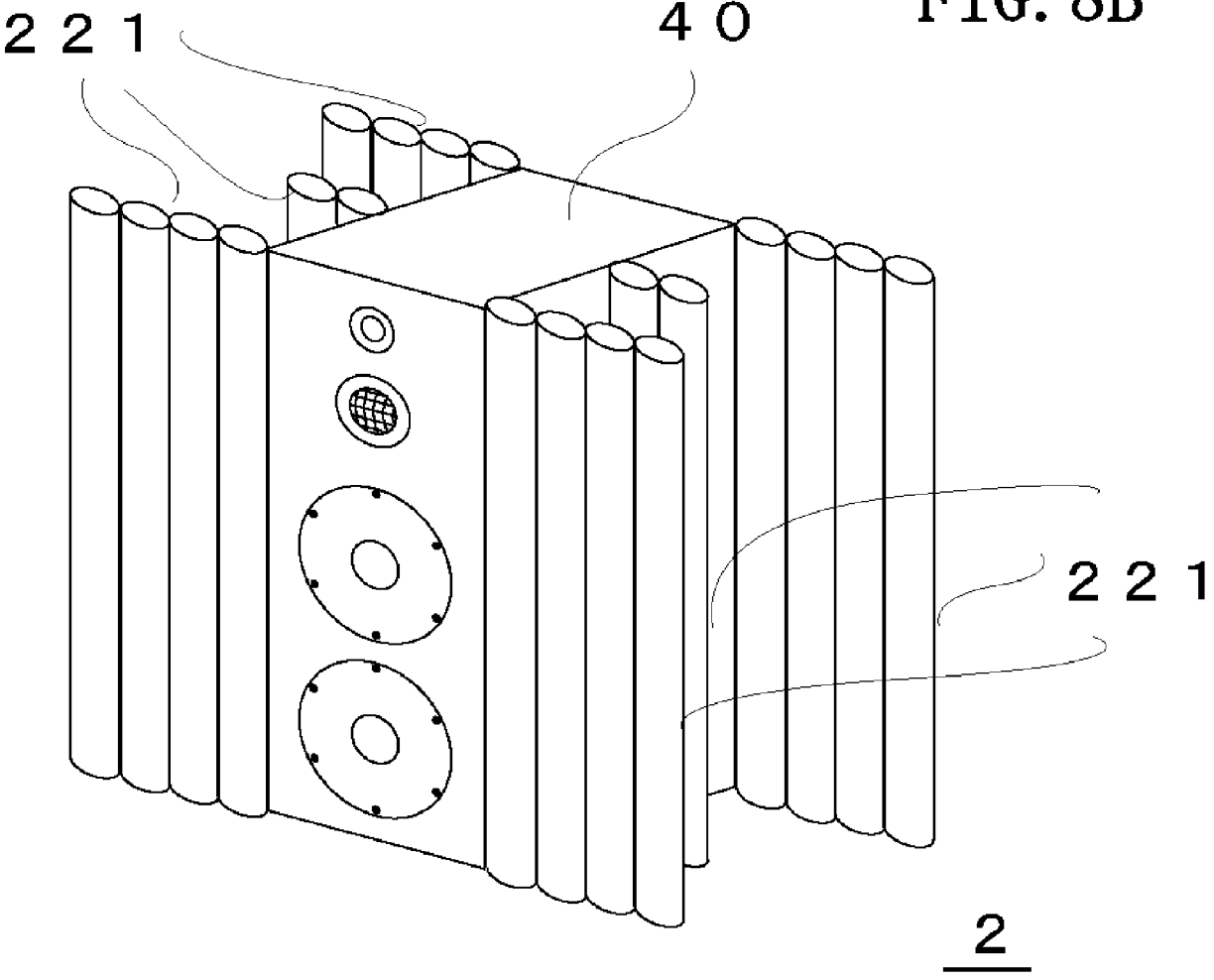
FIG. 8B is a perspective view showing an example of how a sound generation device 40 and a plurality of diffusion columns 221 in a sound generation system 2 are disposed according to the second embodiment of the present invention.
Figure 8C:
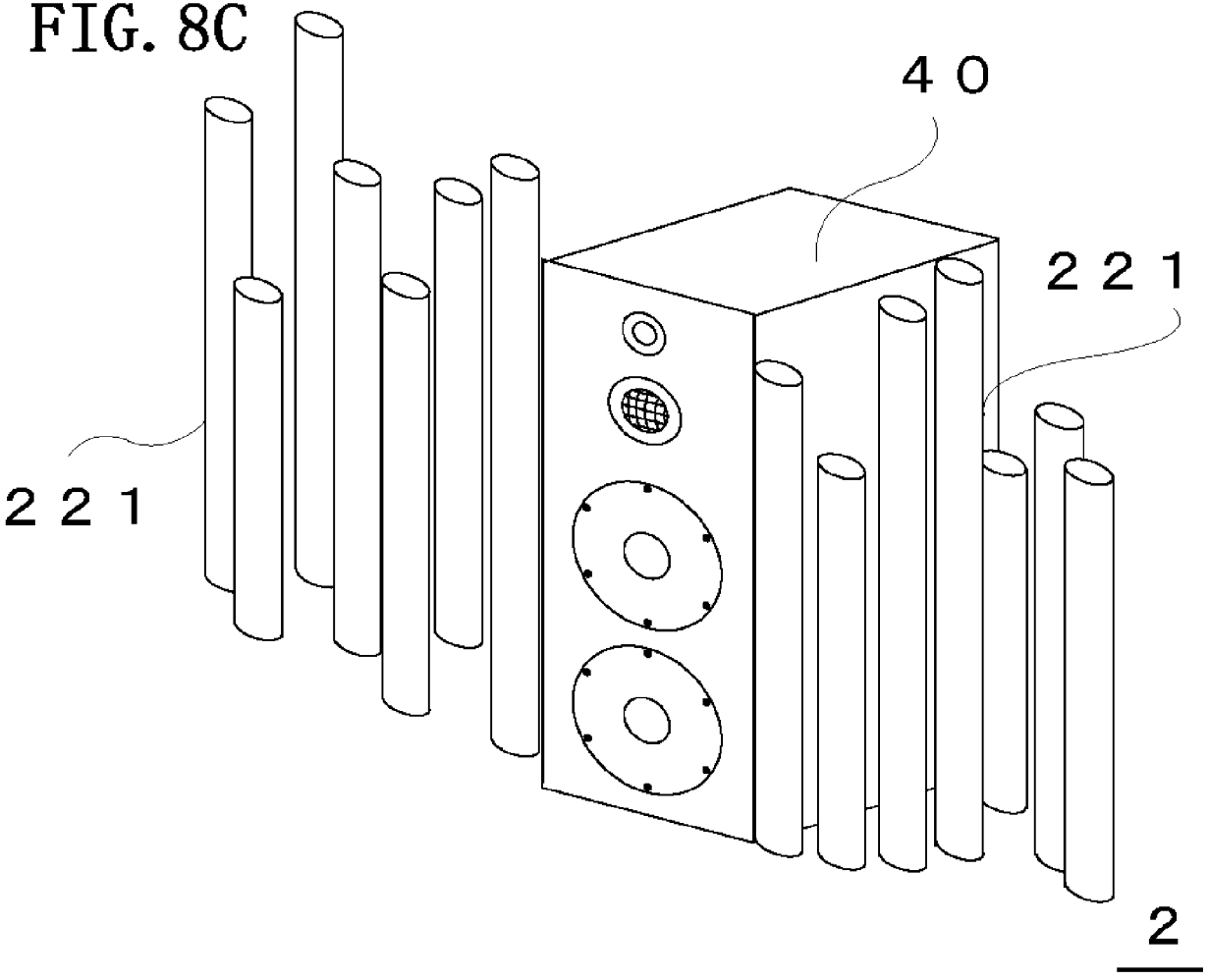
FIG. 8C is a perspective view showing an example of how a sound generation device 40 and a plurality of diffusion columns 221 in a sound generation system 2 are disposed according to the second embodiment of the present invention.
Figure 8D:
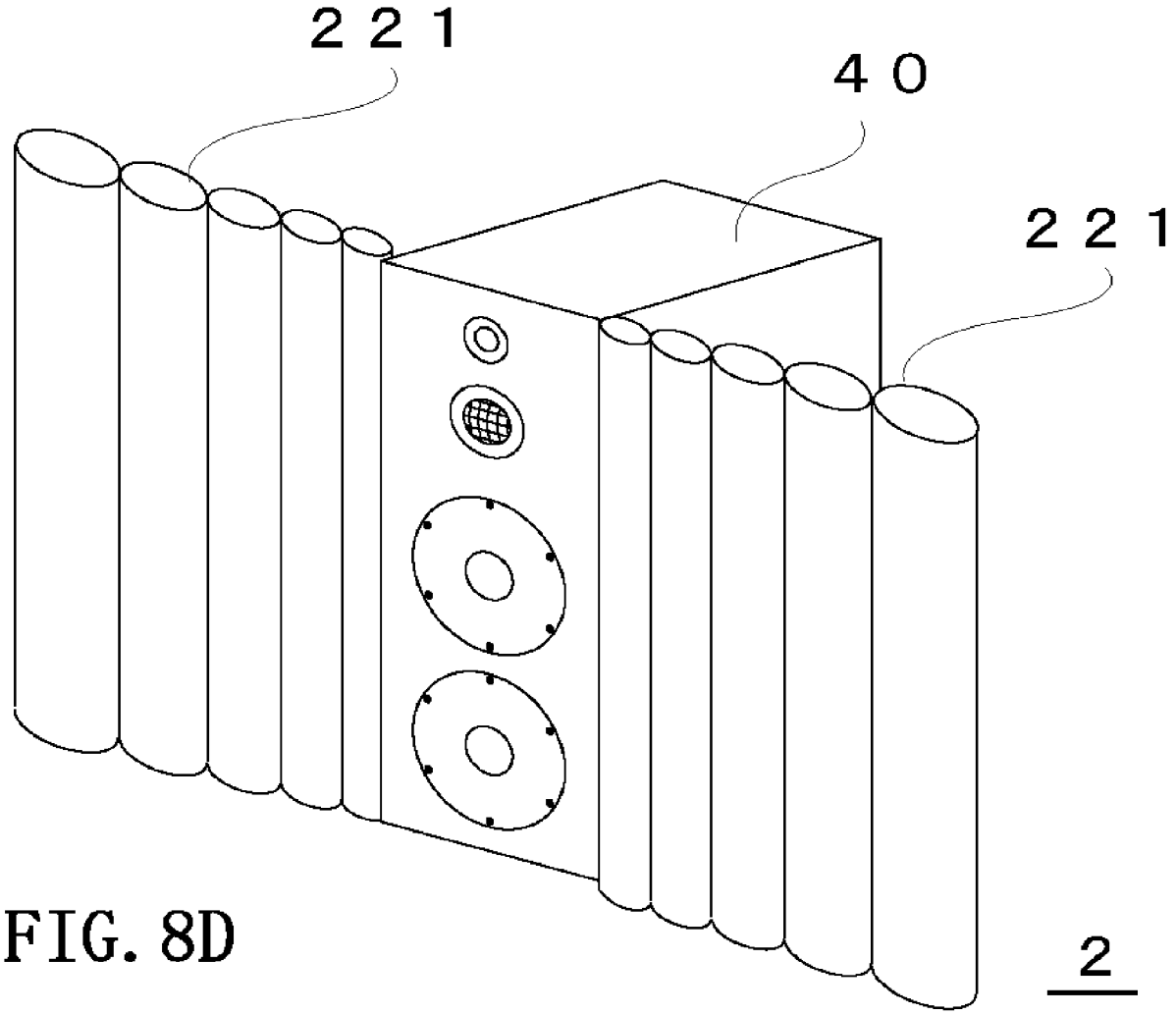
FIG. 8D is a perspective view showing an example of how a sound generation device 40 and a plurality of diffusion columns 221 in a sound generation system 2 are disposed according to the second embodiment of the present invention.
Figure 8E:
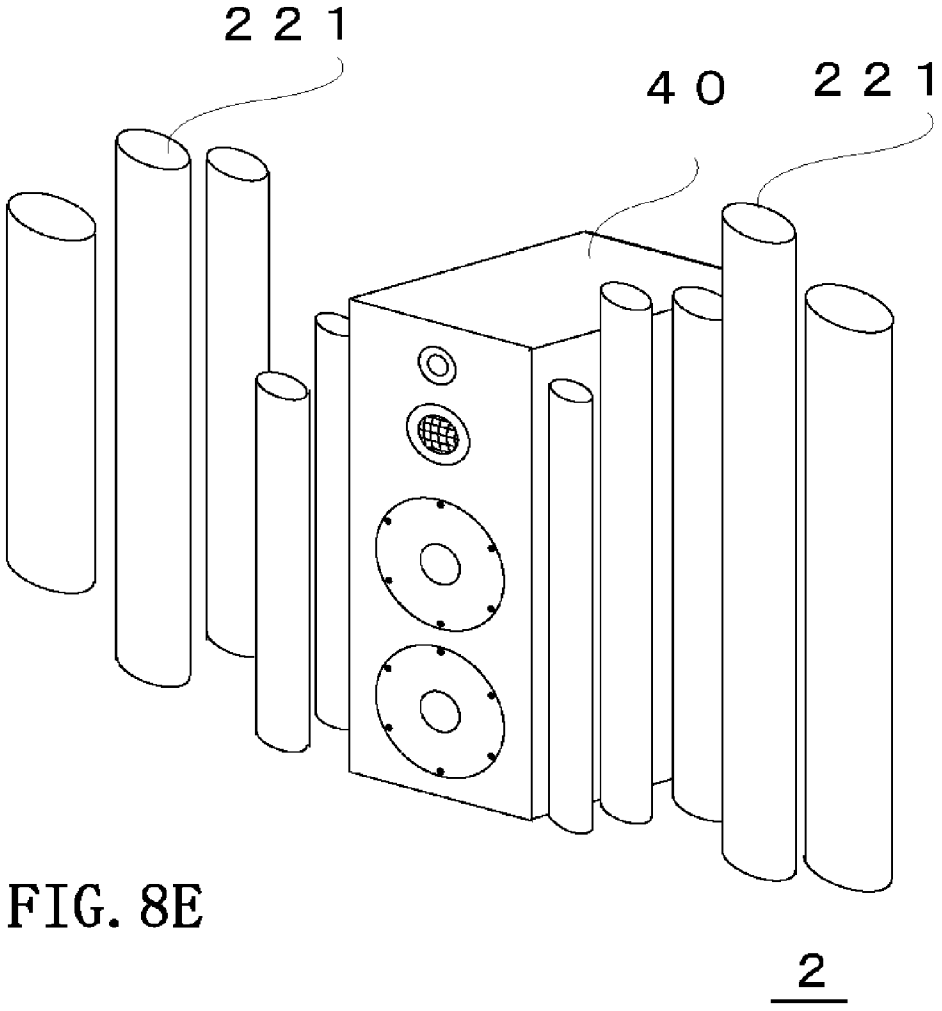
FIG. 8E is a perspective view showing an example of how a sound generation device 40 and a plurality of diffusion columns 221 in a sound generation system 2 are disposed according to the second embodiment of the present invention.
Figure 8F:
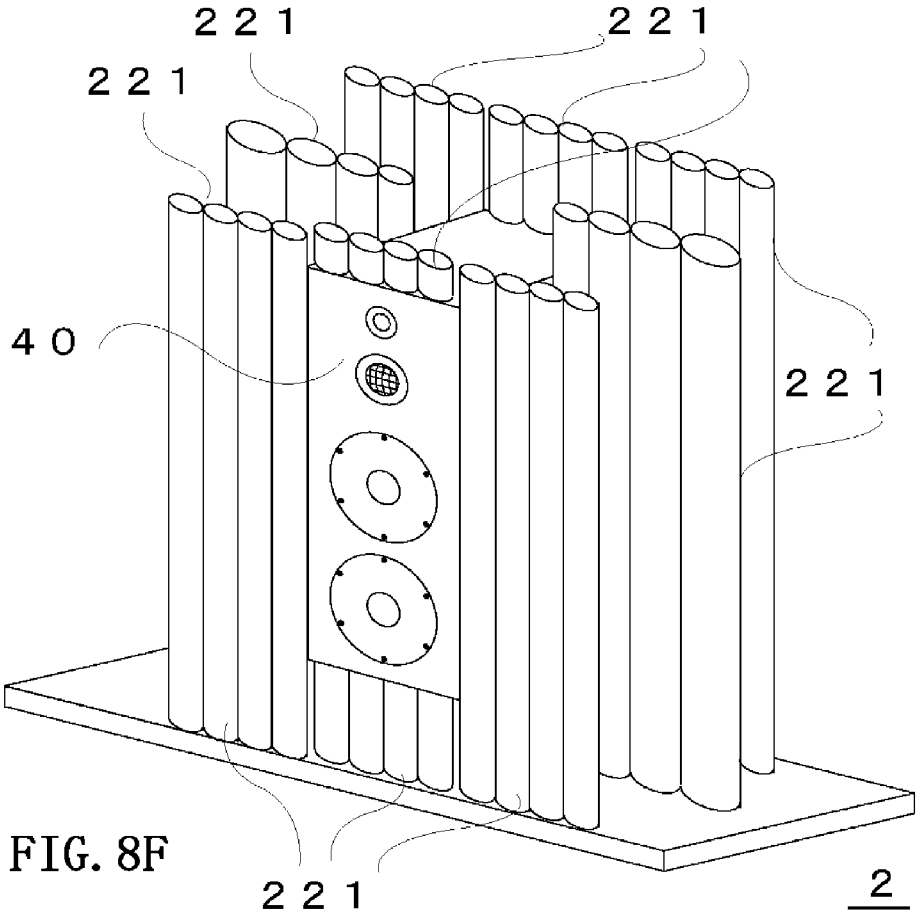
FIG. 8F is a perspective view showing an example of how a sound generation device 40 and a plurality of diffusion columns 221 in a sound generation system 2 are disposed according to the second embodiment of the present invention.

What is shown in the arrangement example of FIG. 8A is the case in which a plurality of diffusion columns 221 is arranged in one line on the left and right sides of the sound generation device 40. What is shown in the arrangement example of FIG. 8B is the case in which a plurality of diffusion columns 221 is arranged in a plurality of lines on the left and right sides of the sound generation device 40. What is shown in the arrangement example of FIG. 8C is the case in which a plurality of diffusion columns 221, which are randomly different in height, is arranged on the left and right sides of the sound generation device 40. What is shown in the arrangement example of FIG. 8D is the case in which a plurality of diffusion columns 221, which are randomly different in thickness, is arranged on the left and right sides of the sound generation device 40. What is shown in the arrangement example of FIG. 8E is the case in which a plurality of diffusion columns 221, which are randomly different in height and thickness, is arranged on the left and right sides of the sound generation device 40. What is shown in the arrangement example of FIG. 8F is the case in which a plurality of diffusion columns 221 is arranged on the upper, lower, rear, left and right sides of the sound generation device 40; a plurality of diffusion columns 221 and the sound generation device 40 are integrally embedded in a base portion 231.

Figure 9A:
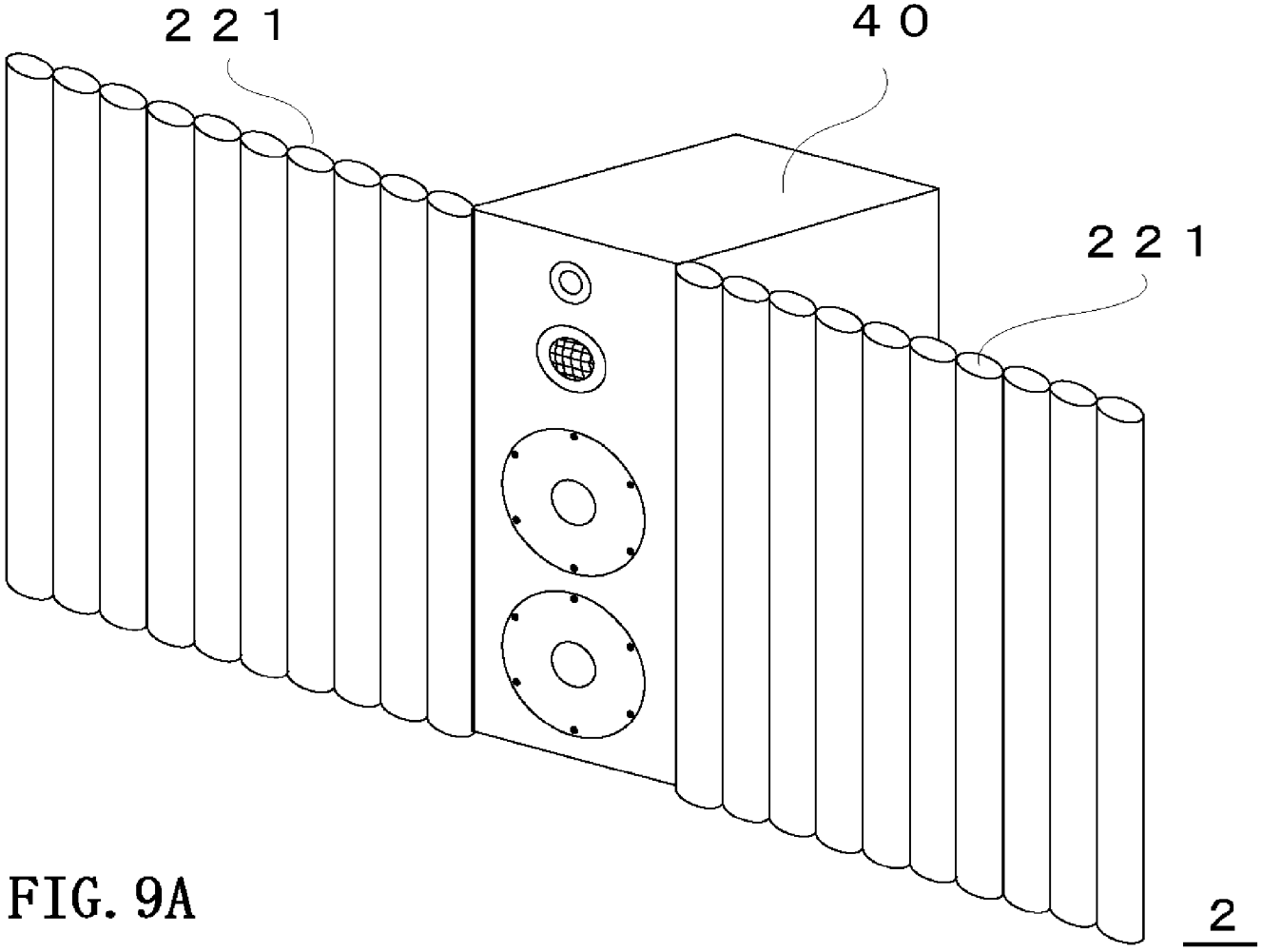
FIG. 9A is a perspective view showing an example of how a sound generation device 40 and a plurality of diffusion columns 221 in a sound generation system 2 are disposed according to the second embodiment of the present invention.
Figure 9B:
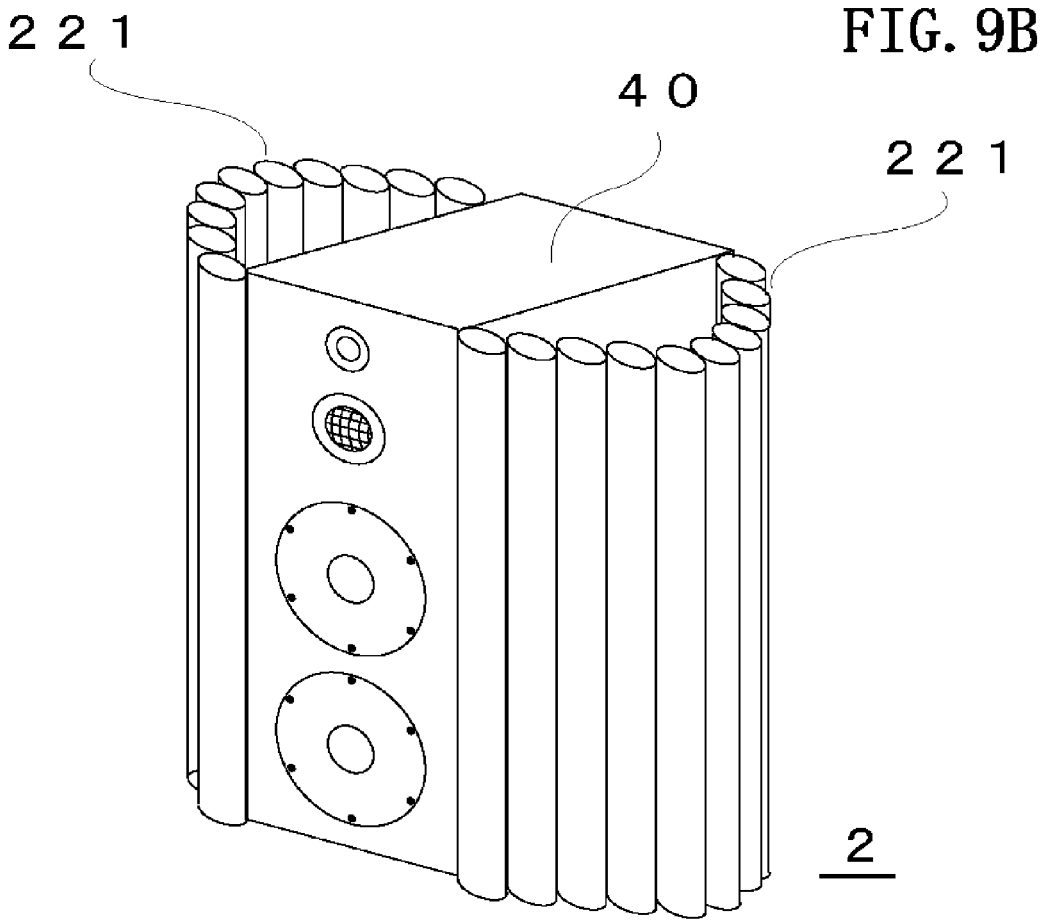
FIG. 9B is a perspective view showing an example of how a sound generation device 40 and a plurality of diffusion columns 221 in a sound generation system 2 are disposed according to the second embodiment of the present invention.
Figure 9C:
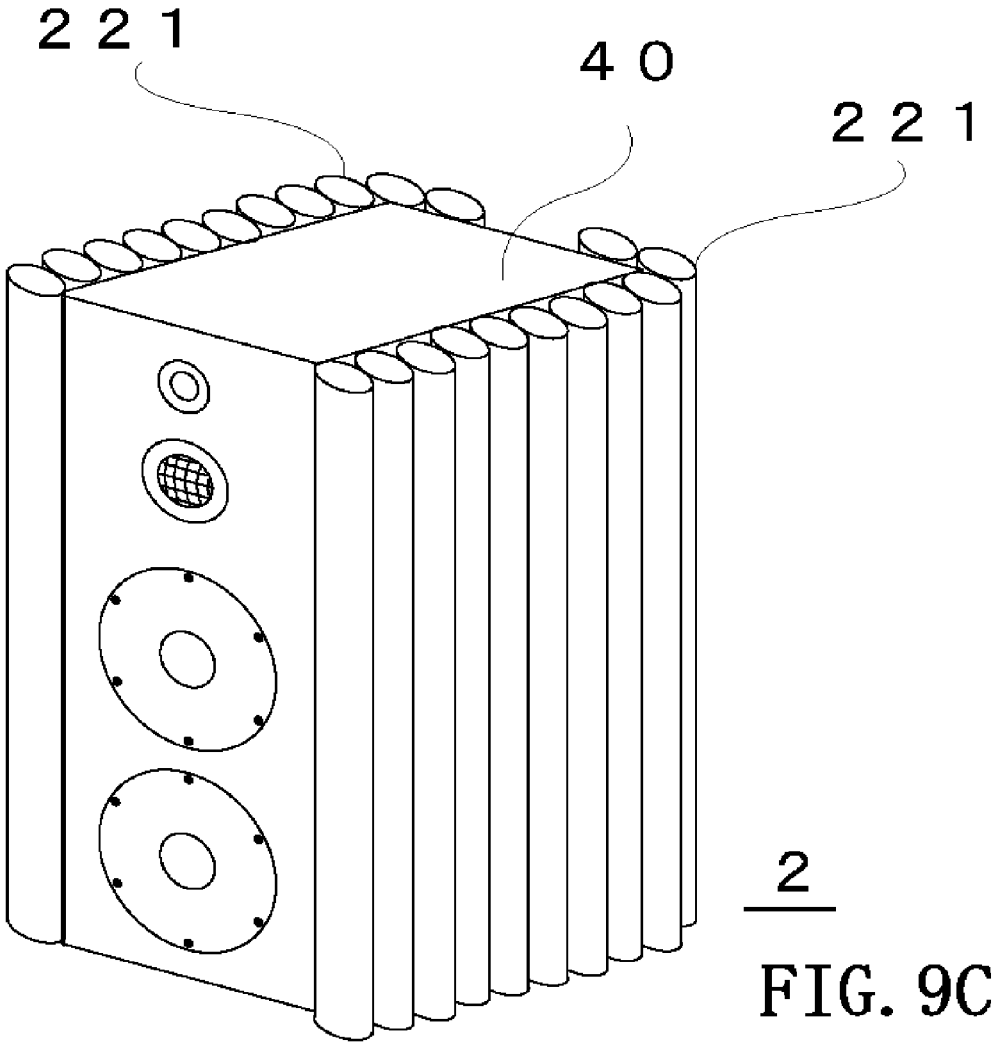
FIG. 9C is a perspective view showing an example of how a sound generation device 40 and a plurality of diffusion columns 221 in a sound generation system 2 are disposed according to the second embodiment of the present invention.

FIGS. 9A to 9C show examples of the arrangement of the sound generation device 40 and a plurality of diffusion columns 221 in the sound generation system 2 according to the second embodiment of the present invention. FIGS. 9A to 9C show the cases where a plurality of diffusion columns 221 and the sound generation device 40 are combined into one unit.

What is shown in the arrangement example of FIG. 9A is the case where a plurality of diffusion columns 221 is arranged so as to be spread in one line on the left and right sides of the sound generation device 40. What is shown in the arrangement example of FIG. 9B is the case where a plurality of diffusion columns 221 is arranged in lines so as to draw circular arcs on the left and right sides of the sound generation device 40. What is shown in the arrangement example of FIG. 9C is the case where a plurality of diffusion columns 221 is arranged and attached to the sound generation device 40 on the rear, left and right sides of the sound generation device 40. As shown in FIGS. 9A to 9C, it is possible to move a plurality of diffusion columns 221, which are combined into one unit, to an appropriate location and use the diffusion columns 221 as desired by a user.

Moreover, when no sound is generated, as shown in FIG. 9C, the diffusion columns 221 can be compactly put in storage. In order to put the diffusion columns 221 in storage, arbitrary methods, including the following, can be used as long as the diffusion columns 221 do not occupy too much space: a method of storing the diffusion columns 221 in such a way that the diffusion columns 221 are attached to the sound generation device 40, a method of storing a plurality of diffusion columns 221 by rolling the diffusion columns 221, and a method of storing a plurality of diffusion columns 221 in such a way that the projecting and depressed portions of the right- and left-hand diffusion columns 221 engage with each other.

Figure 10A:
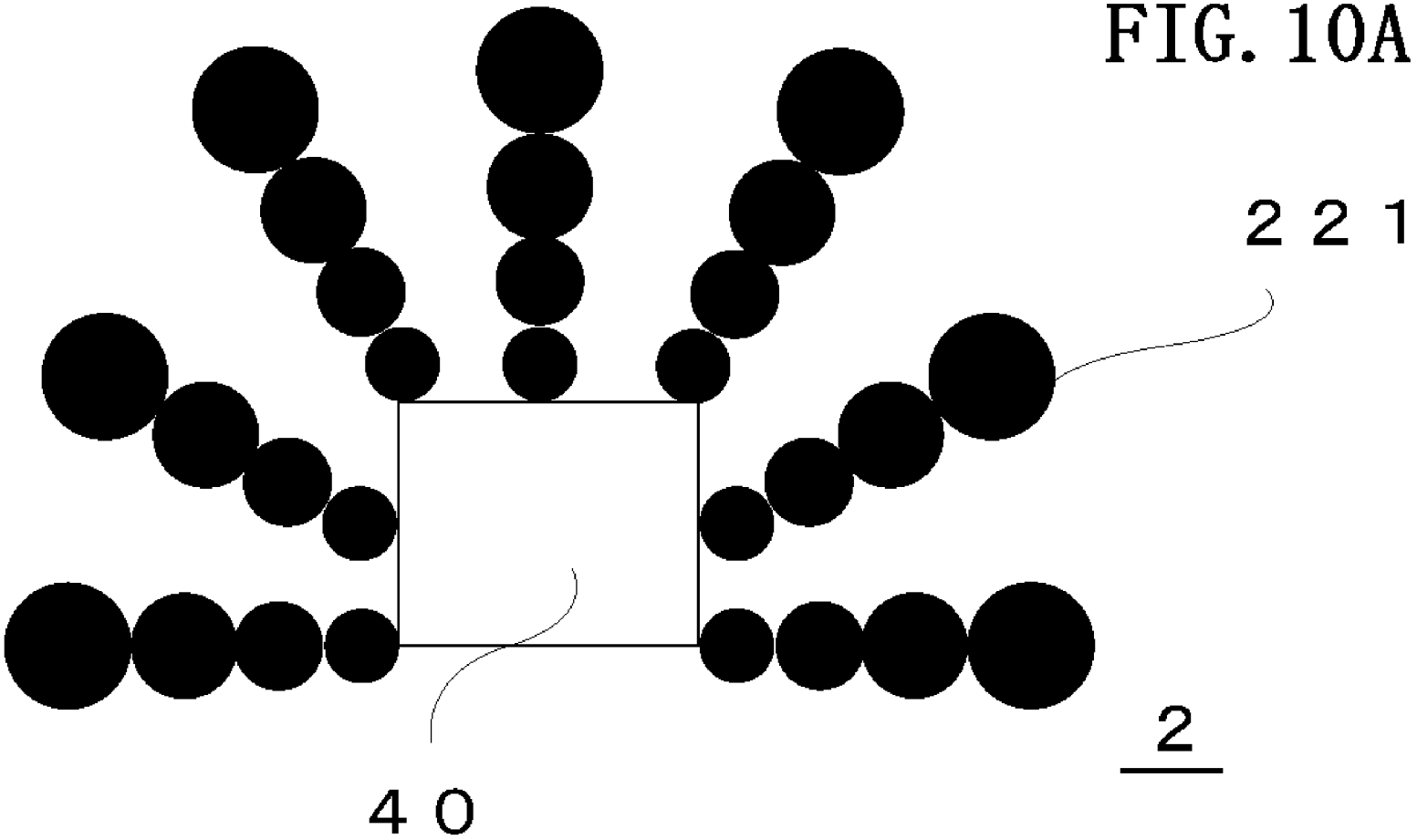
FIG. 10A is a top view showing an example of how a sound generation device 40 and a plurality of diffusion columns 221 in a sound generation system 2 are disposed according to the second embodiment of the present invention.
Figure 10B:
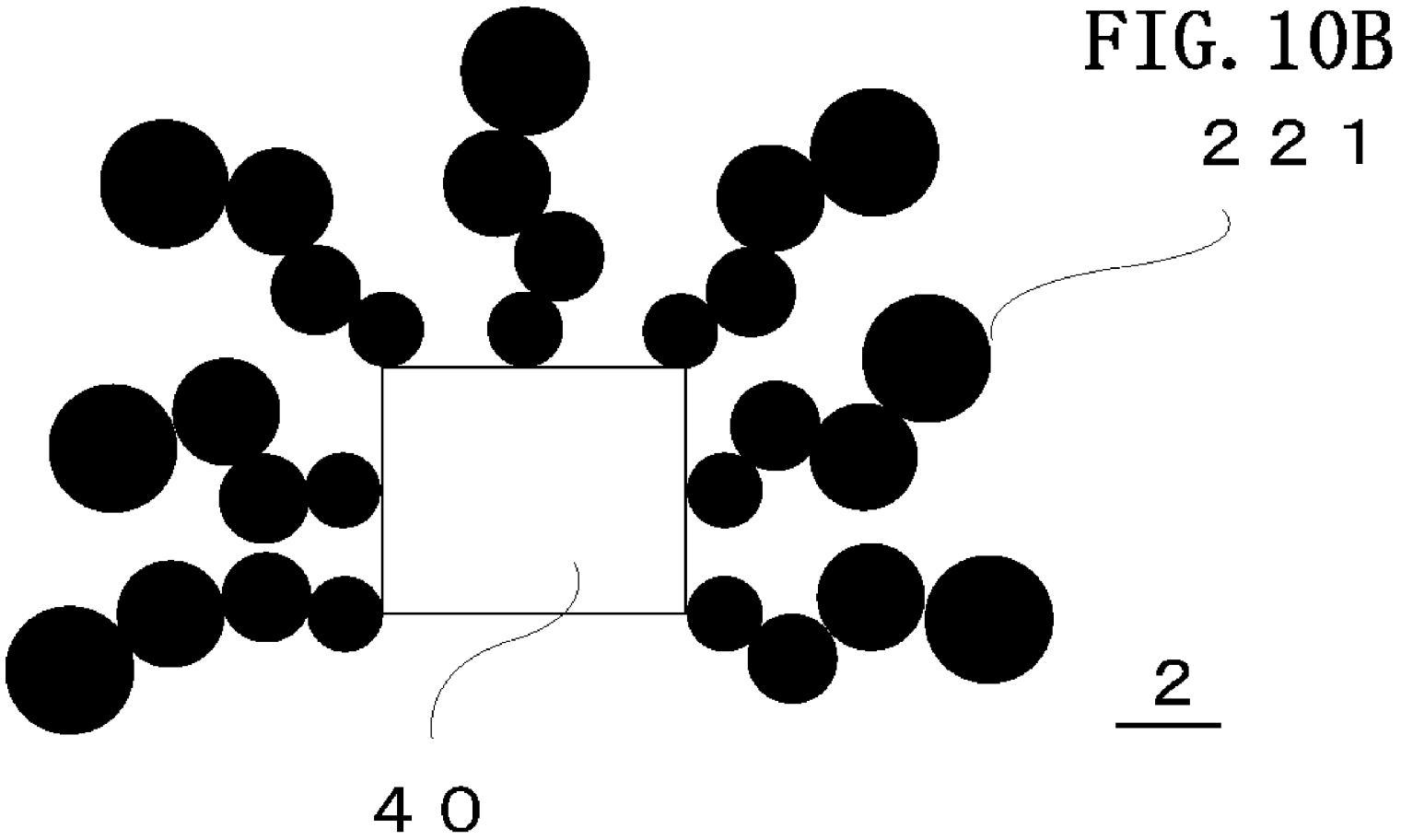
FIG. 10B is a top view showing an example of how a sound generation device 40 and a plurality of diffusion columns 221 in a sound generation system 2 are disposed according to the second embodiment of the present invention.

FIGS. 10A and 10B show examples of the arrangement of the sound generation device 40 and a plurality of diffusion columns 221 in the sound generation system 2 according to the second embodiment of the present invention. FIGS. 10A and 10B show the cases where a plurality of diffusion columns 221 and the sound generation device 40 are combined into one unit.

What is shown in the arrangement example of FIG. 10A is the case where diffusion columns 221 with a plurality of thicknesses, indicated by black circles, are orderly arranged on the rear, left and right sides of the sound generation device 40. What is shown in the arrangement example of FIG. 10B is the case where diffusion columns 221 with a plurality of thicknesses, indicated by black circles, are randomly arranged on the rear, left and right sides of the sound generation device 40.

Figure 11A:
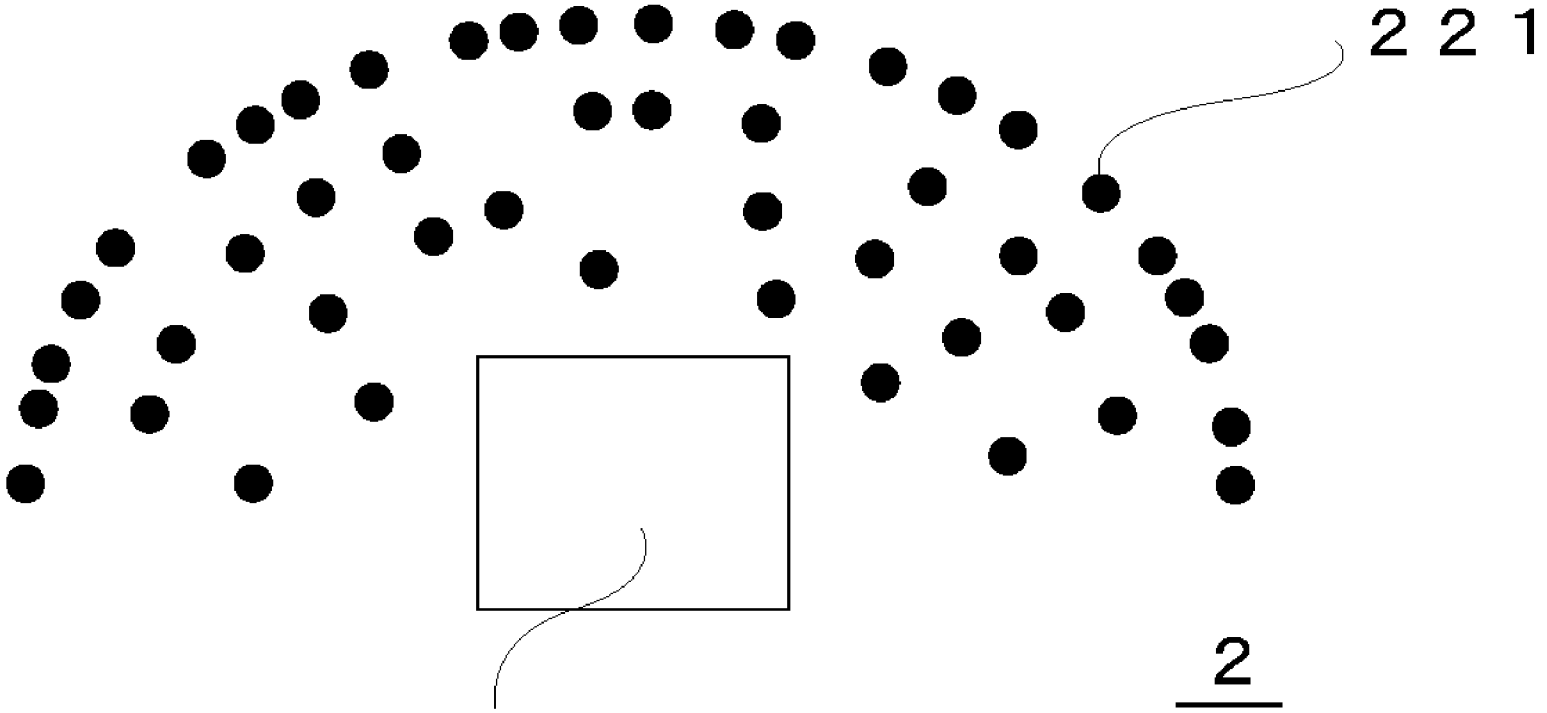
FIG. 11A is a top view showing an example of how a sound generation device 40 and a plurality of diffusion columns 221 in a sound generation system 2 are disposed according to the second embodiment of the present invention.
Figure 11B:
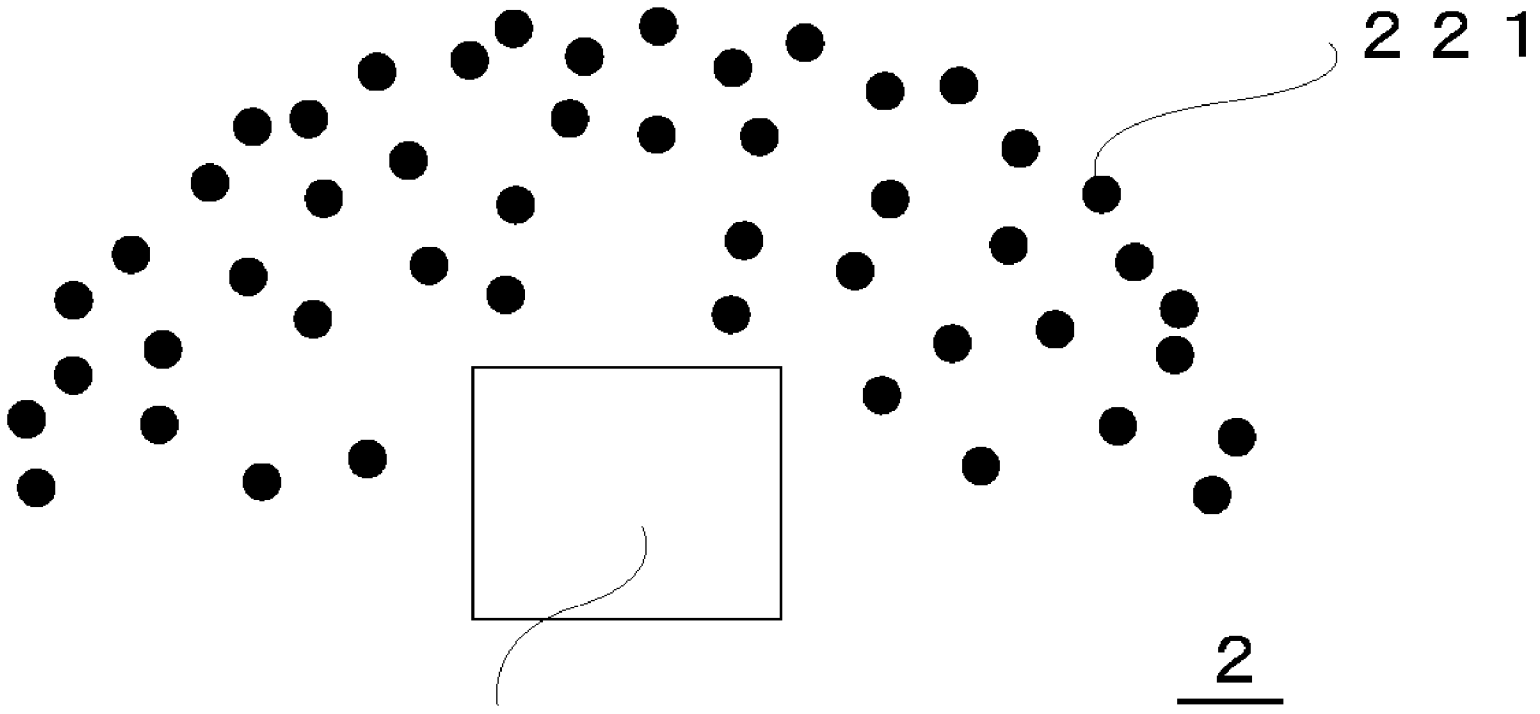
FIG. 11B is a top view showing an example of how a sound generation device 40 and a plurality of diffusion columns 221 in a sound generation system 2 are disposed according to the second embodiment of the present invention.

FIGS. 11A and 11B show examples of the arrangement of the sound generation device 40 and a plurality of diffusion columns 221 in the sound generation system 2 according to the second embodiment of the present invention. FIGS. 11A and 11B show the cases where a plurality of diffusion columns 221 is separated from the sound generation device 40.

What is shown in the arrangement example of FIG. 11A is the case where a plurality of diffusion columns 221, indicated by black circles, is arranged orderly and concentrically on the rear, left and right sides of the sound generation device 40 in directions in which the diffusion columns 221 move away from the sound generation device 40 so that the diffusion columns 221 are sequentially concentrated. What is shown in the arrangement example of FIG. 11B is the case where a plurality of diffusion columns 221, indicated by black circles, is randomly arranged on the rear, left and right sides of the sound generation device 40 in directions in which the diffusion columns 221 move away from the sound generation device 40 so that the diffusion columns 221 are sequentially concentrated.

Figure 12A:
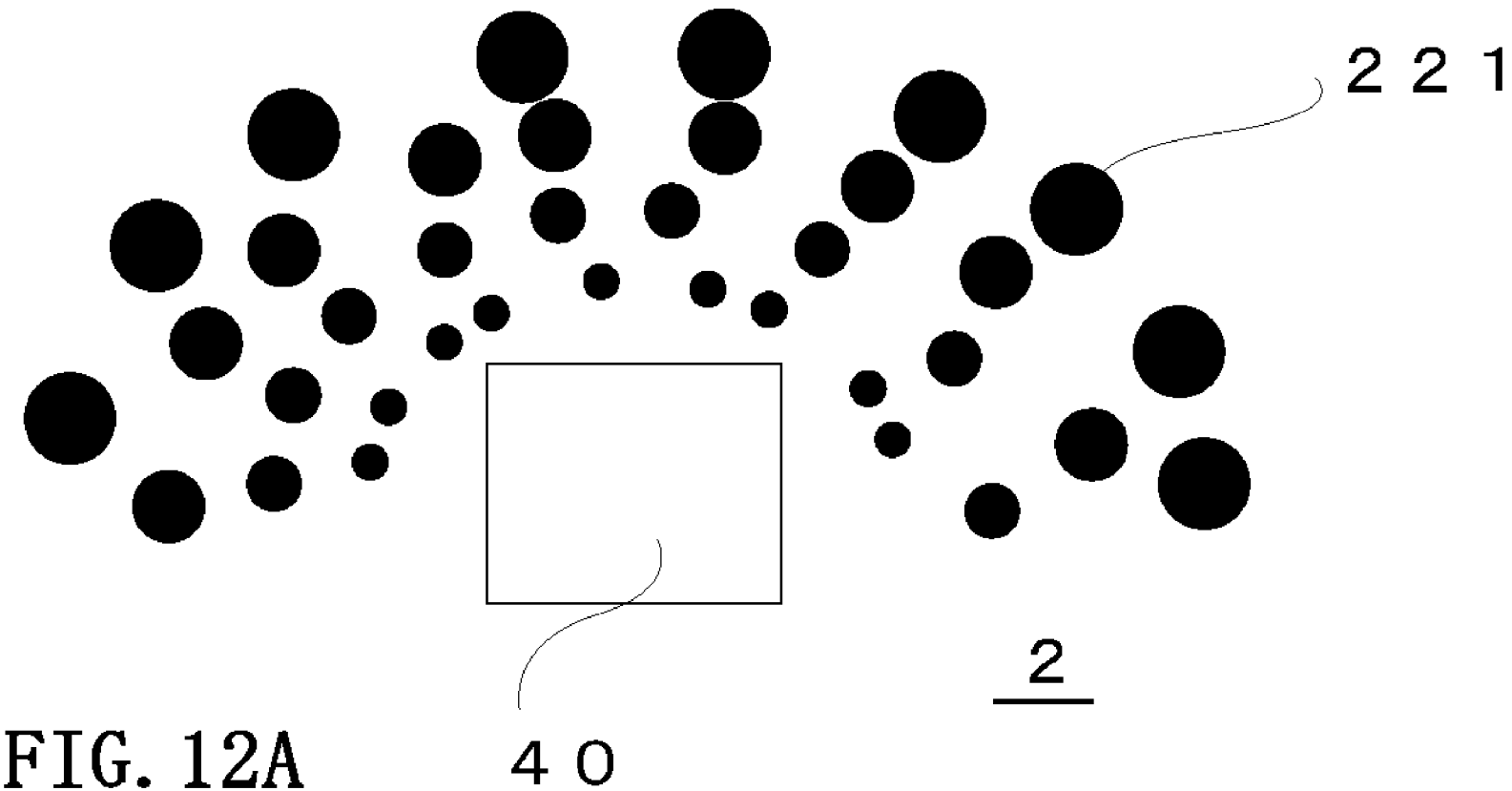
FIG. 12A is a top view showing an example of how a sound generation device 40 and a plurality of diffusion columns 221 in a sound generation system 2 are disposed according to the second embodiment of the present invention.
Figure 12B:
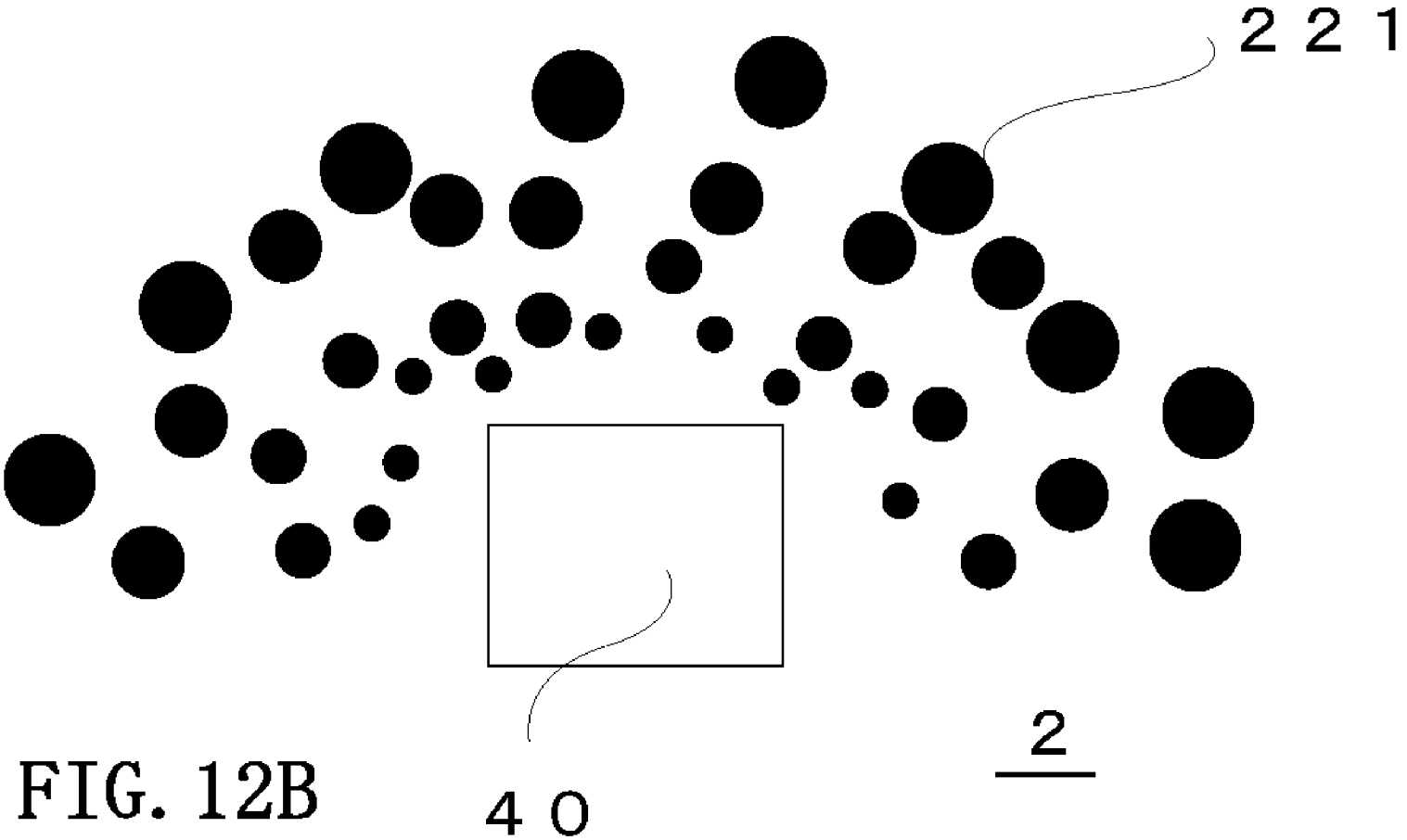
FIG. 12B is a top view showing an example of how a sound generation device 40 and a plurality of diffusion columns 221 in a sound generation system 2 are disposed according to the second embodiment of the present invention.

FIGS. 12A and 12B show examples of the arrangement of the sound generation device 40 and a plurality of diffusion columns 221 in the sound generation system 2 according to the second embodiment of the present invention. FIGS. 12A and 12B show the cases where a plurality of diffusion columns 221 is separated from the sound generation device 40.

What is shown in the arrangement example of FIG. 12A is the case where a plurality of diffusion columns 221, indicated by black circles, is arranged orderly and concentrically on the rear, left and right sides of the sound generation device 40 in directions in which the diffusion columns 221 move away from the sound generation device 40 so that the diffusion columns 221 sequentially become thicker in diameter. What is shown in the arrangement example of FIG. 12B is the case where a plurality of diffusion columns 221, indicated by black circles, is randomly arranged on the rear, left and right sides of the sound generation device 40 in directions in which the diffusion columns 221 move away from the sound generation device 40 so that the diffusion columns 221 sequentially become thicker in diameter.

The arrangement examples shown in FIGS. 8A to 8F, FIGS. 9A to 9C, FIGS. 10A and 10B, FIGS. 11A and 11B, and FIGS. 12A and 12B are for illustrative purposes only. Needless to say, a plurality of diffusion columns 221 can be disposed randomly at arbitrary locations on the upper, lower, front, rear, left and right sides of the sound generation device 40, as long as the diffusion columns 221 are positioned around the sound generation device 40.

A plurality of diffusion columns 221 may be provided after being fixed to the sound generation device 40 (see FIGS. 8A to 8F, FIGS. 9A to 9C, and FIGS. 10A and 10B); or may be provided so as to be movable by means of a hinge or the like (see FIGS. 9A to 9C). Moreover, a plurality of diffusion columns 221 may be combined with the sound generation device 40 as one unit (see FIGS. 8A to 8F, FIGS. 9A to 9C, and FIGS. 10A and 10B); or may be provided in such a way that the diffusion columns 221 are separated from the sound generation device 40 (see FIGS. 11A and 11B and FIGS. 12A and 12B). Alternatively, the diffusion columns 221 can be attached to or removed from the sound generation device 40. In any case, all that is required is to be able to spread sound waves in every direction, i.e. in the upward, downward, forward, backward, left-hand, and right-hand directions, by diffusing and reflecting sound generated from the sound generation device 40. Therefore, it is possible to obtain a sound-field environment with less coloration, which is acoustically desirable.

In the arrangement examples shown in FIGS. 8A to 8F, FIGS. 9A to 9C, FIGS. 10A and 10B, FIGS. 11A and 11B, and FIGS. 12A and 12B, a plurality of diffusion columns 221 is disposed behind an acoustic generation unit or baffle surface of the sound generation device 40. By such an arrangement, a listener can pickup a direct sound, which is not reflected by the diffusion columns 221. Incidentally, when a plurality of diffusion columns 221 is disposed on the front side of the sound generation device 40, a listener is able to get only a reflected sound. Therefore, it is possible to reproduce a sound that makes a listener feel as if being in the woods.

Since a plurality of columnar bodies exists around the sound generation device 40, it is possible to provide the sound generation system 2 that looks aesthetically desirable. In particular, with the use of a plurality of random columnar bodies, it is possible to provide the sound generation system 2 that looks esthetically unique because of a combination of various kinds of surface coating, surface finishing, material and the like.

As described above, the sound generation system 2 of the second embodiment of the present invention uses a sound diffusion method, which uses the sound diffusion body 1 of the first embodiment of the present invention, even in generating sound.

Therefore, the sound generation system 2 of the second embodiment of the present invention is able to obtain the same advantageous effects that can be obtained from the sound diffusion body 1 of the first embodiment of the present invention.

Moreover, in the sound generation system 2 of the second embodiment of the present invention, it is possible to generate sound waves by controlling the frequency characteristics of a low-tone range and a middle- and high-tone range, the relationship of diffusion/sound absorption, the frequency band, the reflection direction, the reflection-time structure and the like according to the state of the sound in the room. That is, since it becomes possible to control the ratio of diffusion of sound of a specific frequency to absorption of the sound, it is possible to significantly improve and make pleasant the sound field generated by the sound generation device.

Furthermore, in the sound generation system 2 of the second embodiment of the present invention, it is possible to dispose a plurality of diffusion columns 221 in accordance with a sound/frequency characteristic of the sound generation device 40. Therefore, it is possible to prevent sound from being diffracted due to the shape of the baffle of the sound generation device 40, thereby avoiding adverse effects; it is possible to provide a sound field optimized for the sound generation device 40.

Third Embodiment

A sound recording system 3 of a third embodiment of the present invention includes the following main components: a sound recording device 50 and diffusion columns 222, which are columnar reflection objects and sound diffusion bodies placed around the sound recording device 50.

For the sound recording device 50, an arbitrary device can be used, as long as the device is a recording device that records sound. For example, the sound recording device 50 may be any kind of device, from a sensor such as a microphone that is used in recording sound signals to an audiphone or the like that is used in collecting sound. For the sound recording device 50, a plurality of the above devices can be used in combination.

The diffusion columns 222 may be in an arbitrary shape as in the shape of the diffusion columns 220 of the first embodiment of the present invention. A plurality of diffusion columns 222 may be realized by a combination of an arbitrary length, thickness, material and the like. The diffusion columns 222 may not stand perpendicularly; the diffusion columns 222 may be arranged diagonally or laterally.

With reference to arrangement examples of FIGS. 13A to 13F, FIGS. 14A to 14C, FIGS. 15A and 15B, FIGS. 16A and 16B, and FIGS. 17A and 17B, the configuration of the sound generation system 3 of the third embodiment of the present invention will be described in detail.

FIGS. 13A to 13F show examples of the arrangement of the sound recording device 50 and a plurality of diffusion columns 222 in the sound recording system 3 according to the third embodiment of the present invention.

Figure 13A:
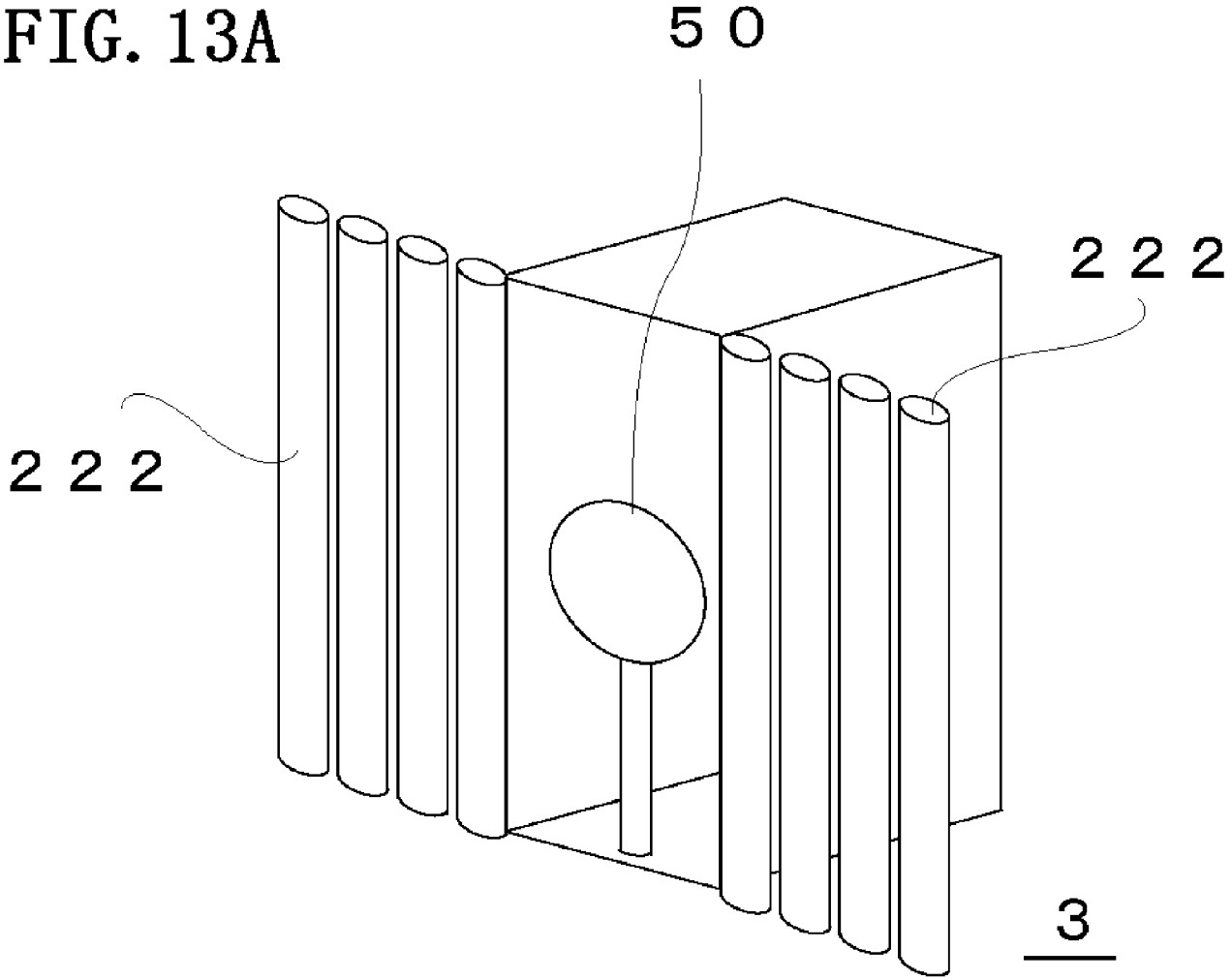
FIG. 13A is a perspective view showing an example of how a sound recording device 50 and a plurality of diffusion columns 222 in a sound recording system 3 are disposed according to a third embodiment of the present invention.
Figure 13B:
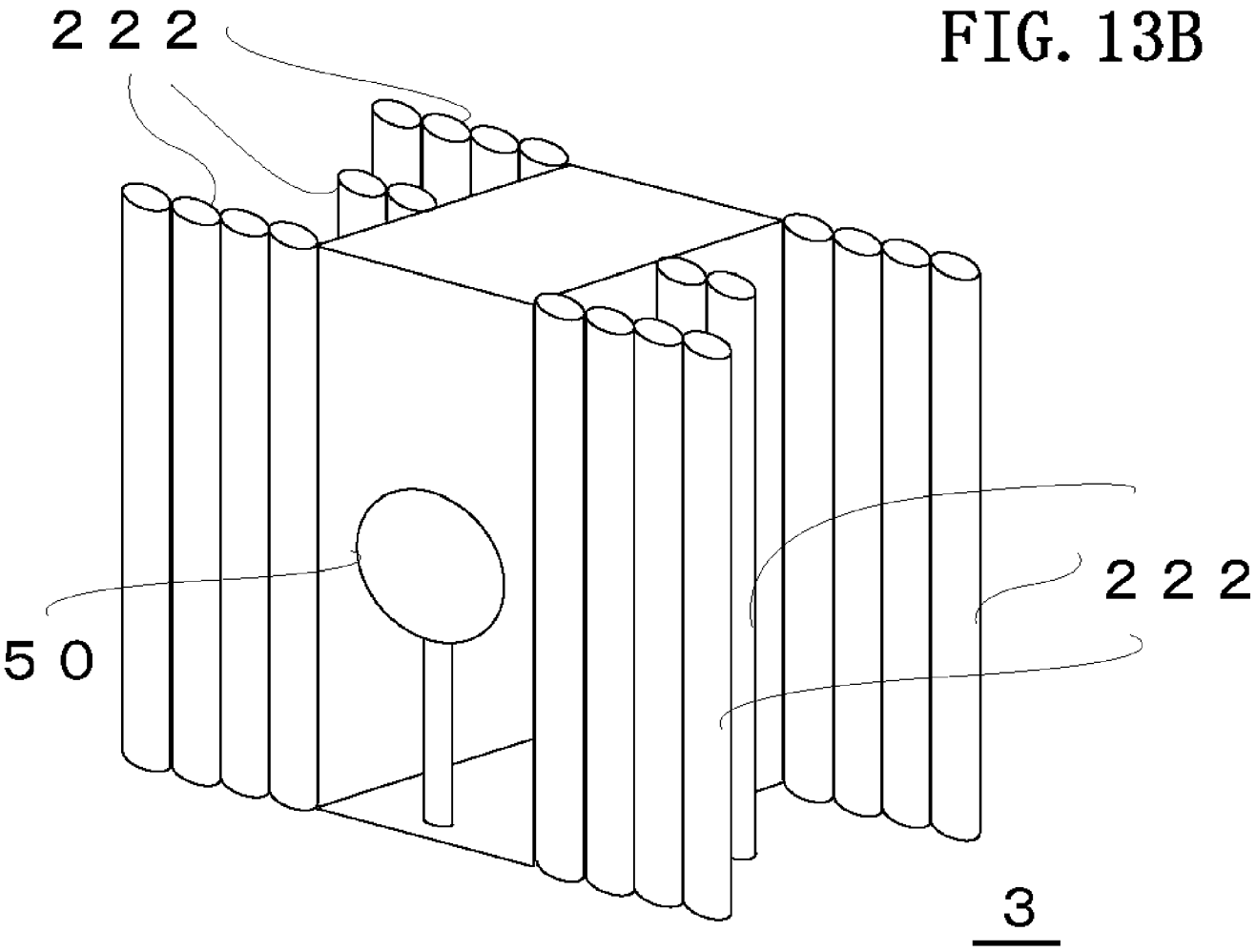
FIG. 13B is a perspective view showing an example of how a sound recording device 50 and a plurality of diffusion columns 222 in a sound recording system 3 are disposed according to the third embodiment of the present invention.
Figure 13C:
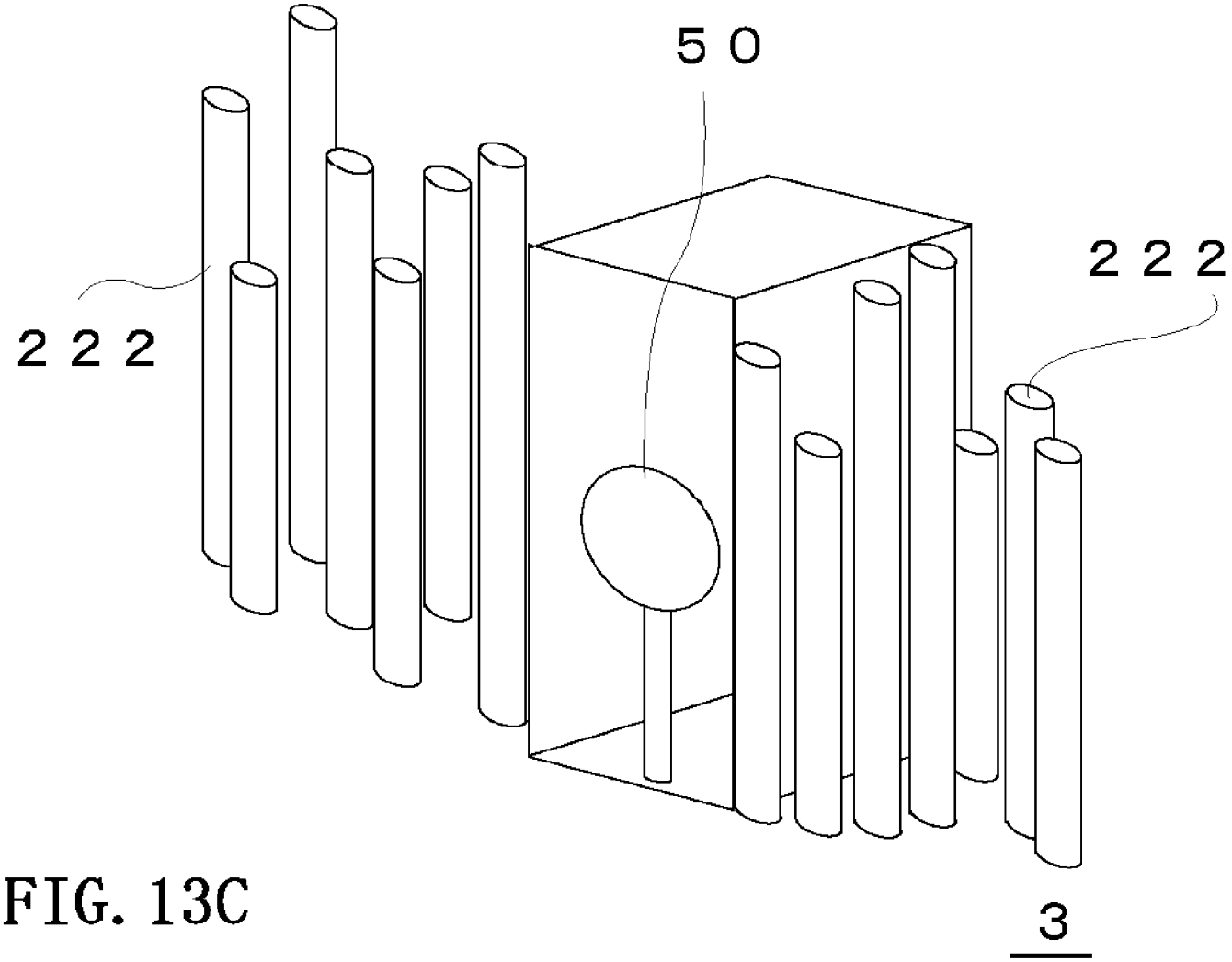
FIG. 13C is a perspective view showing an example of how a sound recording device 50 and a plurality of diffusion columns 222 in a sound recording system 3 are disposed according to the third embodiment of the present invention.
Figure 13D:
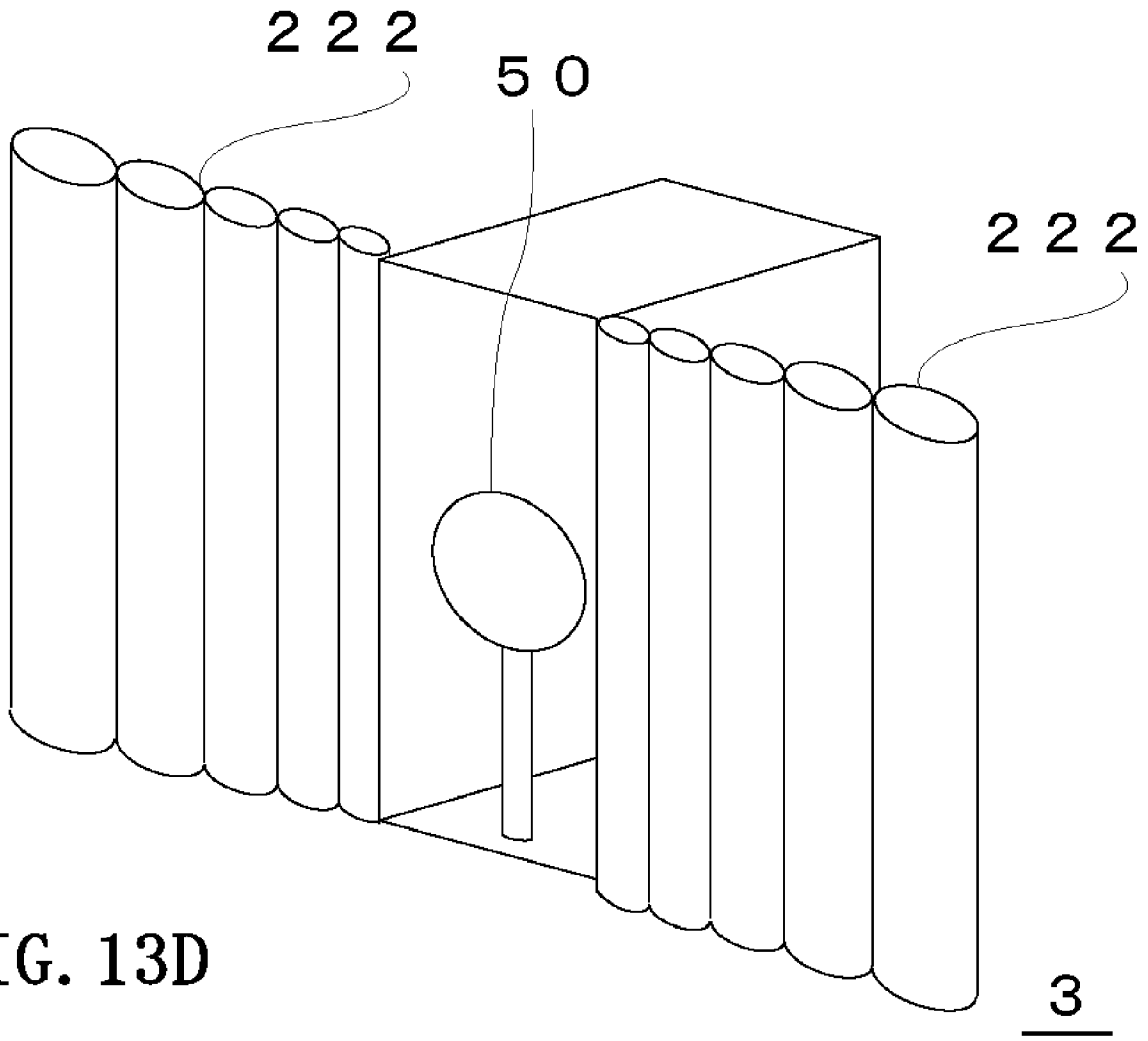
FIG. 13D is a perspective view showing an example of how a sound recording device 50 and a plurality of diffusion columns 222 in a sound recording system 3 are disposed according to the third embodiment of the present invention.
Figure 13E:
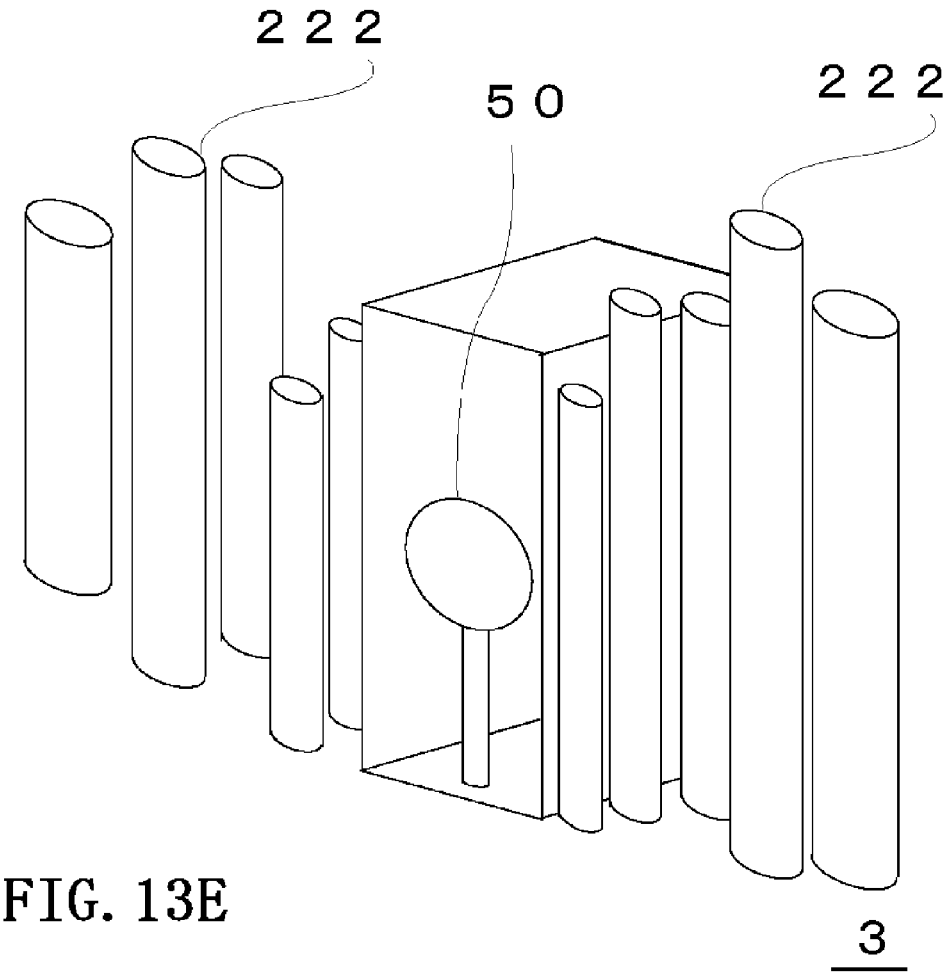
FIG. 13E is a perspective view showing an example of how a sound recording device 50 and a plurality of diffusion columns 222 in a sound recording system 3 are disposed according to the third embodiment of the present invention.
Figure 13F:
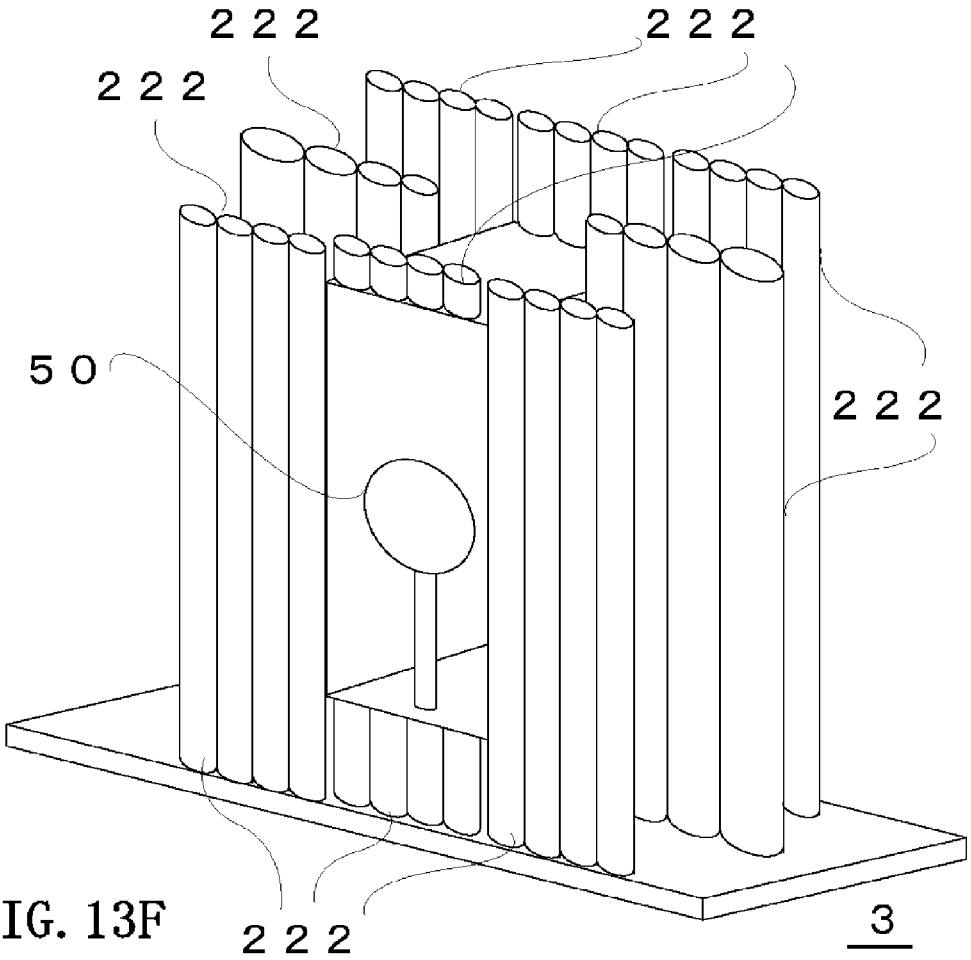
FIG. 13F is a perspective view showing an example of how a sound recording device 50 and a plurality of diffusion columns 222 in a sound recording system 3 are disposed according to the third embodiment of the present invention.

What is shown in the arrangement example of FIG. 13A is the case in which a plurality of diffusion columns 222 is arranged in one line on the left and right sides of the sound recording device 50. What is shown in the arrangement example of FIG. 13B is the case in which a plurality of diffusion columns 222 is arranged in a plurality of lines on the left and right sides of the sound recording device 50. What is shown in the arrangement example of FIG. 13C is the case in which a plurality of diffusion columns 222, which are randomly different in height, is arranged on the left and right sides of the sound recording device 50. What is shown in the arrangement example of FIG. 13D is the case in which a plurality of diffusion columns 222, which are randomly different in thickness, is arranged on the left and right sides of the sound recording device 50. What is shown in the arrangement example of FIG. 13E is the case in which a plurality of diffusion columns 222, which are randomly different in height and thickness, is arranged on the left and right sides of the sound recording device 50. What is shown in the arrangement example of FIG. 13F is the case in which a plurality of diffusion columns 222 is arranged on the upper, lower, rear, left and right sides of the sound recording device 50; a plurality of diffusion columns 222 and the sound recording device 50 are integrally embedded in a base portion 232.

Figure 14A:
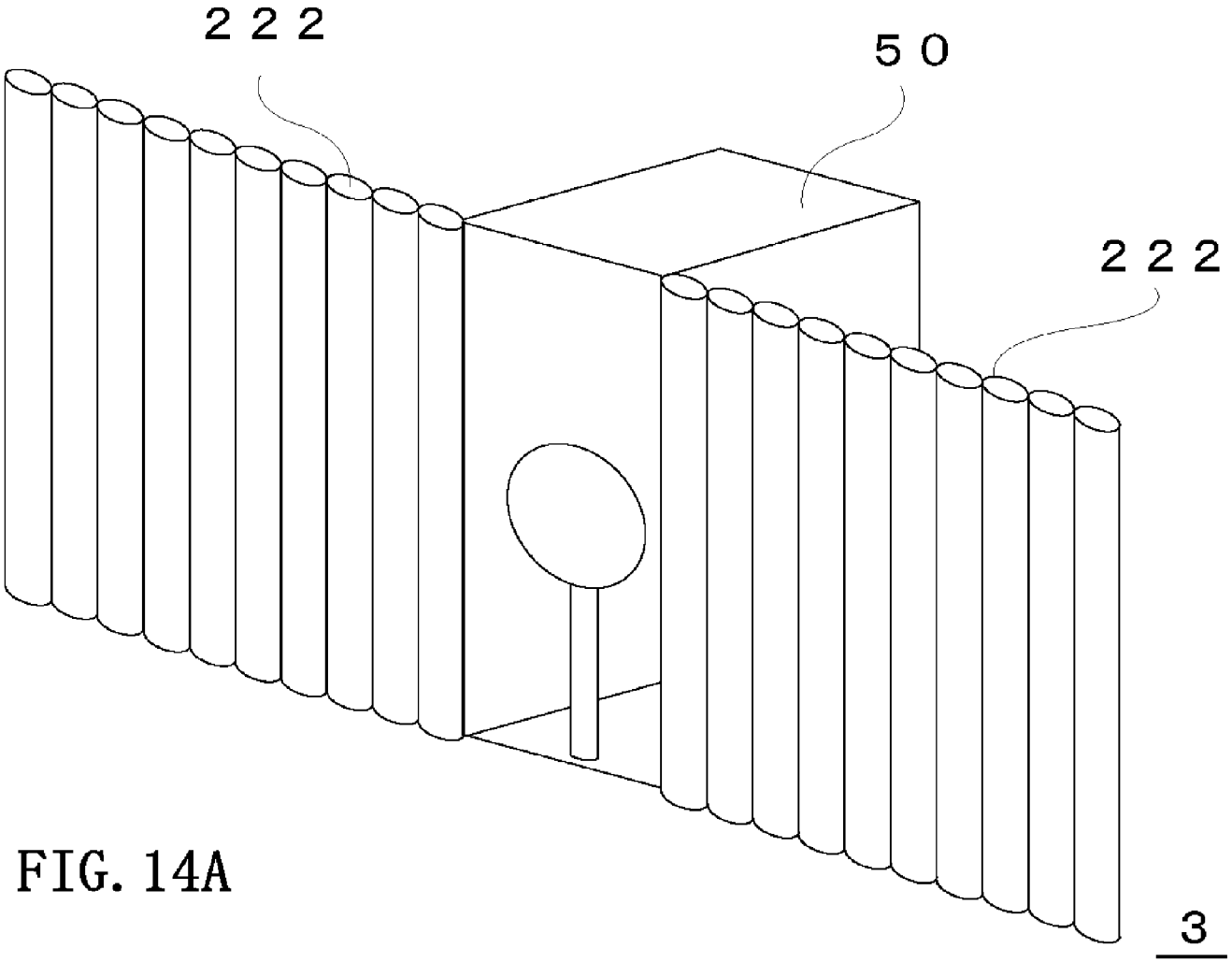
FIG. 14A is a perspective view showing an example of how a sound recording device 50 and a plurality of diffusion columns 222 in a sound recording system 3 are disposed according to the third embodiment of the present invention.
Figure 14B:
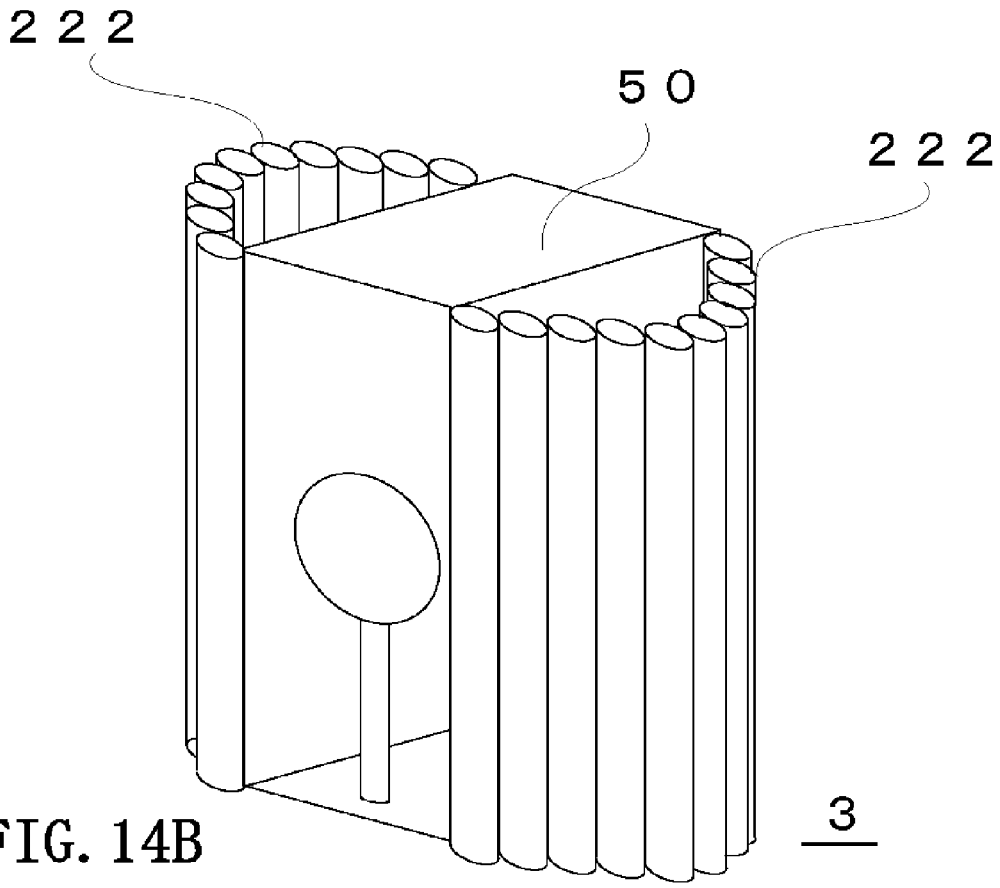
FIG. 14B is a perspective view showing an example of how a sound recording device 50 and a plurality of diffusion columns 222 in a sound recording system 3 are disposed according to the third embodiment of the present invention.
Figure 14C:
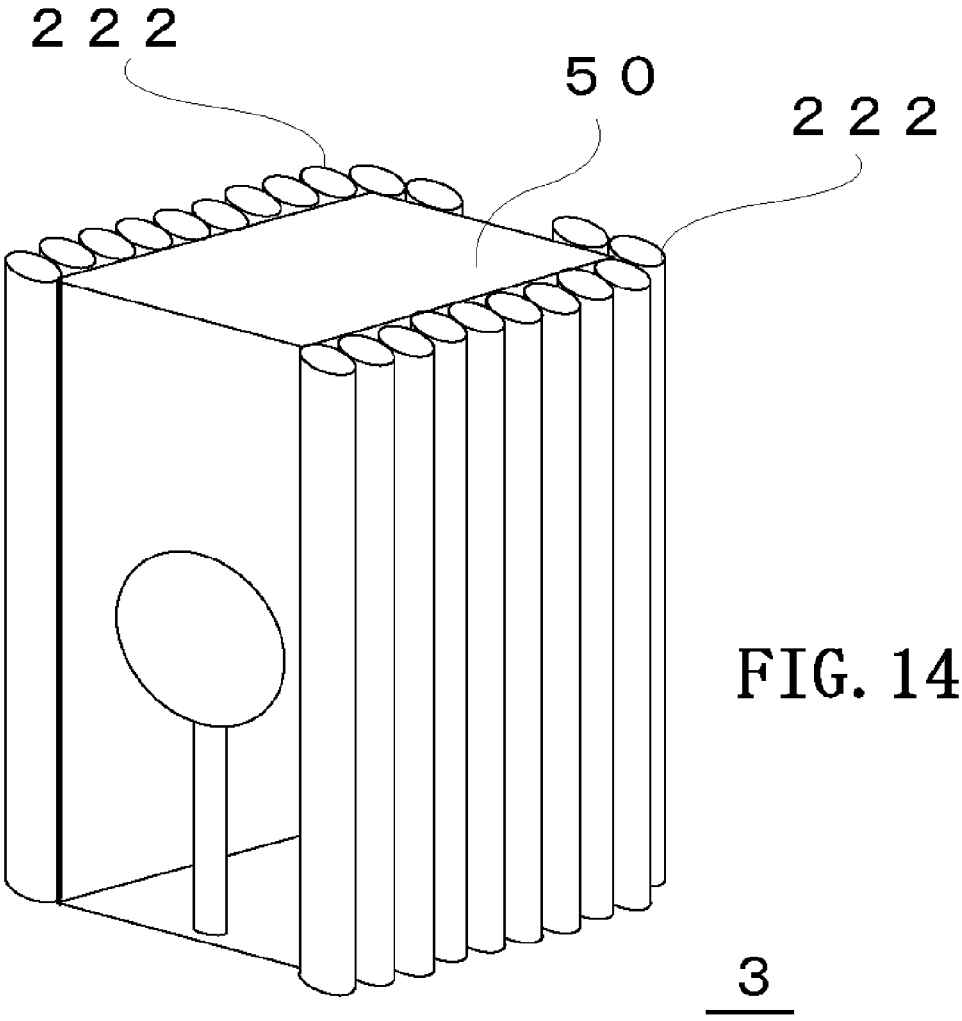
FIG. 14C is a perspective view showing an example of how a sound recording device 50 and a plurality of diffusion columns 222 in a sound recording system 3 are disposed according to the third embodiment of the present invention.

FIGS. 14A to 14C show examples of the arrangement of the sound recording device 50 and a plurality of diffusion columns 222 in the sound recording system 3 according to the third embodiment of the present invention. FIGS. 14A to 14C show the cases where a plurality of diffusion columns 222 and the sound recording device 50 are combined into one unit.

What is shown in the arrangement example of FIG. 14A is the case where a plurality of diffusion columns 222 is arranged so as to be spread in one line on the left and right sides of the sound recording device 50. What is shown in the arrangement example of FIG. 14B is the case where a plurality of diffusion columns 222 is arranged in lines so as to draw circular arcs on the left and right sides of the sound recording device 50. What is shown in the arrangement example of FIG. 14C is the case where a plurality of diffusion columns 222 is stored and attached to the sound recording device 50 on the rear, left and right sides of the sound recording device 50.

Moreover, when no sound is recorded, as shown in FIG. 14C, the diffusion columns 222 can be compactly put in storage. In order to put the diffusion columns 222 in storage, arbitrary methods, including the following, can be used as long as the diffusion columns 222 do not occupy too much space: a method of storing the diffusion columns 222 in such a way that the diffusion columns 222 are attached to the sound recording device 50, a method of storing a plurality of diffusion columns 222 by rolling the diffusion columns 222, and a method of storing a plurality of diffusion columns 222 in such a way that the projecting and depressed portions of the right- and left-hand diffusion columns 222 engage with each other.

Figure 15A:
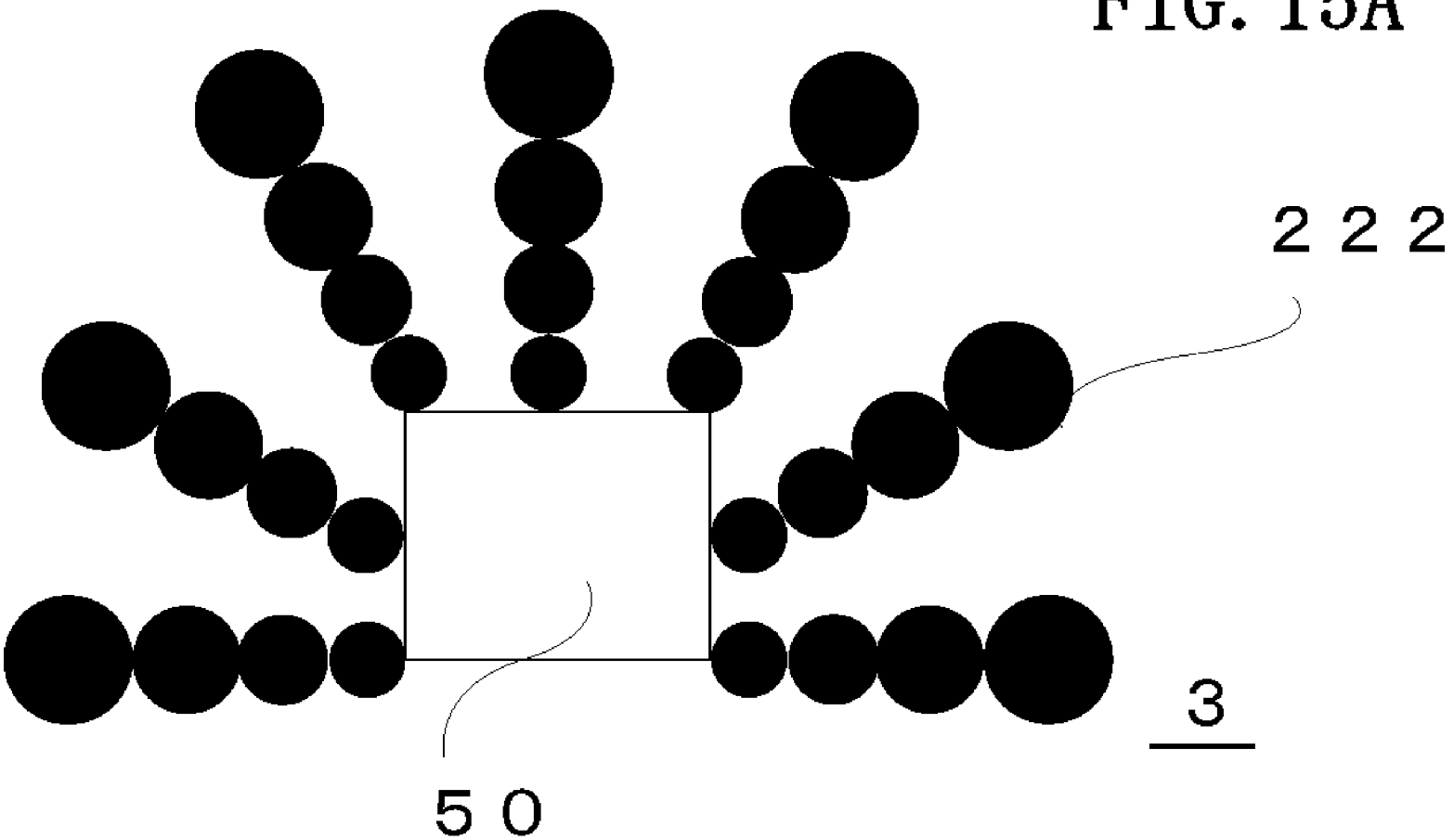
FIG. 15A is a top view showing an example of how a sound recording device 50 and a plurality of diffusion columns 222 in a sound recording system 3 are disposed according to the third embodiment of the present invention.
Figure 15B:
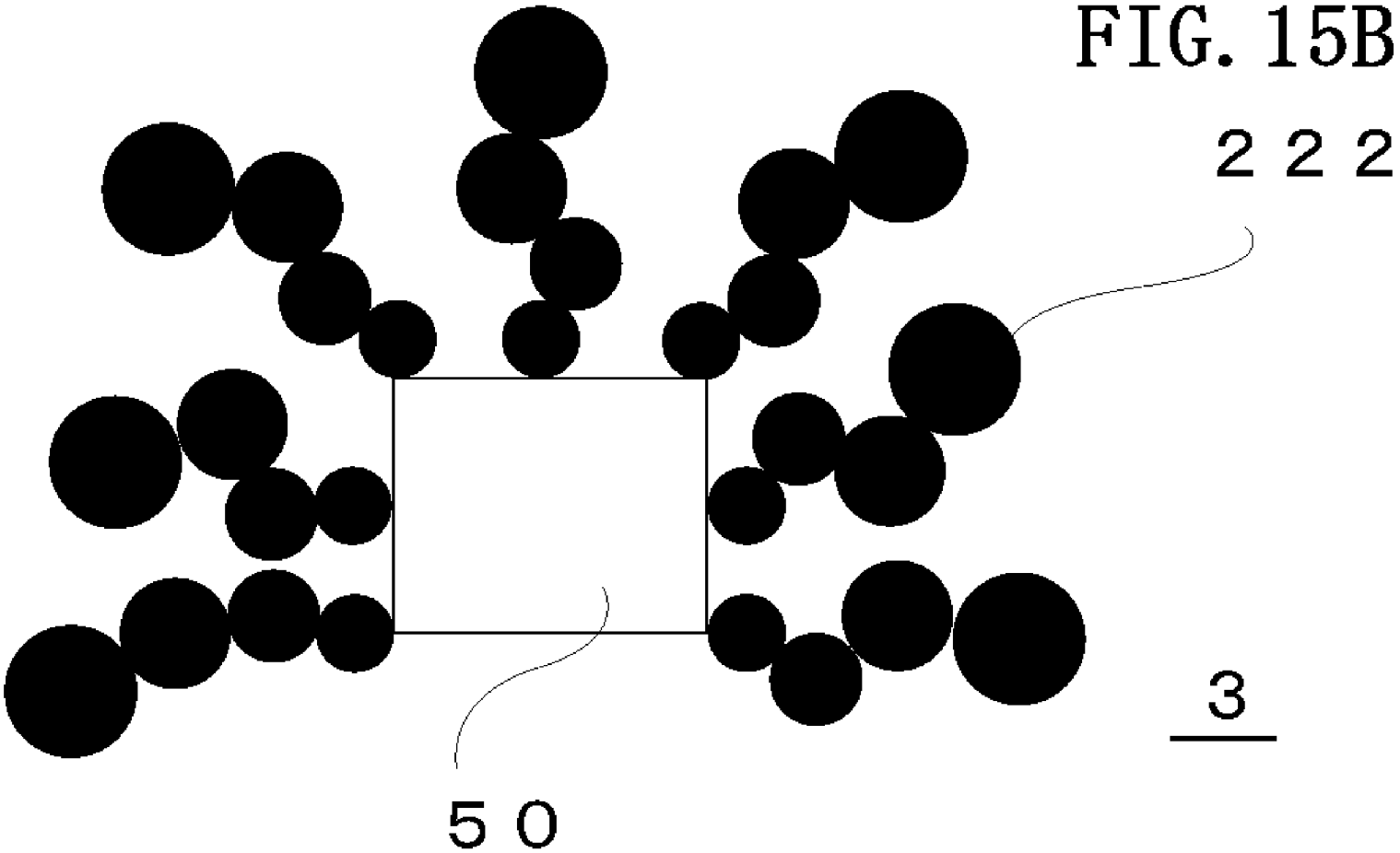
FIG. 15B is a top view showing an example of how a sound recording device 50 and a plurality of diffusion columns 222 in a sound recording system 3 are disposed according to the third embodiment of the present invention.

FIGS. 15A and 15B show examples of the arrangement of the sound recording device 50 and a plurality of diffusion columns 222 in the sound recording system 3 according to the third embodiment of the present invention. FIGS. 15A and 15B show the cases where a plurality of diffusion columns 222 and the sound recording device 50 are combined into one unit.

What is shown in the arrangement example of FIG. 15A is the case where diffusion columns 222 with a plurality of thicknesses, indicated by black circles, are orderly arranged on the rear, left and right sides of the sound recording device 50. What is shown in the arrangement example of FIG. 15B is the case where diffusion columns 222 with a plurality of thicknesses, indicated by black circles, are randomly arranged on the rear, left and right sides of the sound recording device 50.

Figure 16A:
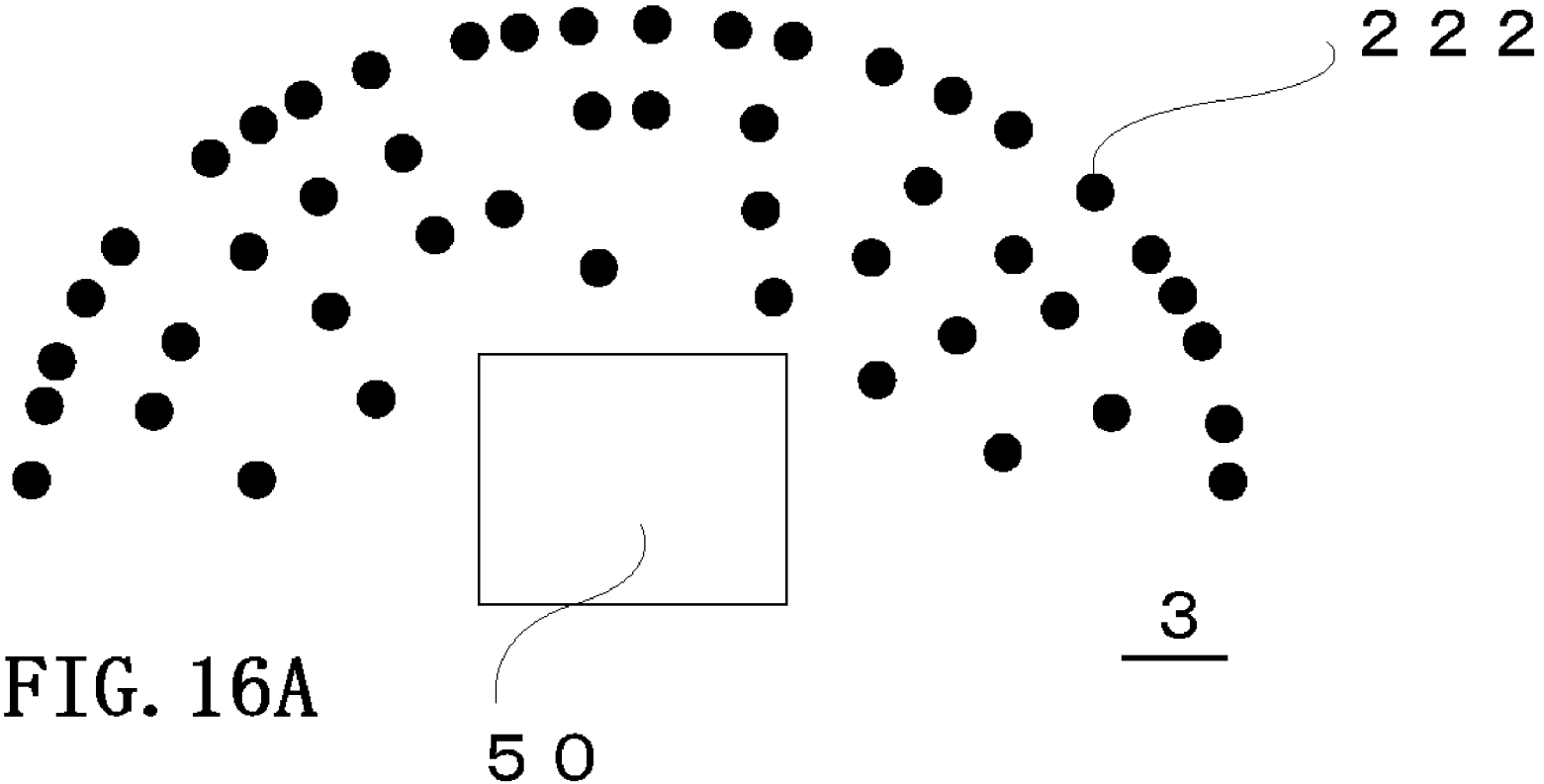
FIG. 16A is a top view showing an example of how a sound recording device 50 and a plurality of diffusion columns 222 in a sound recording system 3 are disposed according to the third embodiment of the present invention.
Figure 16B:
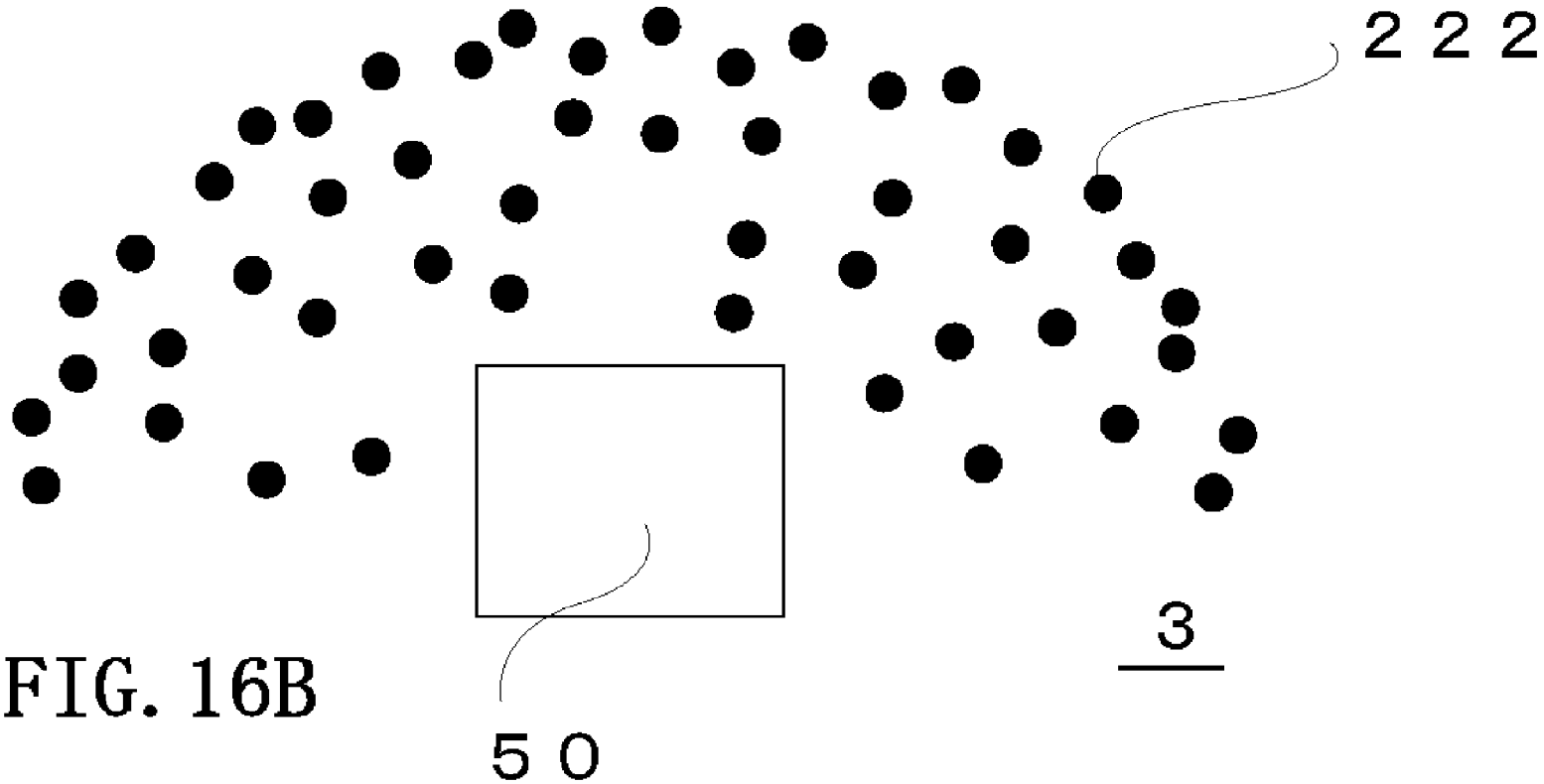
FIG. 16B is a top view showing an example of how a sound recording device 50 and a plurality of diffusion columns 222 in a sound recording system 3 are disposed according to the third embodiment of the present invention.

FIGS. 16A and 16B show examples of the arrangement of the sound recording device 50 and a plurality of diffusion columns 222 in the sound recording system 3 according to the third embodiment of the present invention. FIGS. 16A and 16B show the cases where a plurality of diffusion columns 222 is separated from the sound recording device 50.

What is shown in the arrangement example of FIG. 16A is the case where a plurality of diffusion columns 222, indicated by black circles, is arranged orderly on the rear, left and right sides of the sound recording device 50 in directions in which the diffusion columns 222 move away from the sound recording device 50 so that the diffusion columns 222 are sequentially concentrated. What is shown in the arrangement example of FIG. 16B is the case where a plurality of diffusion columns 222, indicated by black circles, is randomly arranged on the rear, left and right sides of the sound recording device 50 in directions in which the diffusion columns 222 move away from the sound recording device 50 so that the diffusion columns 222 are sequentially concentrated.

Figure 17A:
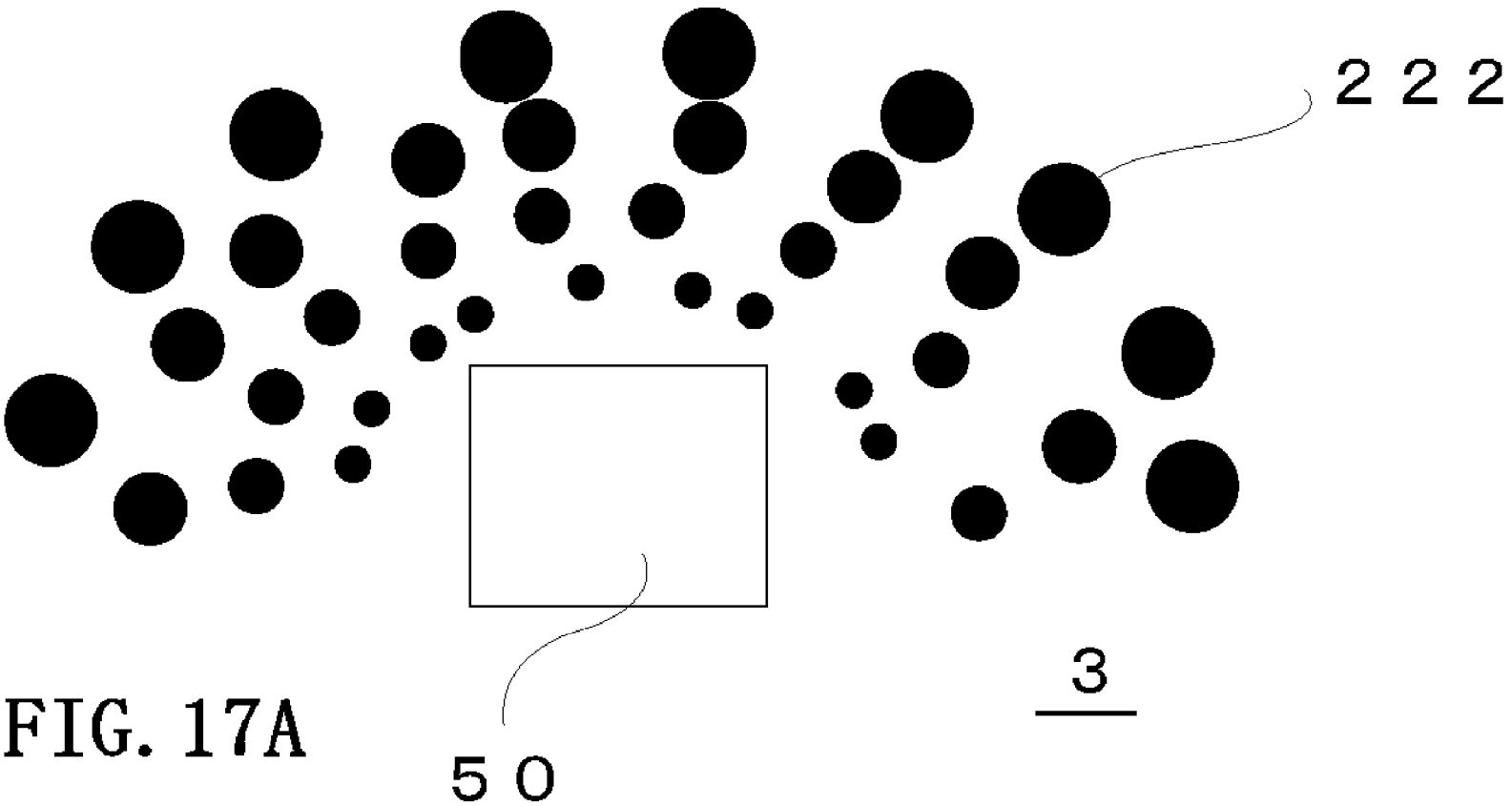
FIG. 17A is a top view showing an example of how a sound recording device 50 and a plurality of diffusion columns 222 in a sound recording system 3 are disposed according to the third embodiment of the present invention.
Figure 17B:
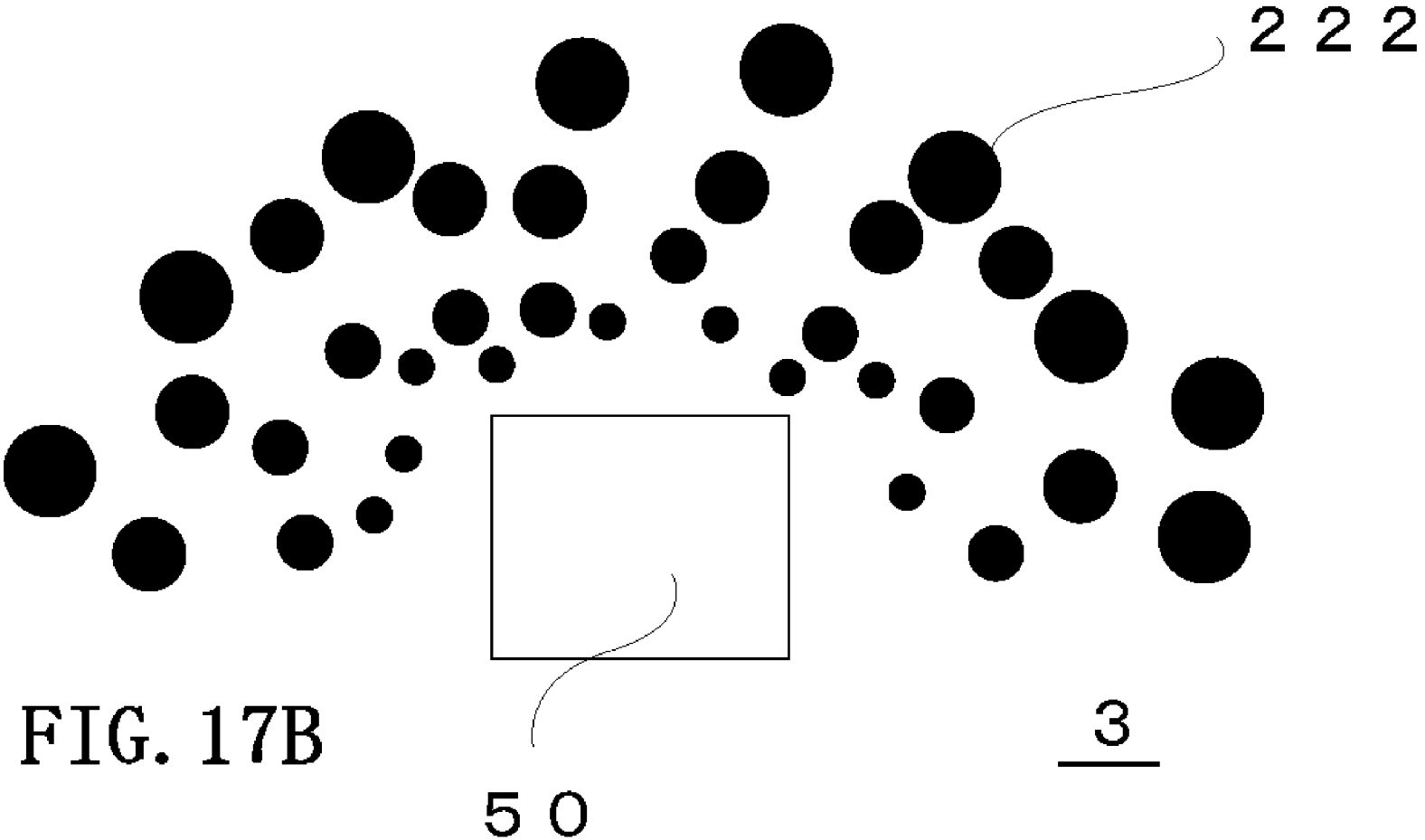
FIG. 17B is a top view showing an example of how a sound recording device 50 and a plurality of diffusion columns 222 in a sound recording system 3 are disposed according to the third embodiment of the present invention.

FIGS. 17A and 17B show examples of the arrangement of the sound recording device 50 and a plurality of diffusion columns 222 in the sound recording system 3 according to the third embodiment of the present invention. FIGS. 17A and 17B show the cases where a plurality of diffusion columns 222 is separated from the sound recording device 50.

What is shown in the arrangement example of FIG. 17A is the case where a plurality of diffusion columns 222, indicated by black circles, is arranged orderly on the rear, left and right sides of the sound recording device 50 in directions in which the diffusion columns 222 move away from the sound recording device 50 so that the diffusion columns 222 sequentially become thicker in diameter. What is shown in the arrangement example of FIG. 17B is the case where a plurality of diffusion columns 222, indicated by black circles, is randomly arranged on the rear, left and right sides of the sound recording device 50 in directions in which the diffusion columns 222 move away from the sound recording device 50 so that the diffusion columns 222 sequentially become thicker in diameter.

The arrangement examples shown in FIGS. 13A to 13F, FIGS. 14A to 14C, FIGS. 15A and 15B, FIGS. 16A and 16B, and FIGS. 17A and 17B are for illustrative purposes only. Needless to say, a plurality of diffusion columns 222 can be disposed randomly at arbitrary locations on the upper, lower, front, rear, left and right sides of the sound recording device 50, as long as the diffusion columns 222 are positioned around the sound recording device 50.

A plurality of diffusion columns 222 may be provided after being fixed to the sound recording device 50 (see FIGS. 13 and 15); or may be provided so as to be movable by means of a hinge or the like (see FIG. 14). Moreover, a plurality of diffusion columns 222 may be combined with the sound recording device 50 as one unit (see FIGS. 13 to 15); or may be provided in such a way that the diffusion columns 222 are separated from the sound recording device 50 (see FIGS. 16 and 17). Alternatively, the diffusion columns 222 can be attached to or removed from the sound recording device 50. In any case, all that is required is for the sound recording device 50 to be able to record sound waves that are spread in every direction, i.e. in the upward, downward, forward, backward, left-hand, and right-hand directions, by diffusing and reflecting to-be-recorded sound by means of a plurality of diffusion columns 222. Therefore, it is possible to obtain a sound-field environment with less coloration, which is acoustically desirable.

In the arrangement examples shown in FIGS. 13A to 13F, FIGS. 14A to 14C, FIGS. 15A and 15B, FIGS. 16A and 161B, and FIGS. 17A and 17B, a plurality of diffusion columns 222 is disposed behind a recording unit or baffle surface of the sound recording device 50. By such an arrangement, it is possible to pick up a direct sound, which is not reflected by the diffusion columns 222. Incidentally, when a plurality of diffusion columns 222 is disposed on the front side of the sound recording device 50, it is possible to pick up only a reflected sound. Therefore, it is possible to record a sound that makes a listener feel as if being in a forest. Moreover, for example, when a musical instrument is played and when a plurality of diffusion columns 222 is disposed around the sound recording device 50 in an anechoic room or the like, the sound recording system 3 can be used to record sound.

Since a plurality of columnar bodies exists around the sound recording device 50, it is possible to provide the sound recording system 3 that looks esthetically desirable. In particular, with the use of a plurality of random columnar bodies, it is possible to provide the sound recording system 3 that looks esthetically unique because of a combination of various kinds of surface coating, surface finishing, material and the like.

The sound recording system 3 of the third embodiment of the present invention uses a sound diffusion method, which uses the sound diffusion body 1 of the first embodiment of the present invention, in recording sound. Therefore, the sound recording system 3 of the third embodiment of the present invention can obtain the same advantageous effects that can be obtained from the sound diffusion body 1 of the first embodiment of the present invention.

Moreover, in the sound recording system 3 of the third embodiment of the present invention, it is possible to record sound by controlling the frequency characteristics of a low-tone range and a middle- and high-tone range, the relationship of diffusion/sound absorption, the frequency band, the reflection direction, the reflection-time structure and the like according to the state of the sound in the room. That is, since it becomes possible to control the ratio of diffusion of sound of a specific frequency to absorption of the sound to record sound, it is possible to reduce adverse effects on the process of recording sound, which arise from a sound-field characteristic of a studio. It is possible to record sound with natural reverberations even when a reverb (reverberation) device or the like is not used.

Therefore, it is possible to significantly improve a sound that the sound recording device records and provide a pleasant sound.

Examples

Comparison of Arrangements of Tubular Diffusion Body 10 with Simulation

Here, how much the sound in a room has been improved by the arrangements of the sound diffusion body 1 will be described based on the results of simulation.

In the sound diffusion body 1, the columnar diffusion body 20 can diffuse sound waves when being placed next to a speaker for a middle- and high-tone range. According to the results of experiments (not shown), regardless of a difference of the shape of a speaker, such as a toll boy-type speaker or floor-type speaker, or of a difference of a driving method, such as that of a horn-type speaker, electrostatic speaker or dynamic speaker, it is found that diffusion takes place successfully.

Moreover, as for diffusion and absorption of sound of a low-tone range, it is found that, when the columnar diffusion body 20 is placed as shown in the above FIG. 7A, it is possible to diffuse and absorb a low-pitched sound regardless of a difference of the shape of a speaker, i.e. regardless of whether the bass reflex port is of a shape/back side opening type or not or of other factors.

Furthermore, a question of whether it is possible to improve sound in a room when the tubular diffusion body 10 is separately disposed at a corner of the room as shown in the above FIG. 7B is examined in a concrete way through simulation.

The following describes the results of the simulation in which numerical simulation of the diffusion effects is performed in a difference method at a time when the tubular diffusion body 10 of the first embodiment of the present invention is separately disposed at a corner of the room. The simulation uses software "comfida", manufactured by Nittobo Acoustic Engineering Co Ltd, to carry out calculation in a two-dimensional difference method.

A calculation space of a diffraction target, which turns out to be the shape of a room, measures 7 m in width and 9 m in depth; calculation takes place in a compact difference method for the calculation space.

One speaker 30 is used as a sound source. As for the coordinates of the speaker 30 relative to the coordinates of the top left of a target space, the position is 1.7 m from the left end and at 1.5 m in depth. For the sound source (a source of generating sound waves) output from the speaker 30, a typical Gaussian wave packet is used.

Incidentally, needless to say, the speaker 30 can be replaced with the sound generation device 40 described in the second embodiment of the present invention.

Comparative Example 1

Firstly, with reference to FIG. 18A, the results of simulation at a time when nothing is placed in a room will be described as Comparative Example 1.

Figure 18A:
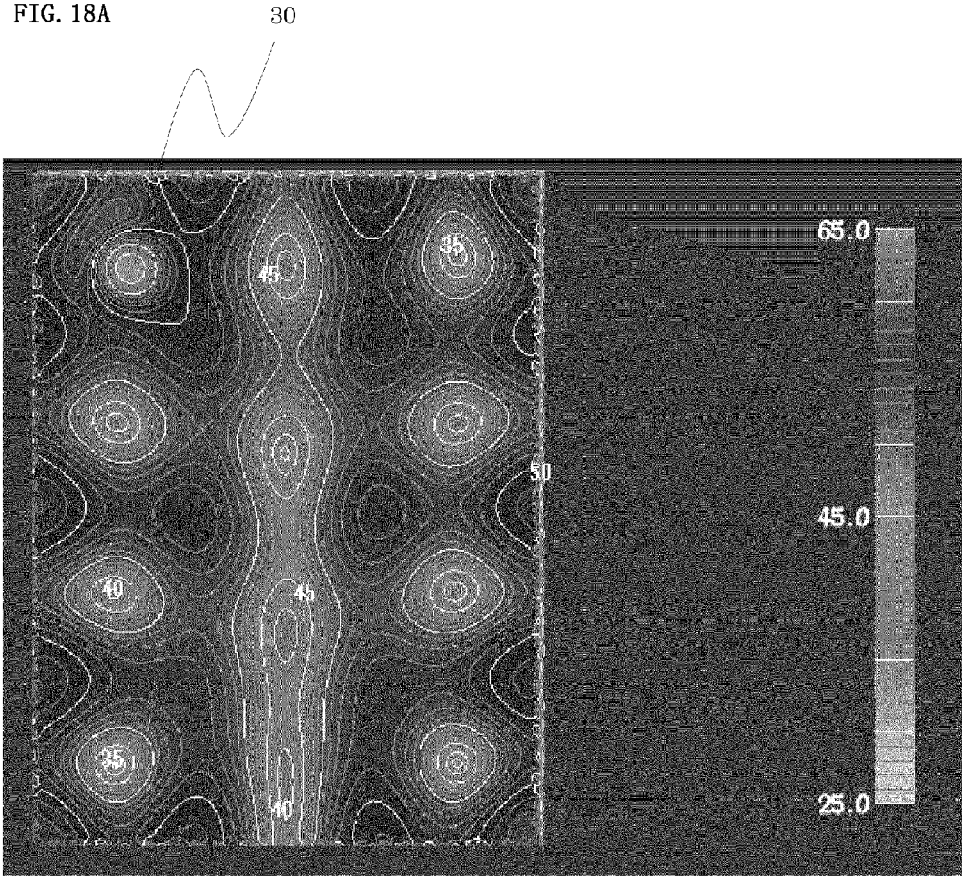
FIG. 18A is a diagram showing the distribution of a sound field of Comparative Example 1 in which a tubular diffusion body 10 is not used according to the first embodiment of the present invention.

In this case, what is shown is sound-pressure distribution of a 100 Hz band at a time when only one speaker 30 is placed in a square room of FIG. 18A as described above. Incidentally, the wall surfaces are designed to absorb sound to a certain degree as in typical wallpaper. Sound pressure (db) is shown in white numbers.

In that manner, when only the speaker 30 is placed in the room, the peak-dip differences of sound pressure, such as flutter echoes, appear clearly in a kind of patchy pattern.

Example 1

Then, with reference to FIG. 18B, the results of simulation at a time when tubular diffusion bodies 10 are placed at four corners of a room will be described as Example 1.

Figure 18B:
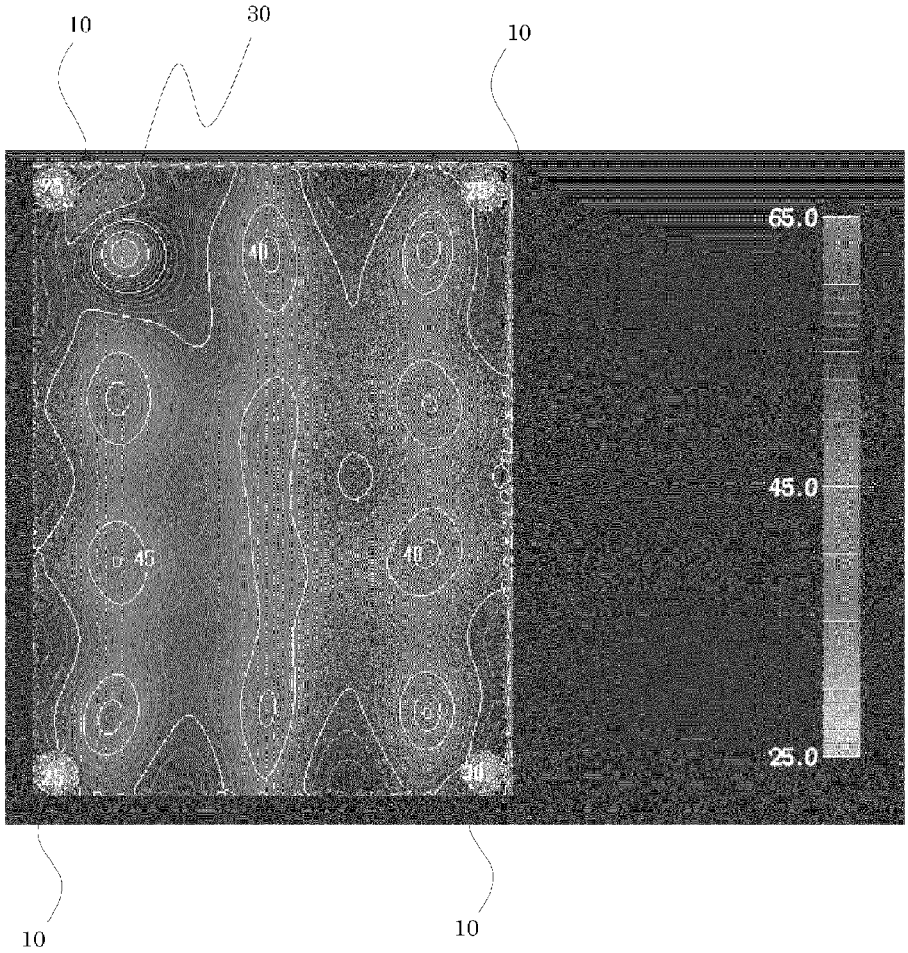
FIG. 18B is a diagram showing the distribution of a sound field of Example 1 in which a tubular diffusion body 10 is used according to the first embodiment of the present invention.

In the case of FIG. 18B, what is shown is sound-pressure distribution of a 100 Hz band at a time when only one speaker 30 is placed in a square room that is equal in size to that of FIG. 18A. In the case of FIG. 18B, the separated tubular diffusion bodies 10 are placed at locations that are 0.7 m in the lateral direction and 0.5 m in the vertical direction away from the corners of the room. Incidentally, as in the case of FIG. 18A, the walls are designed to absorb sound to a certain degree. Sound pressure (db) is shown in white numbers.

When a comparison is made between Example 1 of FIG. 18B and Comparative Example 1 of FIG. 18A, it is found that sound-pressure distribution is smoother at a time when the tubes are placed at the corners as shown in FIG. 18B, and that the difference between the peaks, where sound pressure is large, and the dips, where sound pressure is small, is small. Therefore, what is obtained is a good sound field with less low-pitched sound, which could have an adverse effect on the sound field, such as flutter echoes.

Therefore, even when the tubular diffusion bodies 10 are placed at the corners of the room, it is possible to obtain a good sound field by reducing flutter echoes or the like of a low-tone range, which occur in the room.

In that manner, according to the sound diffusion body 1 of the first embodiment of the present invention, with the use of the columnar diffusion body 20, which forms a plurality of reflection surfaces on which the reflection direction/reflection-time delay (phase) of a middle- and high-tone range is randomly reflected, and of the tubular diffusion body 10, which absorbs and diffuses a low-tone range, it is possible to significantly improve sound in the room.

Because of the above configuration, the following advantageous effects can be obtained.

According to the acoustic panel device of Conventional Technology 1, the problem is that the characteristics of high-, middle- and low-tone ranges are determined from the material, shape and dimensions. Accordingly, in order to improve sound in a room, it is impossible to improve sound when a high-tone range is separated from middle- and low-tone ranges. All that can be done is to absorb and reflect sound in accordance with a frequency characteristic of the acoustic panel device at the location where the acoustic panel device is placed. Therefore, sound cannot be improved sufficiently.

On the other hand, according to the sound diffusion body 1 of the first embodiment of the present invention, the columnar diffusion body 20, which supports a middle- and high-tone range, can be separated from the tubular diffusion body 10, which supports a low-tone range. Therefore, it is possible to freely adjust the positions where the columnar diffusion body 20 and the tubular diffusion body 10, which supports a low-tone range, are placed in a room; and adjust a sound field in a way that makes the sound field most suitable for the shape or acoustic characteristic of the room. That is, in a user's listening room having various kinds of acoustic characteristics, it is possible to form a diffusion body that improves a wide-range sound field.

Furthermore, it is possible to flexibly support speaker and sensor systems having various characteristics, such as the sound generation system 2 of the second embodiment of the present invention or the sound recording system 3 of the third embodiment of the present invention, and, for example, a difference of the sound field associated with a difference of the formation position of the bass reflex port and other differences.

Moreover, the columnar diffusion body 20 is formed in the shape of a circular arc or bow. Therefore, it is possible to diffuse a sound of a middle- and high-tone range with a certain level of directivity. Thus, it is possible to arrange the columnar diffusion body 20 in accordance with a frequency characteristic of a speaker or the like and a characteristic of a phase.

Moreover, it is possible to arrange the tubular diffusion body 10 in accordance with the shape of a bass reflex port or woofer of a speaker or the like or other factors; and to absorb and diffuse a low-pitched sound in an effective manner.

According to a conventional acoustic panel, a packing material is usually disposed of after a user receives the acoustic panel and takes out the acoustic panel from the packing material. Even if the discarded packing material can be melted and recycled, resources end up being wasted.

On the other hand, according to the sound diffusion body 1 of the first embodiment of the present invention, it is possible to produce the tubular diffusion body 10 from an inexpensive material such as paper. Therefore, the tubular diffusion body 10 can be used as a packing material. Therefore, it is possible to make effective use of resources and reduce the cost of the packing material. Moreover, when the tubular diffusion body 10 is made of paper or the like, the cost of producing the tubular diffusion body 10 is inexpensive, and it is easy to recycle.

According to the sound diffusion body 1 of the first embodiment of the present invention, the columnar diffusion body 20 is formed for a middle- and high-tone range. It is possible to use the tubular diffusion body 10 for a low-tone range of a frequency band suitable for the columnar diffusion body 20.

Therefore, it becomes easier to adjust the level of diffusion and absorption of sound for a low-tone range and a middle- and high-tone range.

Moreover, the columnar diffusion body 20 is formed into a compact, thin body. Therefore, the columnar diffusion body 20 can be arranged more easily than a columnar diffusion body that is so formed as to be embedded in a wall.

Furthermore, compared with a plate-like acoustic panel, the columnar diffusion body 20 allows air to pass therethrough in the backward direction. That results air conditioning in the room is not disturbed. Therefore, it is possible to reduce adverse effects on audio associated with air conditioning.

Moreover, as compared with a simple plate-like acoustic panel, the columnar diffusion body 20 is not psychologically obstructive even as the interior of the room.

<Configuration of Tubular Diffusion Body 10 with No Adjustment Section 130>

Incidentally, the configuration of the tubular diffusion body 10 may not have the adjustment section 130.

Figure 19:
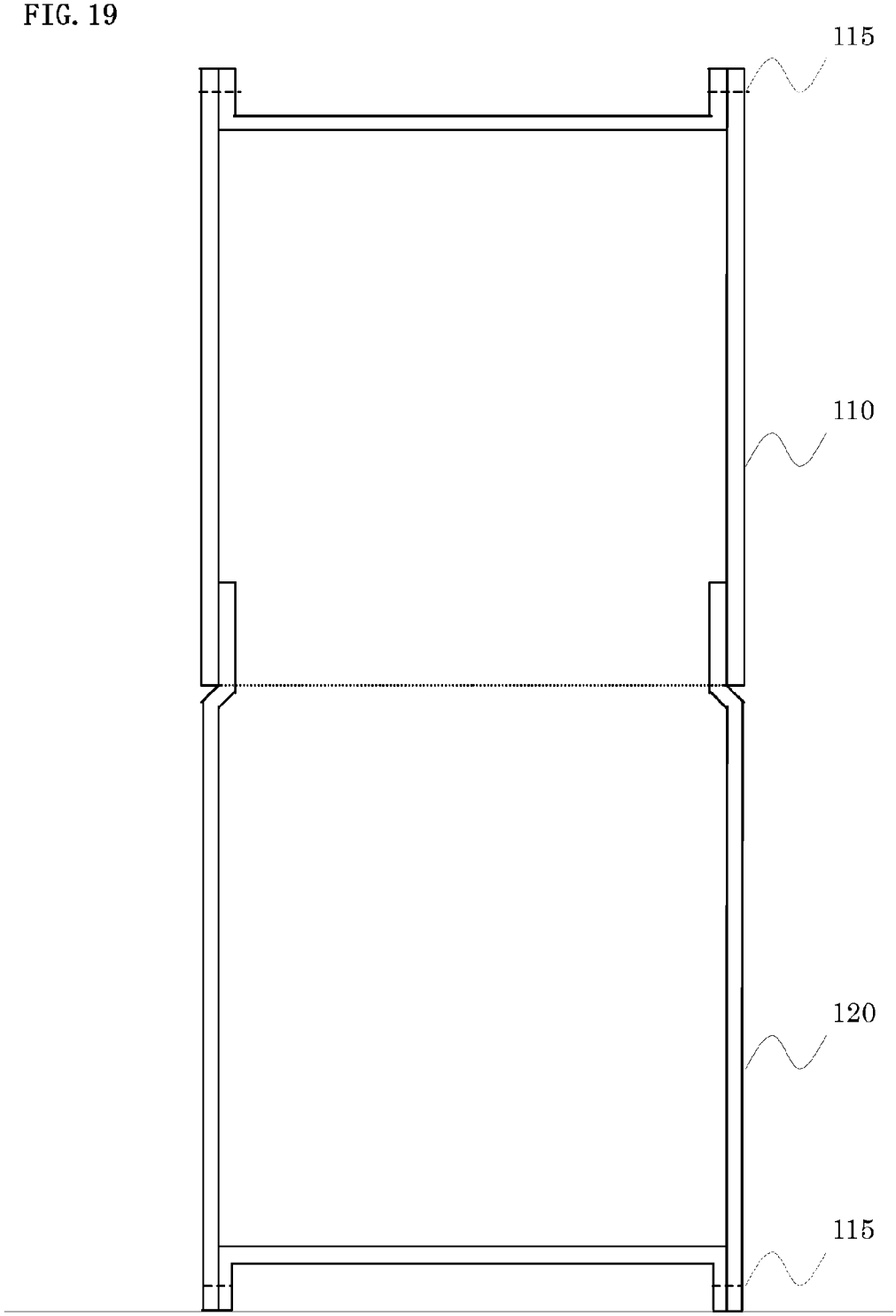
FIG. 19 is a cross-sectional view of a tubular diffusion body 10 that is so formed as not to have an adjustment section 130 according to the first embodiment of the present invention.

FIG. 19 shows a cross-sectional view of the tubular diffusion body 10 cut along the diameter. In the example here, the diameter of the upper end of the lower column 120 is made slightly smaller, so that the upper column 110 is placed thereon and connected. Therefore, even if there is no adjustment section 130, it is possible to adjust the height of the tubular diffusion body 10 by means of the upper column 110 and the lower column 120 and adjust a low-pitched sound that is absorbed and diffused.

Moreover, in the example of FIG. 19, a similar material that is in a circular shape is attached to the upper end portion of the upper column 110 and the lower end portion of the lower column 120 by sewing the material with a thread along seams 115 or using other methods. Therefore, it is possible to increase the strength of the upper column 110 and the lower column 120. Thus, even when there is no adjustment section 130, the tubular diffusion body 10 can be sufficiently strong as a packing material and highly durable.

Sound Adjusting Method, Sound Adjusting Program, Sound Field Adjusting System, Speaker Stand, and Furniture

Fourth Embodiment

System Configuration

Figure 20:
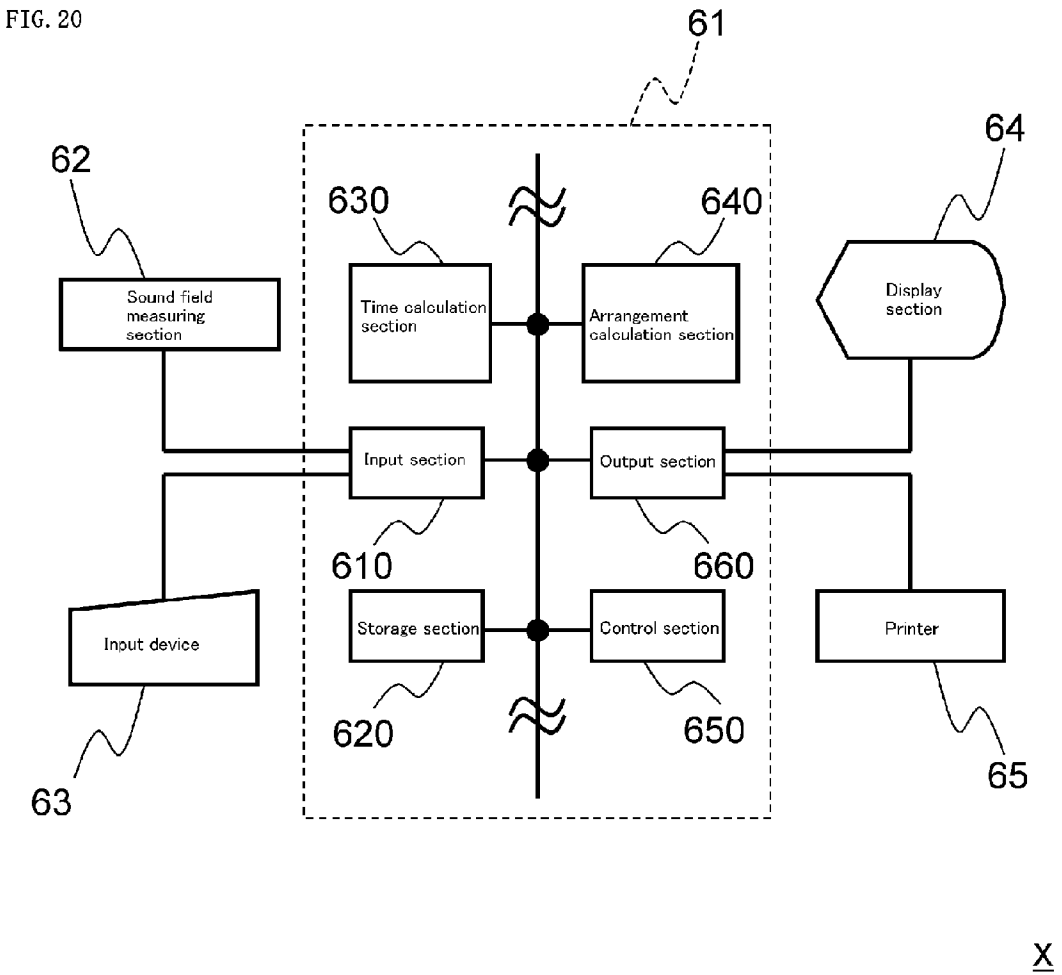
FIG. 20 is a control configuration diagram of a sound adjusting system X according to a fourth embodiment of the present invention.

With reference to FIG. 20, the control configuration of a sound adjusting system X of a fourth embodiment of the present invention will be described.

The sound adjusting system X includes the following main components: a PC 61, a sound field measurement section 62, an input device 63, a display section 64, and a printer 65.

The PC 61 is a PC (Personal Computer), i.e. a typical PC/AT-compatible or MAC-standard personal computer; and is a component able to perform calculation of a sound adjusting method of the fourth embodiment of the present invention. The PC 61 includes the following main components: an input section 610 (input means), which inputs various kinds of data; a storage section 620 (storage means), which stores input data, data that are used in arranging a sound diffusion body, and other data; a time calculation section 630 (diameter calculation means), which is a computing unit or the like to calculate the diameter of a sound diffusion body described below; an arrangement calculation section 640 (output value calculation means), which is a computing unit or the like to calculate an arrangement condition of a sound diffusion body; a control section 650, which is a CPU (Central Processing Unit), MPU (Micro Processing Unit) or the like; and an output unit 660, which outputs the results of calculation.

The sound field measurement section 62 is a device that is for example equipped with a directional sound wave generation device and a microphone to measure a sound field in a room; and is able to acquire data about a reflected sound or sound-field properties in the room with the use of an ultrasonic wave or the like. Therefore, it is possible to obtain data about the relationship between a direct sound and a temporary reflected sound.

The input device 63 is a component associated with a user interface, such as a pointing device like a keyboard or mouse, or touch panel.

The display section 64 is a display device, such as a typical LCD display, plasma display, or organic EL (electroluminescence) display. The display section 64 may display the structure of a room in a three-dimensional way using a liquid crystal shutter system, a hologram system or the like.

The printer 65 is a printing device, such as a typical printer or X-Y plotter. The printer 65 may include a flash memory card reader/writer or the like to store data about a design drawing, the arrangement of the sound diffusion body and the like.

[Configuration of PC 61]

The following provides a more detailed description of the PC 61.

The input section 610 has a variety of terminals and I/Os, such as a USB, network, serial or parallel, that accept inputs from the sound field measurement section 62, the input device 63 and other sections not shown in the diagram, such as input means like a LAN, WAN, flash memory card reader, DVD-ROM or the like. The input section 610 can input data about sound fields of various kinds of acoustic room, shape and the like from the sound field measurement section 62, as well as data about the shape of various kinds of acoustic room and the like, which are set in advance by a person in charge of measurement.

The storage section 620 is a RAM, ROM, flash memory, HDD (Hard Disk Drive), or the like. The storage section 620 stores data about sound fields of various kinds of acoustic room, shape and the like, a sound adjusting program that is used to execute a sound adjusting method of the fourth embodiment of the present invention, and other kinds of data needed for the sound adjusting program.

The time calculation section 630 is a computing unit, such as a DSP (Digital Signal Processor) that is used exclusively for calculation, a computing device that is used exclusively for physics calculation, or a GPU (Graphics Processing Unit). The time calculation section 630 calculates the time between a direct sound 1200 and an early-reflected sound 1300, which are described later, from data of the sound field measurement section 62.

The arrangement calculation section 640 is a computing unit able to calculate in real time, such as a DSP that is used exclusively for calculation, a computing device that is used exclusively for physics calculation, or a GPU. The arrangement calculation section 640 calculates an arrangement condition that is most suitable for a sound diffusion body in order to insert a diffusion reflected sound 1360 during the time between the direct sound 1200 and the early-reflected sound 1300, which are described later.

The control section 650 is a component that actually controls and calculates when a noise judgment process is executed, as described below. The control section 650 executes various kinds of control and calculation process according to a program memorized in a ROM, HDD, or the like of the storage section 620.

The output section 660 is an I/O or the like that outputs to output means such as the display section 64, printer 65 or the like. The output section 660 can output the structures of various kinds of designed acoustic rooms and a design drawing. The output section 660 can also output a design drawing of a sound diffusion body structure or the like, which includes the diameter of a sound diffusion body and an arrangement condition. Moreover, the output section 660 is equipped with an audio I/O and is able to simulate and output the way sound is actually heard during a simulation process described below.

Incidentally, the functions of the time calculation section 630 and arrangement calculation section 640 may be realized by means of the calculation function of the control section 650.

[Sound Adjusting Method]

Here, with reference to FIGS. 21 to 24, a sound adjusting method of the fourth embodiment of the present invention will be outlined.

As described above, since various kinds of acoustic rooms must be constructed in a limited space, there is only a restricted space behind a speaker P that is to be installed. According to various kinds of conventional acoustic rooms, the magnitude of an early-reflected sound and reverberant sound and the delay time are adjusted by adjusting a sound field in acoustic designing and acoustic installation or by combining acoustic panels.

According to such a conventional adjustment method, it is difficult to empirically adjust a sound field so as to give a sense of spreading that is greater than the sizes of various kinds of acoustic rooms.

Therefore, the inventors of the present invention have worked hard to examine and conduct experiments on a method for adjusting a sound field that gives a sense of greater spreading in various kinds of acoustic room.

The inventors of the present invention have found that a silent portion that emerges between a direct sound and an early-reflected sound (a primary reflected sound from a floor, wall, ceiling or the like) has a grater impact than previously thought on the sense of spreading of sound in various kinds of acoustic rooms.

That is, conventionally, a silent section has always appeared between a direct sound and an early-reflected sound, enabling a listener to detect the silent section wittingly or unwittingly. The listener can feel the sizes of various kinds of acoustic room consciously or unconsciously because of the length of the time of the silent section.

As a result, conventionally, it has been found that it is difficult to adjust a sound field that gives a sense of spreading greater in size than various kinds of acoustic rooms.

Accordingly, the inventors of the present invention has invented a sound field adjusting method for adjusting the creation of a diffusion reflected sound (multilayer diffusion sound) in the silent section that emerges between the direct sound and the early-reflected sound.

Thus, it is possible to significantly improve a sense of spreading of sound in various kinds of acoustic rooms.

As described above, the inventors of the present invention have come up with the sound field adjusting method to make up for a silent portion appearing between a direct sound and an early-reflected sound with a diffusion reflected sound.

The inventors of the present invention have worked hard to conduct experiments and examinations and concluded that it is difficult to realize such a multilayer diffused-reflection structure in the acoustic panel of Conventional Technology 2, a plate-like acoustic panel and a rugged acoustic panel.

The inventors of the present invention have come up with the use of a multilayer diffused-reflection structure to generate the diffusion reflected sound. For such a columnar diffusion body (a columnar diffusion sound-absorption body, a columnar reflection body, and a sound diffusion body), there is a body in which a plurality of columns that are different in diameter are arranged randomly (see https://www.noe.co.jp/product/pdt1/pd112.html, for example).

The columnar diffusion body is able to give a sense of spreading of sound in various kinds of acoustic rooms in an effective manner even when the arrangement of the columnar diffusion body is normal. At this time, a diffusion reflected sound has occurred in part of the area between a direct sound and an early-reflected sound. However, conventionally, the arrangement has been empirically changed to give a sense of spreading of sound as much as possible.

As for a method of forming and arranging a columnar diffusion body in a way that generates a diffusion reflected sound in a silent section appearing between a direct sound and an early-reflected sound, the inventors of the present invention have worked hard to conduct experiments and examinations and finally come up with the sound adjusting method of the fourth embodiment of the present invention.

According to the sound adjusting method of the fourth embodiment of the present invention, a multilayer diffusion reflection structure is formed by securing a gap between objects, which contribute to diffusion, on the basis of a criterion described below.

Because of the multilayer diffusion reflection structure, diffusion reflected sound is generated to make up for a section between a direct sound and an early-reflected sound, which are associated with a direct sound played from a speaker. Therefore, it is possible to realize a sense of spreading of sound that goes beyond the limits of the sizes of various kinds of acoustic rooms.

A primary reflected sound basically has the effects of making a listener sense reverberations of a room with respect to a direct sound. However, the problem is that the primary reflected sound interferes with the direct sound.

That is, with the same phase, the sound pressure of the primary reflected sound doubles to, for example, about 6 dB. However, when the phase is inverted, the sound pressure is edging toward zero indefinitely. Therefore, the problem is that, if there is a strong primary reflected sound, the frequency characteristic of the waveforms of the direct sound and primary reflected sound combined turns out to be an extremely rugged characteristic.

According to the sound adjusting method of the fourth embodiment of the present invention, it is possible to generate a diffusion reflected sound not only in a silent section appearing between a direct sound and an early-reflected sound but also in an early-reflected sound section containing a plurality of incoming primary reflected sounds.

Therefore, the advantage is that extreme interference of phase can hardly occur.

Moreover, since a diffusion reflected sound that emerges in a silent section appearing between a direct sound and an early-reflected sound ends up being a reflected sound after being reflected off a wall, it is possible to improve the frequency characteristic of the waveforms of the direct sound and primary reflected sound combined, along with the diffusion reflected sound of a primary reflected sound section. Therefore, it is possible to significantly improve the sound fields of various kinds of acoustic rooms.

Figure 22:
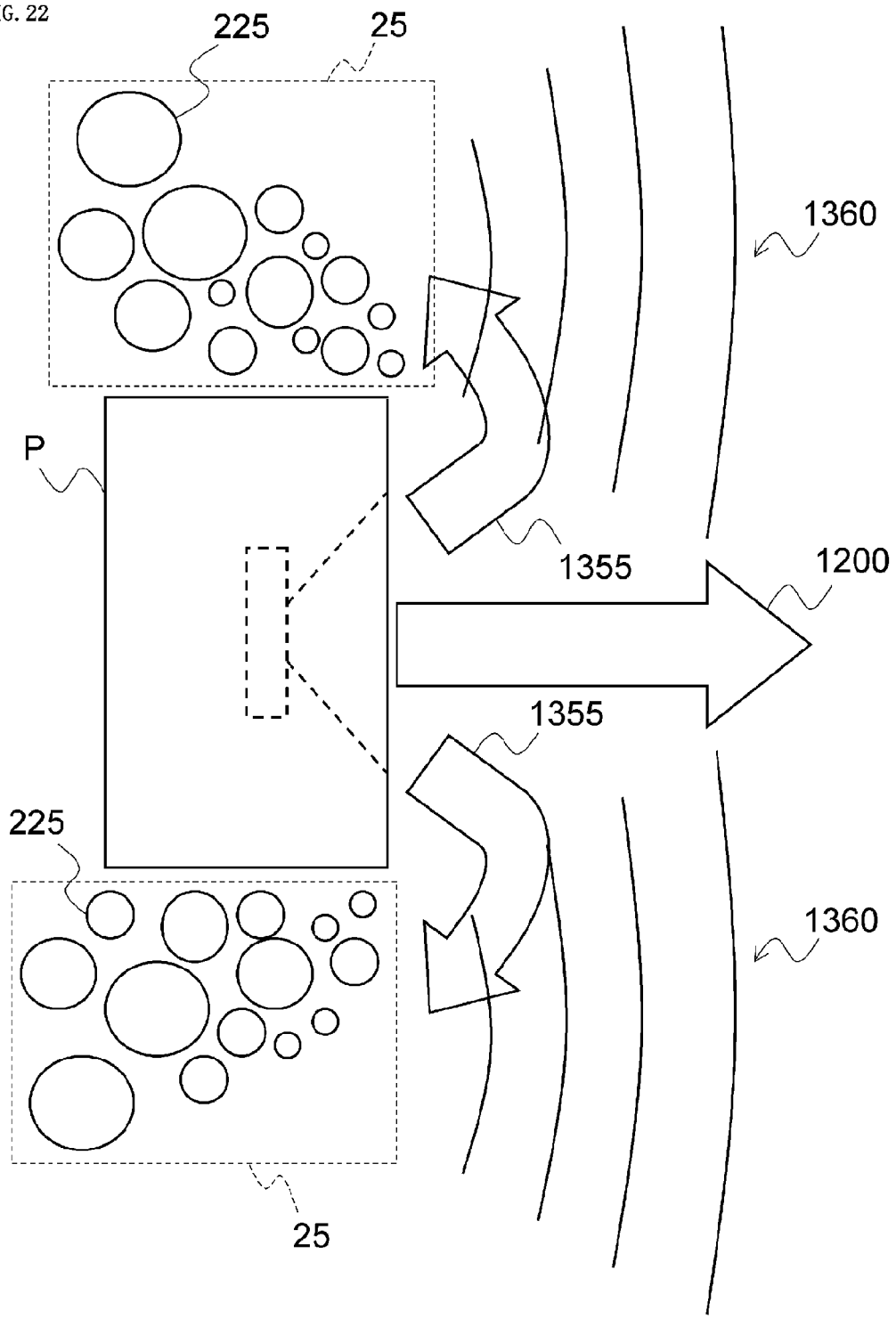
FIG. 22 is a conceptual diagram at a time when a sound diffusion body generates a diffusion reflected sound according to the fourth embodiment of the present invention.

FIG. 22 shows an example in which a plurality of sound diffusion bodies 225 (columnar diffusion bodies, for example), which are diffused-reflection bodies, are disposed as a sound diffusion body group 25, which is a multilayer diffusion structure as shown in the diagram.

In this case, a speaker P, which is a speaker (loudspeaker) of a typical dynamic type, electrostatic type or piezoelectric type or the like, generates a direct sound 1200.

As for the direct sound 1200, in a high-tone band (high-tone range; about several thousand Hz or more), acoustic energy with sharp directivity is emitted from the speaker P substantially in the front direction.

However, in a middle-tone band (middle-tone range; between about 500 Hz to 2,000 Hz), acoustic energy of −5 to −15 dB from the direct sound 1200 is emitted as a diffracted sound 1355 at an angle of 90 degrees in the lateral direction relative to the front of the speaker P.

In a low-tone band (low-tone range; about 300 Hz or less), acoustic energy is emitted with almost no directivity regardless of the direct sound 1200 or diffracted sound 1355.

Thus, conventionally, in particular, the acoustic energy of the middle- and low-tone range except the direct sound 1200 has been directly reflected off a wall or acoustic panel and ended up being part of an early-reflected sound. Even when an acoustic panel is placed behind the speaker P, all that can be done is to adjust the delay of an early-reflected sound; it is impossible to ensure a sufficient multilayer diffusion structure.

Therefore, a feature of the sound adjusting method of the fourth embodiment of the present invention is that a sound diffusion body 225 is placed around the speaker P.

Because of the sound diffusion body 225 placed around the speaker P, unlike the conventional case, it is possible to emit the acoustic energy except the direct sound 1200 as a diffusion reflected sound 1360 in a way that prevents the acoustic energy from turning into a portion of a primary reflected sound.

In this case, "diffusion," such as that of the diffusion reflected sound 1360, means that sound is reflected so complexly, or randomly, that the listener L cannot sense the reflection directions of sound waves having different frequency bands and/or the reflection-time delay (phase).

Figure 23:
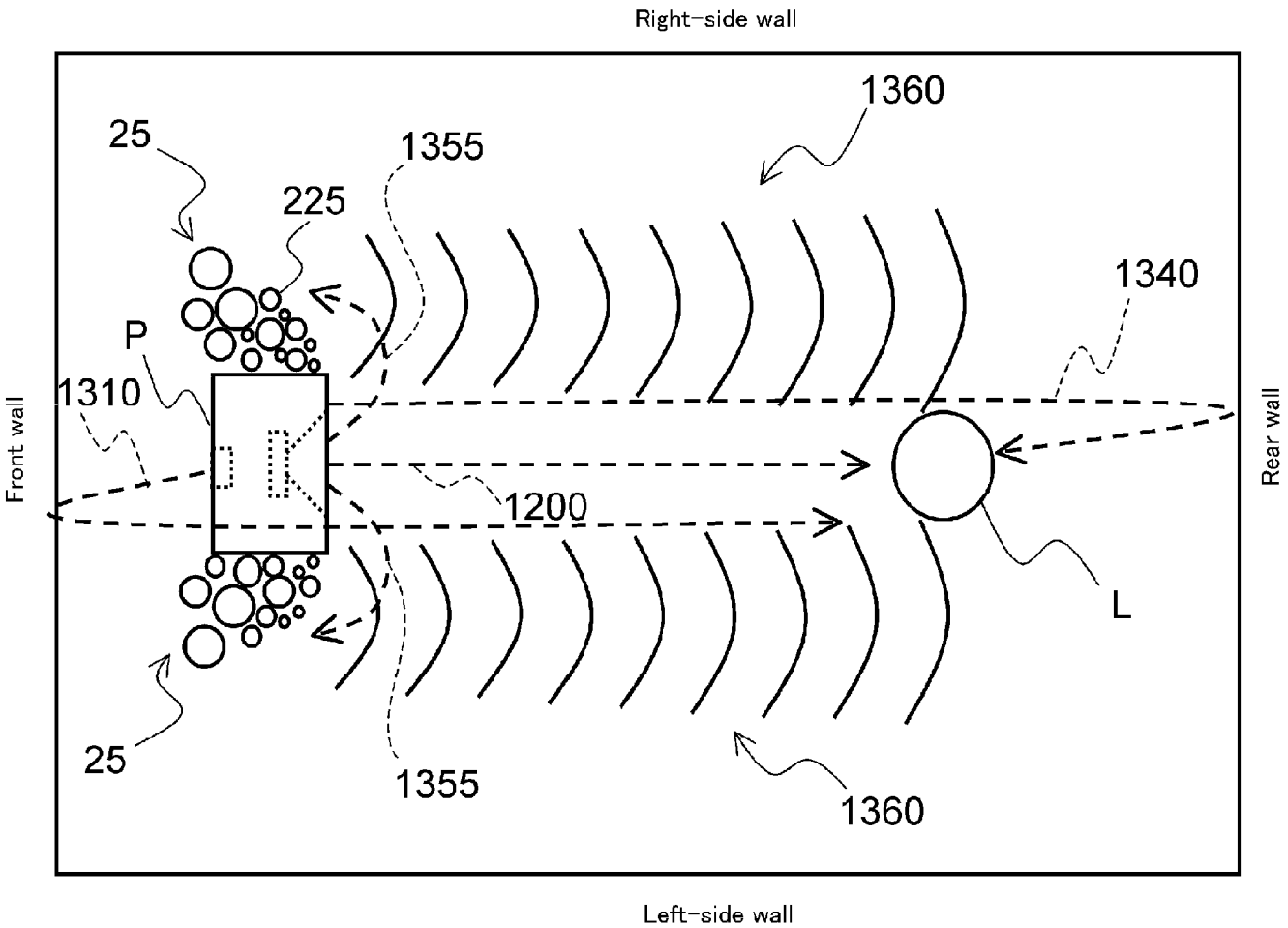
FIG. 23 is a conceptual diagram associated with a flat surface at a time when sound diffusion bodies are disposed in various kinds of acoustic room by means of a sound adjustment method according to the fourth embodiment of the present invention.
Figure 24:
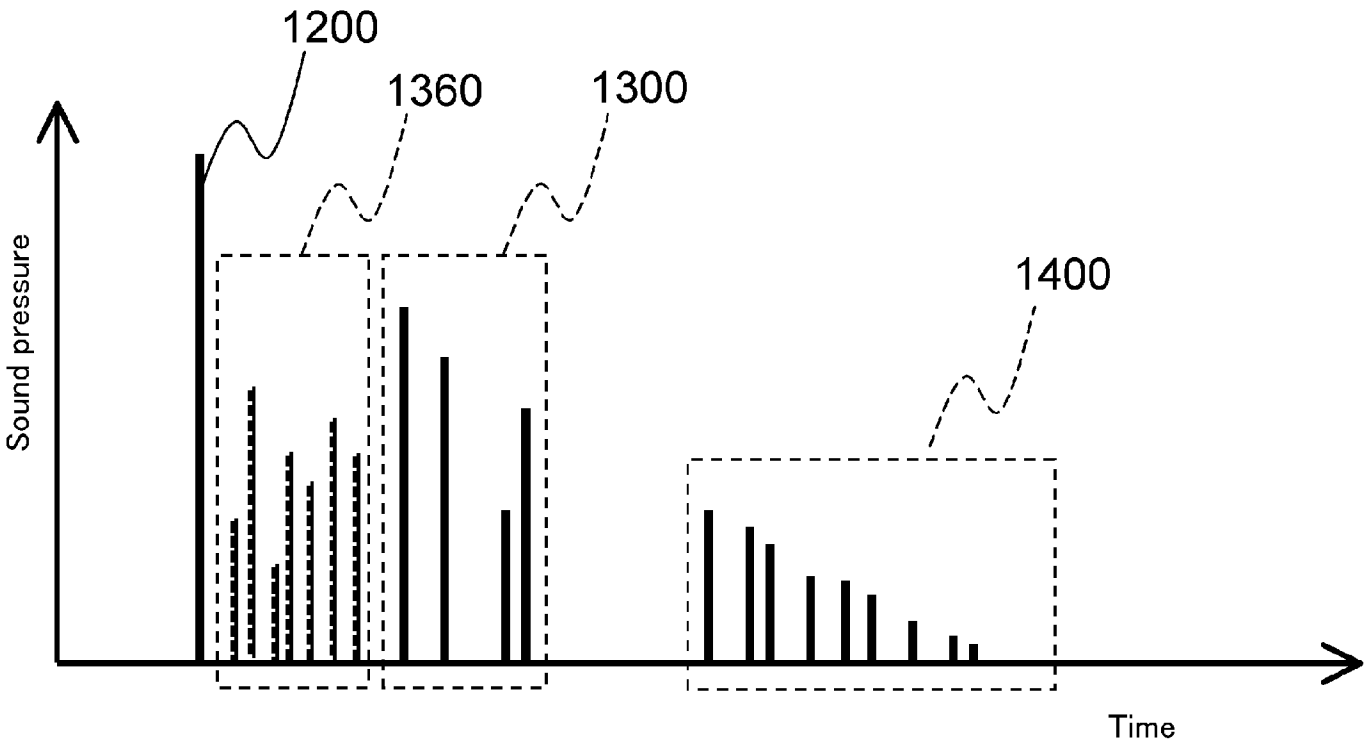
FIG. 24 is a graph showing the relationship between a direct sound, diffusion reflected sound, primary reflected sound, and reverberant sound, and the relation of time attenuation at a time when sound diffusion bodies are disposed in various kinds of acoustic room by means of a sound adjustment method according to the fourth embodiment of the present invention.
Figure 25:
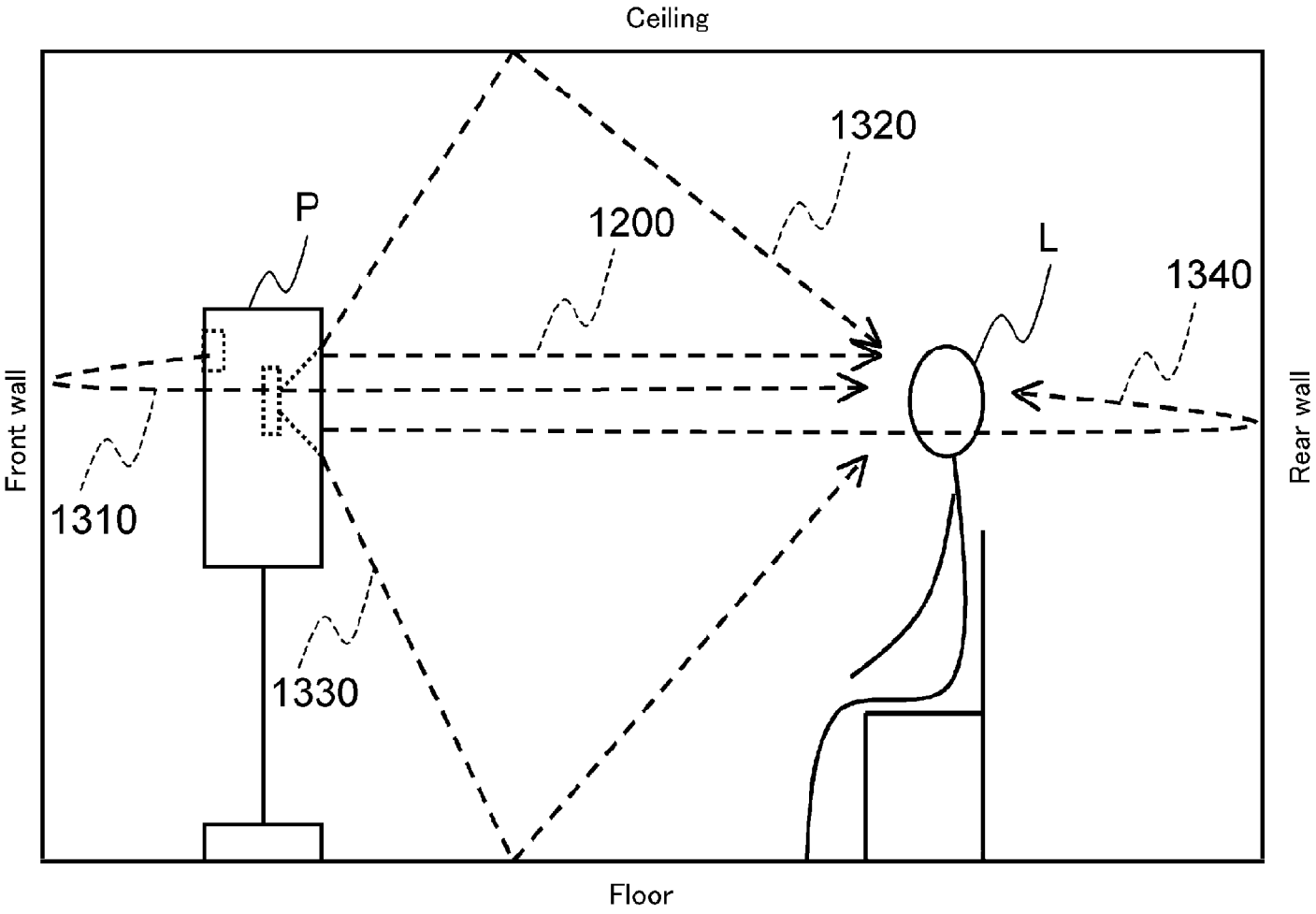
FIG. 25 is a conceptual diagram associated with side faces of various kinds of acoustic room about the relationship between a direct sound and an early-reflected sound in various kinds of conventional acoustic room.
Figure 26:
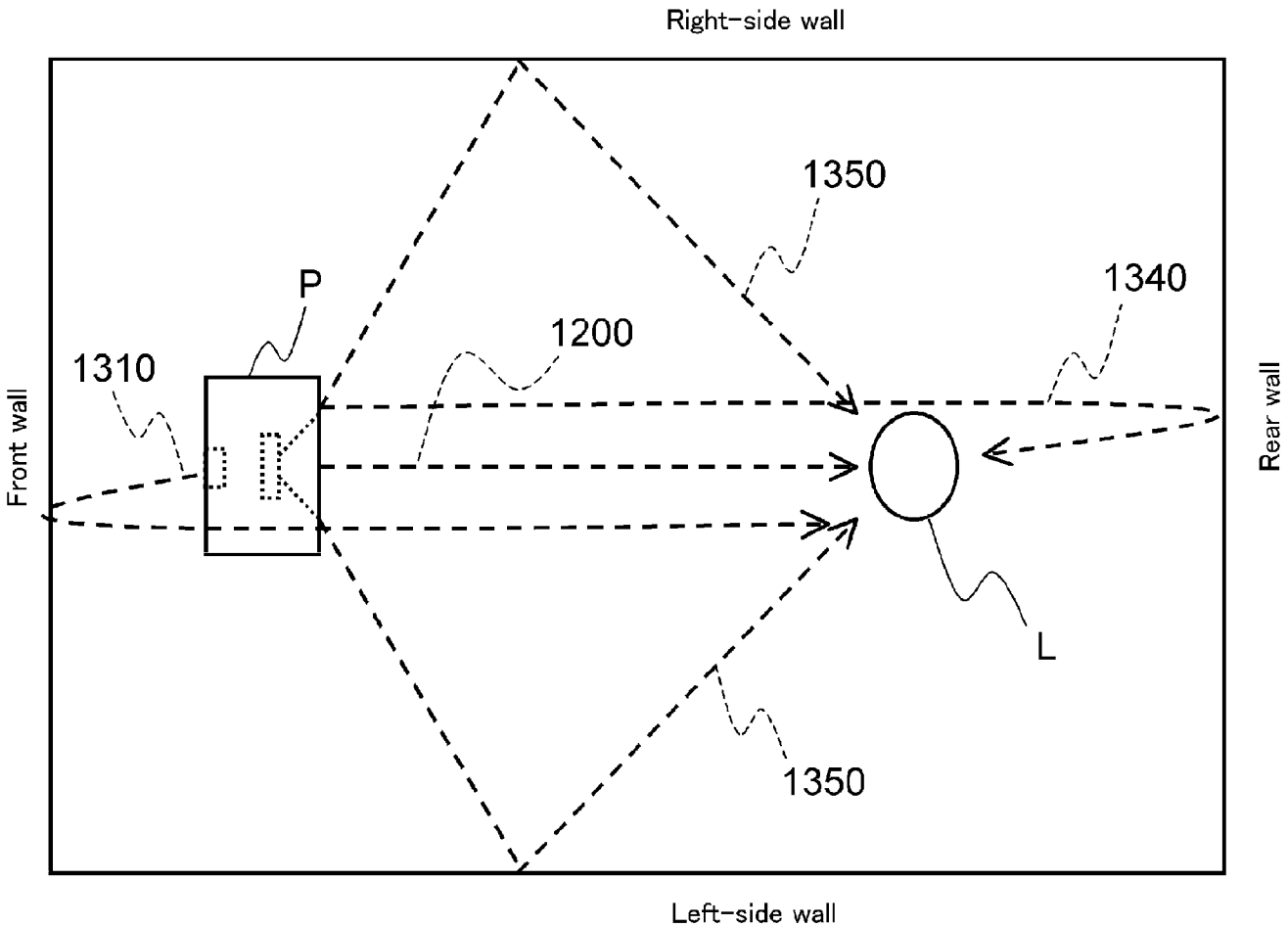
FIG. 26 is a conceptual diagram associated with flat surfaces of various kinds of acoustic room about the relationship between a direct sound and an early-reflected sound in various kinds of conventional acoustic room.
Figure 27:
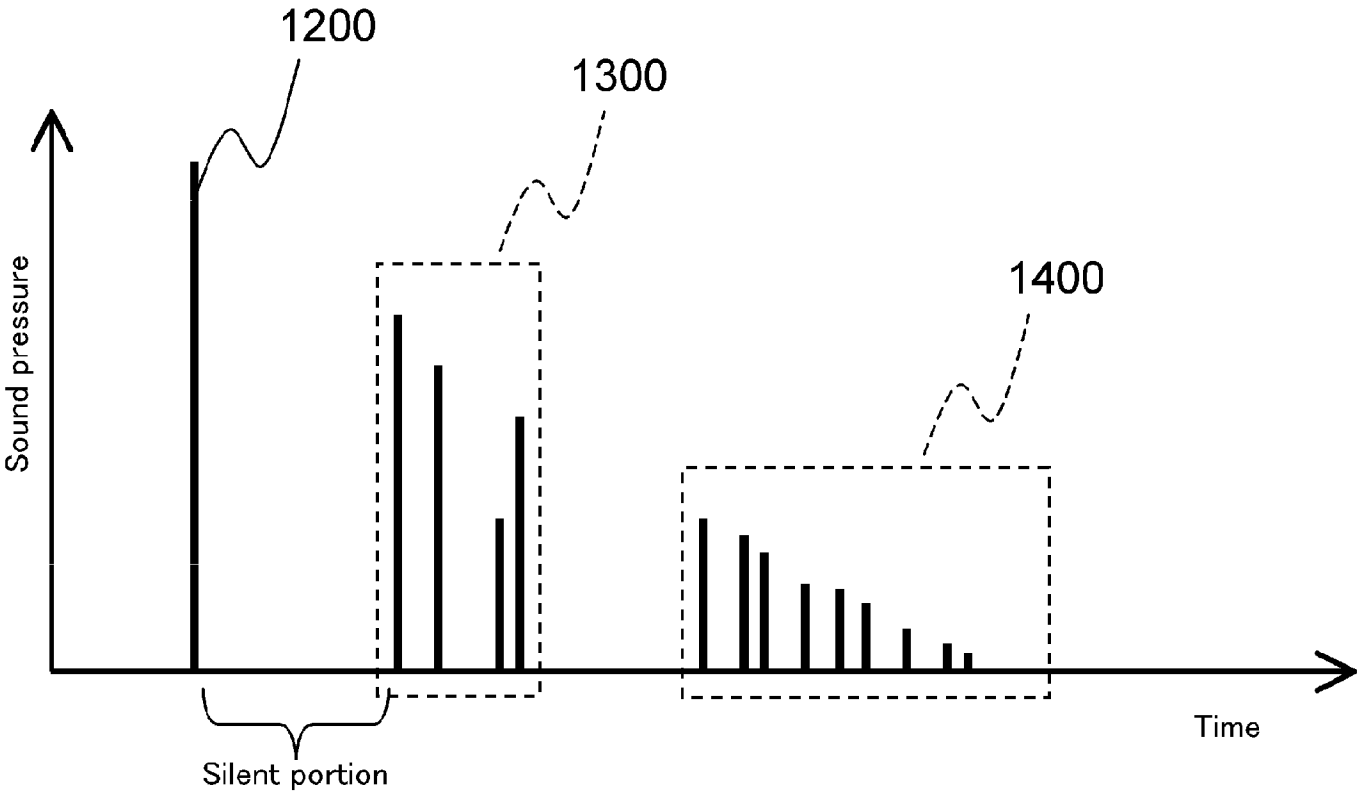
FIG. 27 is a graph showing the relationship between a direct sound, primary reflected sound, reverberant sound, and time attenuation in various kinds of conventional acoustic room.

FIGS. 23 and 24 show an example in which the above diffusion reflected sound 1360 reaches a listener in various kinds of acoustic rooms.

As shown in FIG. 23, the diffusion reflected sound 1360 reaches the listener L along with the direct sound 1200 in a way that maintains a predetermined level of spreading. By the configuration and arrangement of sound diffusion bodies 225 in the sound diffusion body group 25 formed by a process described below, the diffusion reflected sound 1360 reaches the listener L in a section of the time during which the direct sound 1200 and the early-reflected sound 1300, such as front-wall reflected sound 1310 and rear-wall reflected sound 1340, have just arrived.

Therefore, it is possible to make the direct sound 1200 magnificent particularly with respect to a middle- and low-tone range. FIG. 24 shows an example in which the diffusion reflected sound is added.

Incidentally, in this case, for ease of explanation, one speaker P is provided. However, in the case of a stereo system, two similar speakers P can be arranged on the left and right sides. Moreover, it is possible to support a multichannel system such as a surround-sound system.

[Process of Sound Adjusting Method]

Here, with reference to FIG. 21, the sound adjusting method of the fourth embodiment of the present invention will be described in detail.

As described above, according to the sound adjusting method of the fourth embodiment of the present invention, the configuration and arrangement of sound diffusion bodies 225 are calculated so that the diffusion reflected sound 1360 appears between the direct sound 1200 and the early-reflected sound 1300.

As for the configuration and arrangement, an arrangement method is employed: According to the arrangement method, diffused-reflection bodies (sound diffusion bodies), which are not necessarily in the shape of a column for carrying out diffusion of sound, are arranged in a multilayer pattern so that gaps are created therebetween, and the average density of the diffused-reflection bodies increases as the diffused-reflection bodies move away from a sound source and/or sound-reception coordinates. As for the increase in the density, an average value of gaps between objects that contribute to diffusion is calculated in response to the sound of various kinds of acoustic rooms. Therefore, it is possible to realize a multilayer diffusion structure. The columnar diffusion bodies may be fixed to a plate on which holes are made or the like; and arranged so as to be skewered. Therefore, the advantage is that it becomes easier to produce and arrange columnar diffusion bodies.

Incidentally, for the diffused-reflection bodies, the following describes an example in which columnar diffusion bodies are used. However, the diffused-reflection bodies in any shape, such as in the shape of a ball, an elliptic ball or a rugged object skewered, may be used as long as the structure obeys the results of calculation as to the average value of gaps.

Figure 21:
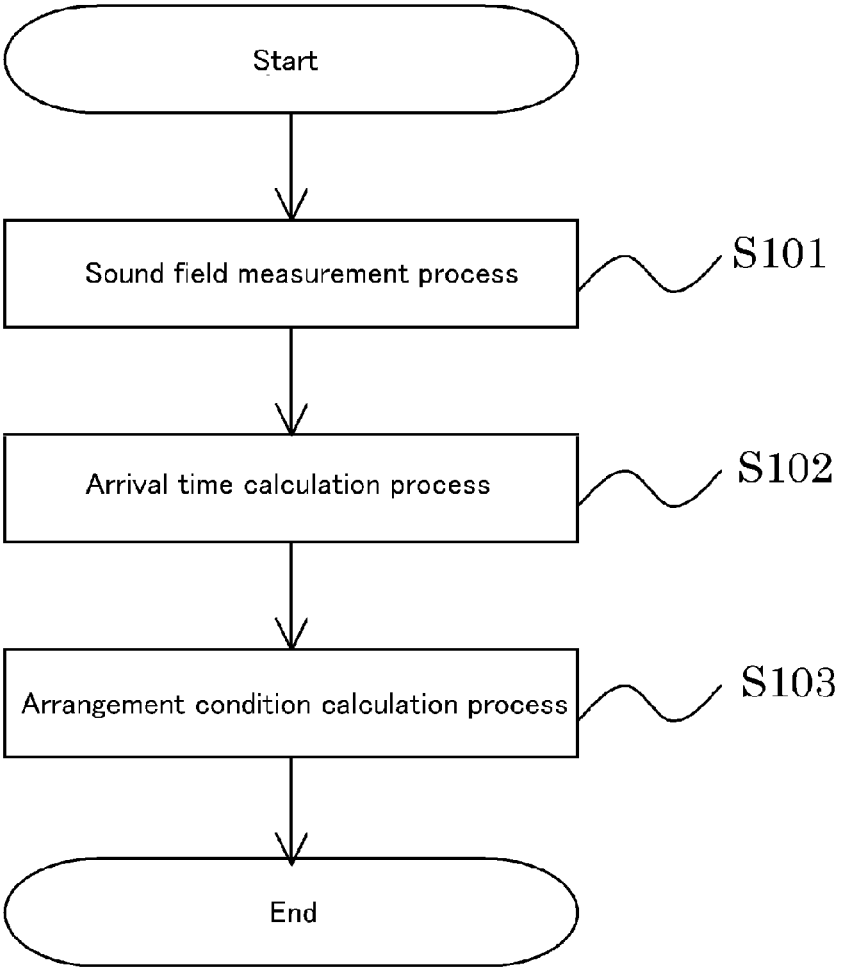
FIG. 21 is a flowchart associated with an operation of the sound adjusting system X according to the fourth embodiment of the present invention.

The following provides a detailed description of the process with reference to FIG. 21. The control section 650 of the PC 61 performs the process and controlling each component according to the program stored in the storage section 620.

(Step S101)

Firstly, the sound field measurement section 62 of the PC 61 performs a sound-field measurement process.

More specifically, the sound field measurement section 62 emits a sound wave of a predetermined frequency from a speaker or the like, not shown in the diagram; measures the sound wave by means of a microphone or the like; and measures acoustic characteristics, such as the properties of the early-reflected sound 1300 of various kinds of acoustic rooms or the volume of a reverberant sound.

It is also possible to calculate acoustic characteristics by performing simulation and calculation with the use of a three-dimensional scanner, data about the shapes of various kinds of acoustic rooms, and information about the arrangement of acoustic panels and the like.

In particular, the use of design drawings of various kinds of acoustic rooms and the like makes it possible to similarly adjust a diffusion sound through simulation that relies on numerical calculation.

(Step S102)

Then, the time calculation section 630 of the PC 61 performs an arrival time calculation process.

At the above step, a section that ranges from the arrival of the direct sound 1200 to the arrival to the early-reflected sound 1300 is calculated from the above acoustic characteristics. It is also possible to calculate the section in milliseconds between a peak of acoustic energy measured as the direct sound 1200 and a peak of acoustic energy measured as the early-reflected sound 1300.

In the case of the simulation that relies on numerical calculation, for example, in accordance with the sound speed or the like in the atmosphere at a temperature of 25 degrees Celsius, the state of the arrangement of the speaker P, and the distance from the wall, the peak of acoustic energy measured as the direct sound 1200 and the peak of acoustic energy of the early-reflected sound 1300 are calculated. Therefore, it is possible to calculate a silent section between the direct sound 1200 and the early-reflected sound 1300.

Thus, it is possible to calculate a section in which the diffusion reflected sound 1360 should emerge.

(Step S103)

Then, the arrangement calculation section 640 of the PC 61 performs an arrangement condition calculation process.

Here, an example in which the above diffused-reflection bodies are used as columnar diffusion bodies will be described.

If a cross-sectional surface of the columnar diffusion body is in the shape of a circular column, it is possible to almost ideally emit again a sound wave whose wavelength is shorter than the diameter in a predetermined proportion. Therefore, it is possible to return diffusion sounds evenly across a broader area. Moreover, the cross-sectional surface may not be in the shape of a circular column, but in the shape of an elliptic column or in another shape.

The diameter of the columnar diffusion body at a time when a sound wave enters a cylinder has been continuously analyzed. Therefore, it is possible to use the results of the analysis (see Acoustic Engineering Principle, "http://www.acoust.rise.waseda.ac.jp/publications/onkyou/genron-4.pdf," for example).

After that, as for a columnar diffusion body group that uses a plurality of columnar diffusion bodies, the following are calculated: the number of columnar diffusion bodies, the distance in a row, and the distance between rows. The calculation can be based on a criterion that is obtained by calculating the density for the cross-sectional area of each of cross-sectional surfaces, which are obtained by cutting a plurality of columns in a direction perpendicular to the length direction. Moreover, it is also possible to calculate, for each of the rows of the sound diffusion bodies, the density (aperture ratio) for the cross-sectional area of a gap from which an opposite plane can be seen at a time when a vertical-direction cross-sectional surface is projected relative to the length direction of columns of the columnar diffusion bodies. It is also possible to set the number of columns and the distance between the rows so that a difference of the cross-sectional areas is less than 10%.

The above settings mean that a value of the mean free path d in each row is kept substantially at a constant level.

The mean free path d associated with the diffusion of the sound diffusion bodies will be described in detail in the following equation:

[Equation 1]

$$d = \frac{(1 - 2na^2)}{2na}(m) \qquad \text{Equation (1)}$$

$$\begin{cases} a(m)\text{: diameter of circular column} \\ n(\text{number})\text{: number per unit area} \end{cases}$$

As indicated in the above equation, diffused-reflection bodies are disposed in such a way that the density increases as the mean free path d in each row moves away from a sound source and/or a sound-reception point, which is the coordinates of the listener L. In the example here, the sound diffusion bodies 225, which are columnar diffusion bodies, are disposed. That is, the sound diffusion bodies 225 are each in a multilayer or multiple state while being equipped with gaps. The sound diffusion bodies 225 are disposed in such a way that the density increases to reflect more on the rear side. Moreover, as described above, when the diffused-reflection bodies are columnar diffusion bodies, it is possible to control in a way that reflects a high-pitched sound diffusely and allows a low-pitched sound to pass therethrough before being reflected on the rear side by increasing an occupying cross-sectional area of a column that is thick in diameter in a moving-away direction.

As for the arrangement of the diffused-reflection bodies and the value of the mean free path d, in accordance with the sound speed or the like in the atmosphere at a temperature of 25 degrees Celsius, the state of the arrangement of the speaker P, and the distance from the wall, a distance is so set that the mean free path d reaches the listener L between the direct sound 1200 and the early-reflected sound 1300. At this time, at a location that is too remote from the speaker P, the diffracted sound 1355 ends up being an early-reflected sound. Therefore, the arrangement calculation section 640 can calculate in a way that brings the speaker P closer to the most appropriate distance.

The distances between the diffused-reflection bodies are set so that the columns, which are calculated in the above equation (1), are randomly arranged and spaced out. At this time, with respect to the value of a distance at a time when the columns are arranged evenly, the columns can be arranged randomly at a rate of about 5 to 50% with the use of random numbers.

Moreover, in accordance with the acoustic characteristics of various kinds of acoustic rooms, calculation may take place in such a way that a broadband frequency characteristic can be obtained.

Incidentally, calculation may further take place as to the arrangement of a sound-absorption layer; it is possible to form in a way that gives a sense of more spreading by adjusting the level of the early-reflected sound and reverberant sound.

As for the above method, the above has described the columnar diffusion bodies (columnar reflection bodies) as diffused-reflection bodies. However, the method is not limited to the above. Any kind of sound diffusion bodies can be used as long as the sound diffusion bodies have gaps and are arranged in such a way that the density of diffused-reflection bodies increases as the diffused-reflection bodies move away from the sound source and/or sound-reception point.

When the columnar diffusion bodies are fixed to a plate on which holes are made or the like and arranged so as to be skewered, it is also possible to calculate an acoustic effect that the plate, to which the columnar diffusion bodies are fixed, have.

Moreover, it is possible to adjust the arrangement of the sound diffusion bodies, with an angle of the speaker P with respect to walls of various kinds of acoustic room taken into account.

Depending on settings stored in the storage section 620, it also may be possible to add a diffusion reflected sound to the early-reflected sound 1300.

As for the settings, the settings about the following cases can be made: the case where the diffusion reflected sound needs to be added even to the early-reflected sound 1300; and the case where the diffusion reflected sound is added even to the early-reflected sound 1300 when the frequency characteristic of the early-reflected sound is not so flat due to the state of a sound field at the above step S101.

Furthermore, it is also possible to form in such away that the diffusion reflected sound is added after sound is played. In this case, one or a plurality of additional sub-speakers is disposed around the speaker P, so that a diffusion reflected sound is calculated, played and added. At this time, a sound whose phase is opposite to that of the early-reflected sound may be also calculated and added, thereby reducing the early-reflected sound.

Moreover, as for the sound played from the speaker P, it is also possible to form in such a way that a diffusion reflected sound is added directly to the section between the direct sound 1200 and the early-reflected sound 1300 by means of a digital delay or any other device.

Furthermore, in the case of multi-channel reproduction, it is also possible to form in such a way that a diffusion reflected sound is played from each speaker so as to reach, for example the listener L during the section between the direct sound 1200 and the early-reflected sound 1300. At this time, the most appropriate diffusion reflected sound is calculated, added and played on the basis of a surround speaker, such as a front or rear speaker, the arrangement of a center speaker, the distance from the listener L, and the like.

Moreover, according to the above fourth embodiment, the sound diffusion body 225 is placed next to the speaker P. However, the sound diffusion body 225 may be placed near the sound-reception point.

For example, in the case where the sound-reception point, where the listener L is positioned, has been set or in any other case, such an arrangement makes it possible to add a diffusion reflected sound in the section between the direct sound and the early-reflected sound and in a subsequent section regardless of a sound field of a room.

When the sound diffusion body 225 is disposed near the sound-reception point, it is possible to add a diffusion reflected sound not only to the diffracted sound 1355 of the direct sound but also to the direct sound. Therefore, it is possible to give a sound field a sense of more spreading.

It is also possible to form in such a way that the sound diffusion body 225 is disposed in front of the speaker P to make the direct sound pass through the sound diffusion body 225 directly so that a diffusion reflected sound is added to the direct sound.

Then, the process of the sound adjusting method comes to an end.

It is possible for designers of various kinds of acoustic rooms or those who build the acoustic rooms to arrange sound diffusion bodies around the speaker P, with the structure and arrangement of the sound diffusion bodies based on the results of calculation.

With the above configuration, the following advantageous effects can be obtained.

According to the sound field adjusting method of the fourth embodiment of the present invention, the acoustic panel is not a simple sound-absorption acoustic panel; it is possible to generate a diffusion reflected sound between a direct sound and an early-reflected sound.

Thus, for the sound played from the speaker P, it is possible to give a sense of depth beyond the sizes of various kinds of acoustic rooms. That is, the expected advantage is that it is possible to make the sound generated from the sound source more magnificent.

The reason is thought to be that since the diffusion reflected sound (multilayer scattered sound) is added, a listener is less likely to grasp the sizes of various kinds of acoustic room wittingly or unwittingly because of the distance between the direct sound and the early-reflected sound. Another expected advantage is to reduce primary reflected sounds from the left and right sides of a room.

Another expected advantage is that a reflected or reverberant sound, other than a sound field colored by the size of an original room, is added to make a sound field more magnificent because a diffusion reflected sound is further reflected.

Thus, according to the sound field adjusting method of the fourth embodiment of the present invention, the advantage obtained is that a sense of depth of sound has been improved in the case of stereo reproduction.

Moreover, in the case of multichannel reproduction, the advantage is that the "sound linkage" of each channel sense becomes better.

Moreover, an early-reflected or reverberant sound of a hall at the time of recording is originally included in the sound played from the speaker P. However, conventionally, it has been thought that a listener prioritizes a sound field of a room and senses the sound field.

On the other hand, according to the sound field adjusting method of the fourth embodiment of the present invention, a diffusion reflected sound is inserted into a section between a direct sound and an early-reflected sound. Therefore, it is possible to reduce an effect that a sound field of a room has and make audience feel the early-reflected sound and reverberant sound that the original reproduction sound includes.

Therefore, the advantage obtained is that a more realistic sense of a sound source, which is recorded in a grand hall such as those for classical music, is created.

Moreover, it becomes difficult to feel an unnecessary sound that comes with a sound field of a room. Therefore, the advantage obtained is that even when being viewed and listened to at full volume, audience does not get tired easily.

Moreover, according to the sound adjusting method of the fourth embodiment of the present invention, the diffused-reflection bodies around the speaker P keep gaps and are in a multilayer state; with the use of the arrangement method in which the density of the diffused-reflection bodies increases as the diffused-reflection bodies move away from the sound source and/or the sound-reception point, the sound diffusion bodies are formed and arranged.

Therefore, without the need to use a special electrical device, it is possible to adjust sound fields of various kinds of acoustic room so as to give a sense of spreading by adjusting sound at low costs. Another advantage is that, in particular, a process of renovating various kinds of existing acoustic room and other processes are unnecessary, resulting in lower costs.

As described above, according to the sound field adjusting method of the fourth embodiment of the present invention, it is possible to dispose the sound diffusion bodies in various kinds of existing acoustic room after the structure of the sound diffusion bodies is determined.

In addition, needless to say, the sound diffusion bodies can be used in various kinds of acoustic room (see http://www.noe.co.jp/product/pdt1/pd112.html, for example) where conventional columnar diffusion bodies are disposed.

With the columnar diffusion bodies used in the fourth embodiment of the present invention, for example, it is possible to make a listener feel as if a plurality of reflection/diffusion bodies is arranged like a forest; an early-reflected sound sounds like a diffuse sound when reaching the listener. Therefore, with the use of the diffused-reflection bodies that are formed and disposed so as to generate a diffusion reflected sound between the direct sound and the early-reflected sound that sounds like a diffuse sound, it is possible to offer a sound field with a sense of more spreading.

Moreover, according to the sound field adjusting method of the fourth embodiment of the present invention, the columnar diffusion bodies are so formed that the density of the columnar diffusion bodies increases as the columnar diffusion bodies move away from the sound source and/or the sound-reception point. The columnar diffusion bodies are not necessarily required. However, a difference of the density is important.

Because of the difference of density of the columnar diffusion bodies, it becomes possible to diffuse and reflect acoustic energy with no directivity of a middle- and low-tone range. Therefore, it is possible to adjust sound in a way that gives a sound field with a sense of more spreading than a conventional one.

Moreover, according to the sound field adjusting method of the fourth embodiment of the present invention, the advantage obtained is that since a diffuse sound is generated in the section of the early-reflected sound 1300, extreme phase interference of a primary reflected sound is not likely to occur.

Incidentally, even if the arrangement of the sound diffusion bodies 225 is adjusted so that there is no diffuse sound in the silent section of the direct sound 1200 and early-reflected sound 1300 while a diffuse sound exists only in a portion of the early-reflected sound 1300, a good sound field can be obtained because of less phase interference.

Moreover, according to the sound field adjusting method of the fourth embodiment of the present invention, the sound diffusion bodies 225 are primarily placed next to the speaker P.

Accordingly, compared with diffusion bodies that are placed on a wall or ceiling, the sound diffusion bodies 225 are close to the sound source, and it is possible to add the diffusion reflected sound 1360 to the direct sound 1200. Therefore, it is possible to add the diffusion reflected sound even to a primary reflected sound from the floor.

That is, even if the sound diffusion bodies exist on a wall or ceiling, it is possible to further diffuse acoustic energy since the direct sound 1200 and the diffusion reflected sound 1360 enter the wall or ceiling.

Furthermore, the feature of the sound diffusion bodies 225 of the fourth embodiment of the present invention is that the sound diffusion bodies 225 have a multilayer diffusion structure. Therefore, it is possible to make the diffusion reflected sound contain the effects of directional diffusion and time-like diffusion. Thus, the following advantage is obtained: a remarkable sense of spreading of a sound field.

Fifth Embodiment

The following describes another arrangement configuration of sound diffusion bodies according to a fifth embodiment of the present invention.

As for the sound adjusting system X of the fourth embodiment of the present invention, the above has described mainly an example in which the sound diffusion bodies 225 are disposed on the left and right sides of the speaker P. However, the arrangement is not limited to the above. For example, a sound diffusion body 225 may be provided on a speaker stand.

Figure 28:
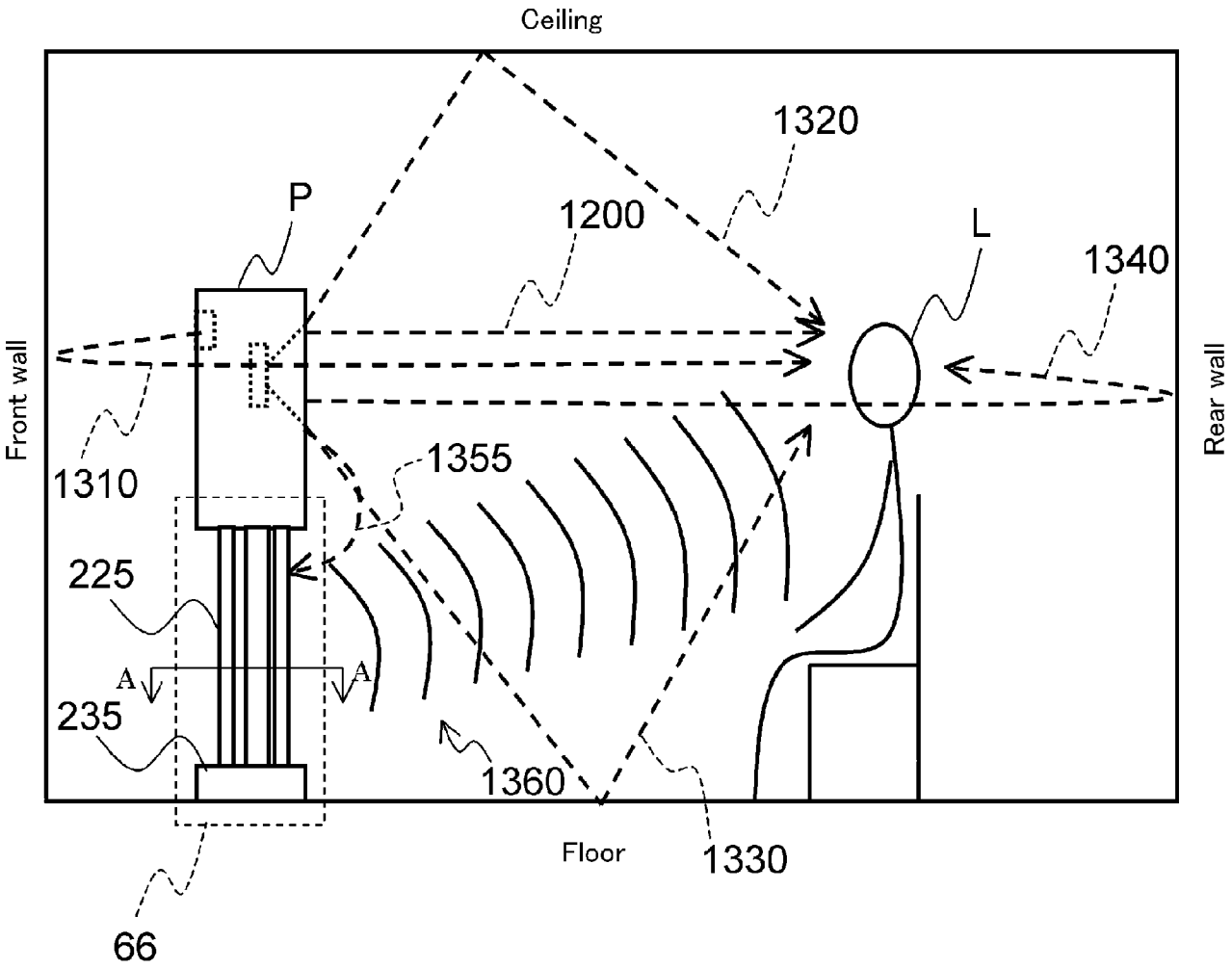
FIG. 28 is a conceptual diagram associated with side faces of various kinds of acoustic room where a speaker stand 66 is disposed, in various kinds of acoustic room according to a fifth embodiment of the present invention.

With reference to FIG. 28, such a structure of a sound diffusion body 225 that is provided on a speaker stand 60 will be described. For example, the speaker stand 60 is provided in such a way that a sound diffusion body 225 is placed on a base section 235. A speaker P may be placed thereon. A diffracted sound 1355 from the speaker P reaches a listener L as a diffusion reflected sound 1360 by the sound diffusion body 225. Incidentally, a speaker mount, as well as the base section 235, may be used. It is also possible not to use the base section 235. Furthermore, additional sound diffusion bodies 225 may be disposed around the speaker P, i.e. on the upper, lower, left or right sides of the speaker P, or at remote sites.

Even with the above configuration, it is possible to use the above sound adjusting system X and obtain the same advantageous effects.

Figure 29:
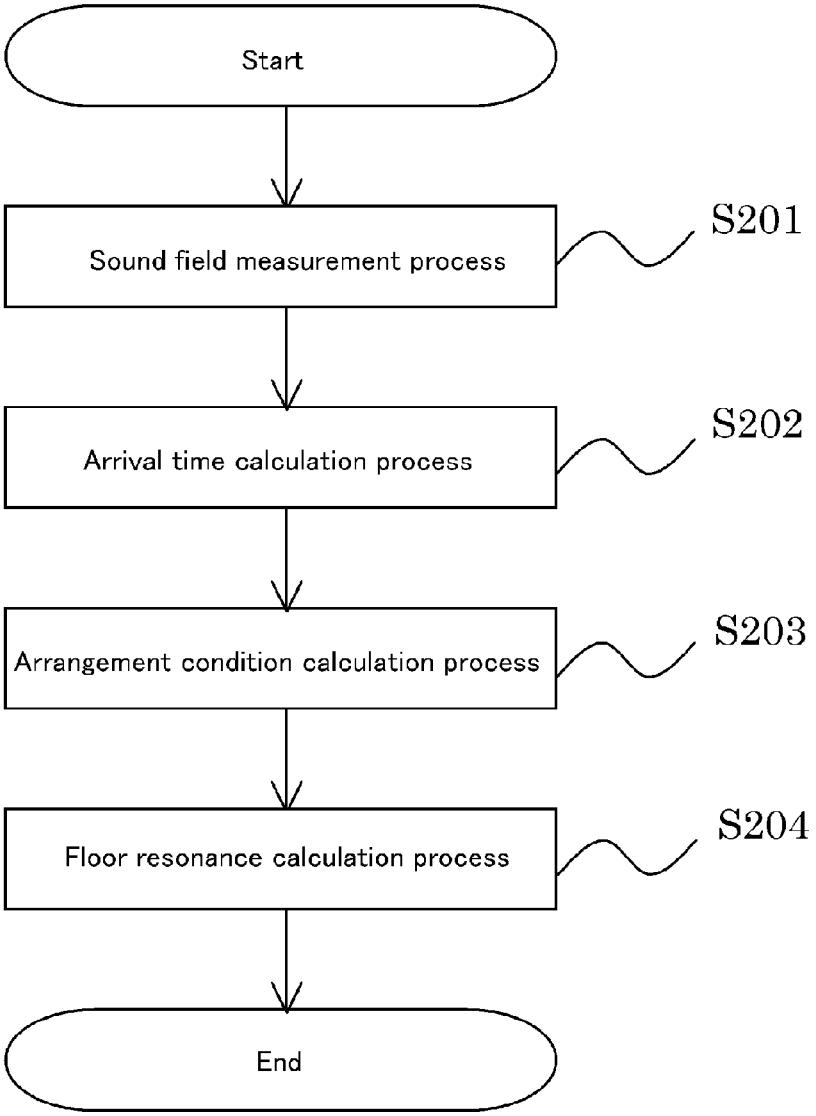
FIG. 29 is a flowchart associated with an operation of a sound adjusting system X according to the fifth embodiment of the present invention.

The following describes in detail how the sound diffusion body 225 is disposed at that time, as well as a specific process with reference to a flowchart of FIG. 29. The control section 650 of the PC 61 performs the above process by controlling each component according to the program stored in the storage section 620.

(Step S201)

The control section 650 performs a sound field measurement process, which is similar to that at step S101 of FIG. 21. At this time, it is possible to measure a low-frequency wave, which is associated with so-called "floor resonance" at a time when vibrations of the speaker P spread to the floor.

At this time, the following can be taken into consideration: the arrangement of sound-production devices, such as a dynamic speaker, tweeter or the like of the speaker P; a material of the floor and the material of the speaker stand 66; the material of the base section 235; and attenuation or the like caused by an insulator.

(Step S202)

Then, the control section 650 performs an arrival time calculation process, which is similar to that at step S102.

In the arrival time calculation process, in addition to a process of performing calculation as to the section ranging from the arrival of the direct sound 1200 of FIG. 24 to the arrival of the early-reflected sound 1300, it is possible to calculate the level and arrival time of a low-frequency wave (low-frequency band) associated with floor resonance.

(Step S203)

Then, the control section 650 performs an arrangement condition calculation process, which is similar to that at step S103.

In the process, an arrangement condition is as follows: When the diffracted sound 1355 of FIG. 28 reaches the speaker 66, the arrangement is performed in such a way that the diffusion reflected sound 1360 of FIG. 24 comes between the direct sound 1200 and the early-reflected sound 1300.

More specifically, in the arrangement condition calculation process, as in the case of the arrangement of the sound diffusion bodies of the above fourth embodiment, the control section 650 calculates the number of sound diffusion bodies 255 disposed on the speaker stand 66, the distance in a row, the distance between rows, and the like.

At this time, if the sound diffusion bodies 255 are disposed at any locations other than the speaker stand 66, the arrangement thereof is also calculated.

(Step S204)

Then, the control section 650 performs a floor resonance calculation process.

In this case, with the use of the results of calculation of floor resonance described above, the arrangement is calculated in a way that cancels a frequency of floor resonance or leaves a low-pitched sound component as diffusion reflected sound between reverberant sounds.

More specifically, the arrangement is performed by adjusting the diameter, arrangement and the like of thick columnar diffusion bodies so that a low-pitched sound component of diffusion reflected sound can be obtained within a time range, i.e. until a low-pitched sound component of floor resonance reaches the listener L. Therefore, it is possible to reduce flutter or the like associated with floor resonance and make a sense of sound field more magnificent.

[Configuration of Speaker Stand 66]

Figure 30:
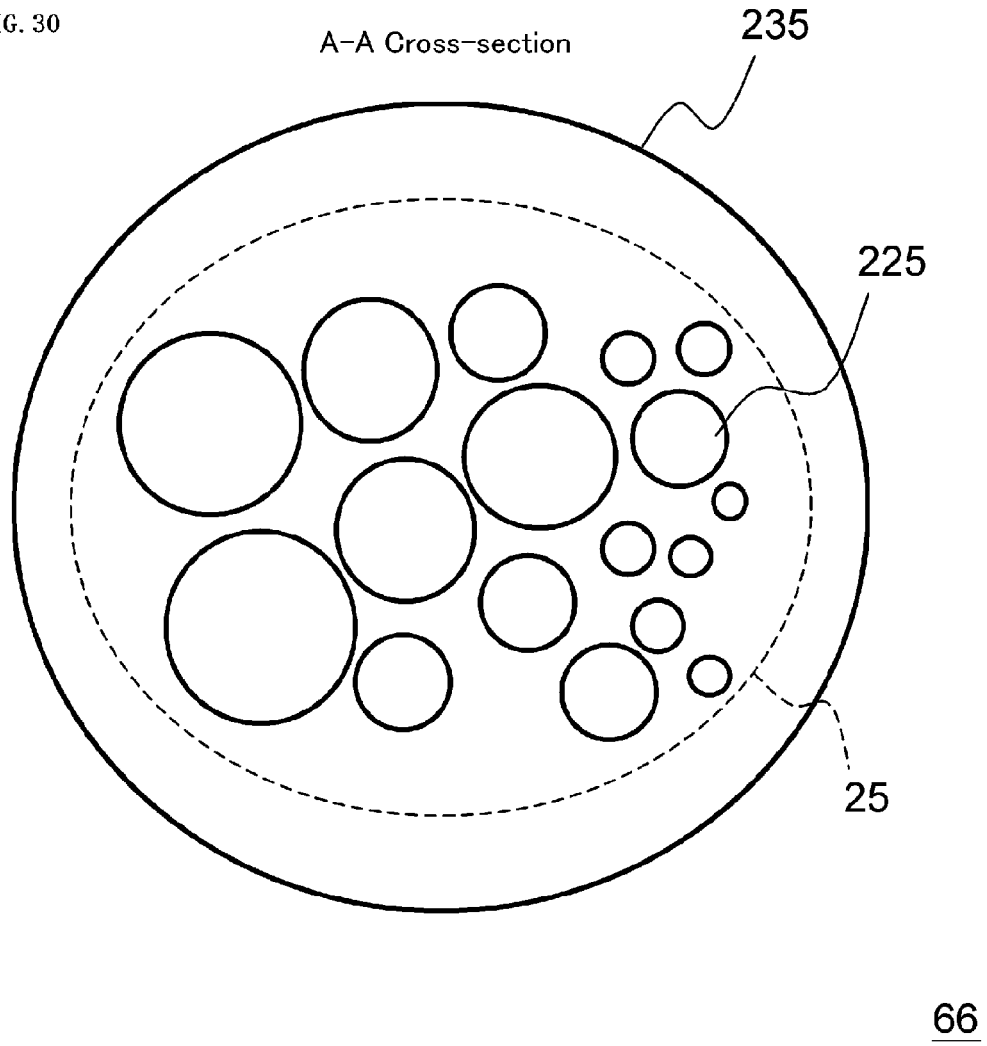
FIG. 30 is a conceptual diagram associated with a flat surface at a time when sound diffusion bodies are disposed on a speaker stand 66 according to the fifth embodiment of the present invention.

The following description is based on a top view of FIG. 30. The speaker stand 66 of the fifth embodiment of the present invention is formed by using sound diffusion bodies 225 that obey an arrangement condition calculated by the above arrangement condition calculation process.

FIG. 30 is a cross-sectional view of FIG. 28 taken along A-A, showing an example in which the sound diffusion bodies 225 are placed on the speaker stand 66 and the base section 235.

The base section 235 is made of wood with high internal losses, plywood, metal, plastic plate or the like. The base section 235 may include an insulator or the like so that the base section 235 does not come in contact with the floor directly.

The sound diffusion bodies 225 are fixed after a portion of the base section 235 is hollowed out, or are fixed with a nail, screw, dowel or the like.

The end portions where the sound diffusion bodies 225 come in contact with the speaker P (FIG. 28) are, for example, processed into flat portions, to which butyl rubber, elastomer or the like is bonded as a nonslip portion that also prevents vibrations. Moreover, the end portion may be processed into a convex shape in order to decrease the area that comes in contact with the speaker P. Thus, it is possible to keep the vibrations of the speaker P from being transmitted directly to the floor.

Incidentally, as described above, it is also possible to place a speaker mount at a location where the sound diffusion body and the speaker P comes in contact with each other. In this case, an insulator or the like may be provided on the speaker mount. Conversely, it is possible to use the base section 60 as a speaker mount and allow the end portions of the sound diffusion bodies 225 to come in contact with the floor. Furthermore, the base section 235 may gain weight after being equipped with marble stone, zircon sand or the like, reducing vibrations and resulting in an increase in stability.

Moreover, the sound diffusion bodies 225 are not necessarily in the shape of a circular column or elliptic column. For the sound diffusion bodies 225, diffusion bodies in the shape of so-called "entasis" with a swelled central portion or balls connected together may be used in order to generate the diffusion reflected sound 1360 in the upward, downward, left-hand, and right-hand directions. The diffusion bodies may also be in the shape of a ball, elliptic ball, or rugged objects skewered.

Moreover, the speaker P may be provided only for part of the sound diffusion bodies 225, with the sound diffusion bodies 225 surrounding the speaker P. Similarly, the sound diffusion bodies 225 may be attached above the speaker P.

With the above configuration, the mount, on which the speaker P is placed, and the sound diffusion bodies 225 can be put together into the speaker stand 66, leading to a decrease in the installation area. In addition, as in the case of the above fourth embodiment, it is possible to generate a diffusion reflected sound between a direct sound and an early-reflected sound, making it possible to adjust a sound field in an excellent manner.

Moreover, the sound diffusion bodies 225 are disposed as the speaker stand 66. Therefore, it is possible to adjust sound by means of a diffusion reflected sound even when it is difficult to provide sound diffusion bodies around the speaker P that is placed along the wall.

Furthermore, since a plurality of sound diffusion bodies 225 is disposed, high stability is ensured. Moreover, since the sound diffusion bodies 225 are randomly disposed, it is possible to keep characteristic vibrations and other vibrations associated with a housing of the speaker P from being transmitted to the floor. Therefore, for the speaker stand, it is possible to obtain a function of reducing an adverse effect on the sound fields of various kinds of acoustic room.

Moreover, after calculation takes place in a way that reduces floor resonance, the sound diffusion bodies 225 are disposed on the speaker stand 66. Therefore, it is possible to use the floor resonance, which has caused flutter echoes or the like and has an adverse effect on the sound fields of various kinds of acoustic rooms, as a portion of the reverberant sound. Therefore, it is possible to play a role in improving a sense of a sound field in various kinds of acoustic rooms, as well as to make a sound field magnificent. That is, even in a small acoustic room, it is possible to obtain a sound wave like a low-tone range reverberant sound. The listener L can enjoy a wide sound field as if being in a large room such as a concert hall.

Incidentally, the sound diffusion bodies 225, which satisfy the arrangement condition calculated by the above arrangement condition calculation process, are available not only to the speaker stand but also to furniture, which includes furnishing goods such as an audio amplifier (Amplifier) stand, AV (Audio Visual) rack, living room's table, chair, floor light, or ceiling light. The furniture, including the above furnishing goods and the like, are disposed in various kinds of acoustic room after calculation is performed in such a way that a diffusion reflected sound can come into a section of a direct sound and early-reflected sound.

At this time, the above sound diffusion bodies around the speaker, the speaker stand and the like may be additionally used to make a sound field more magnificent.

Moreover, a cord, such as a speaker cord, power cord or optical fiber, may be disposed so as to pass through the above columnar sound diffusion body or go along a surface of the sound diffusion body. In this case, it is possible to simplify how such a cord is connected, as well as to save space.

Speaker Cabinet and Speaker Device

Sixth Embodiment

A sound diffusion body of an embodiment of the present invention may be formed so as to be placed in a speaker device. Such an embodiment of the present invention will be described with reference to the drawings.

Figure 31:
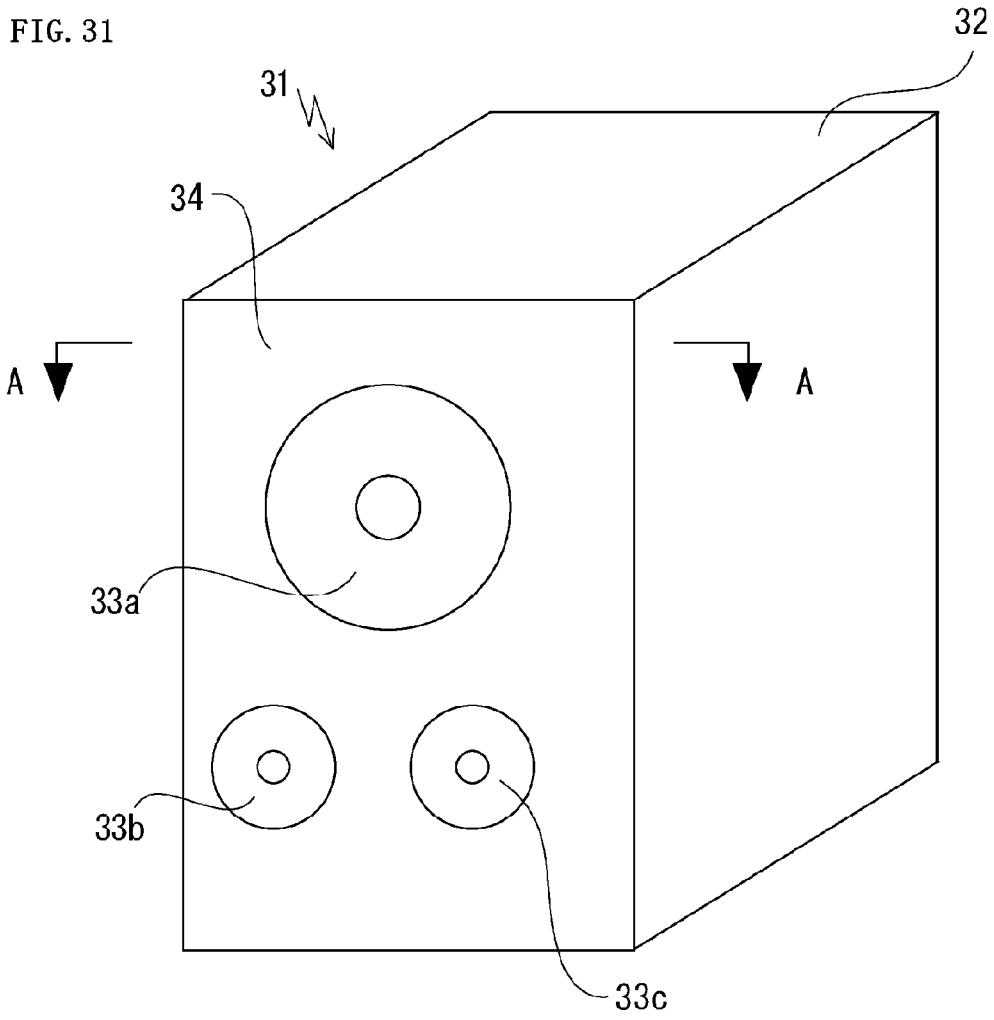
FIG. 31 is a perspective view showing a speaker device according to a sixth embodiment of the present invention.
Figure 32:
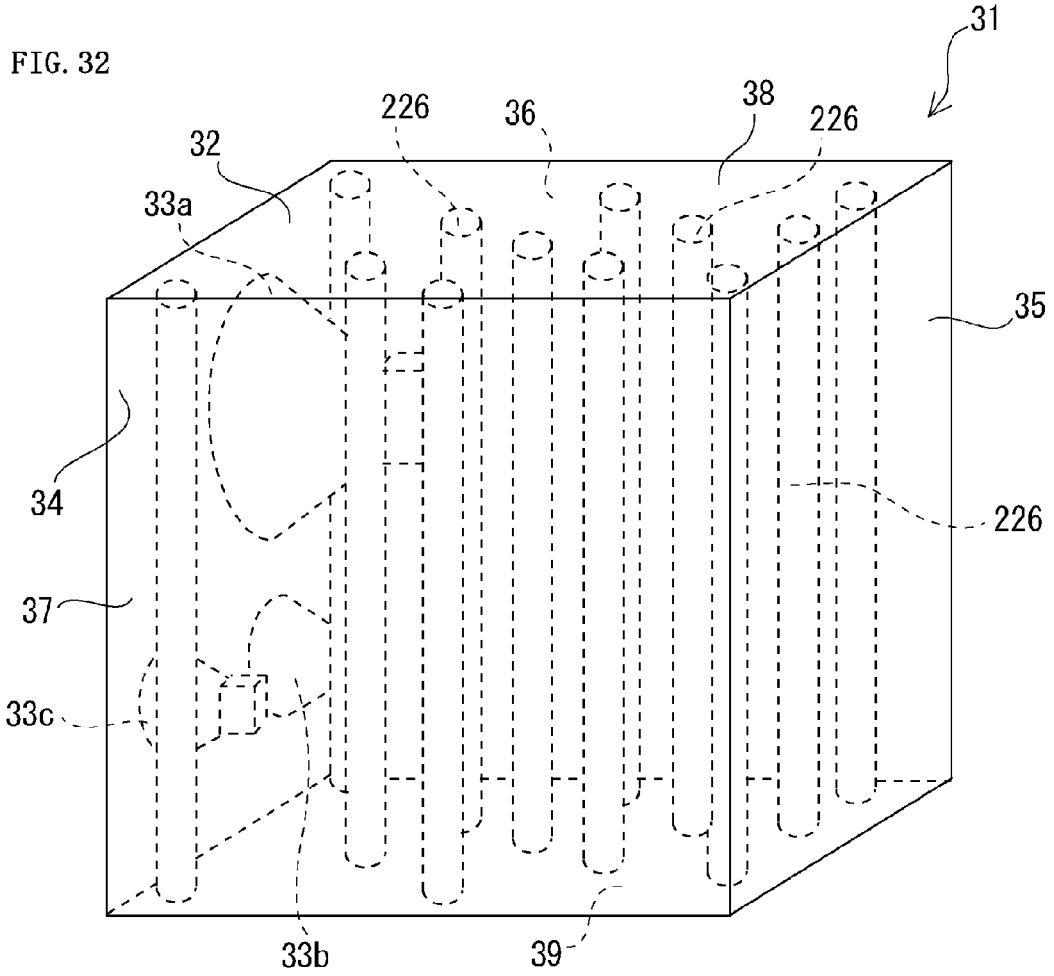
FIG. 32 is a perspective view showing the internal configuration of a cabinet of a speaker device according to the sixth embodiment of the present invention.
Figure 33:
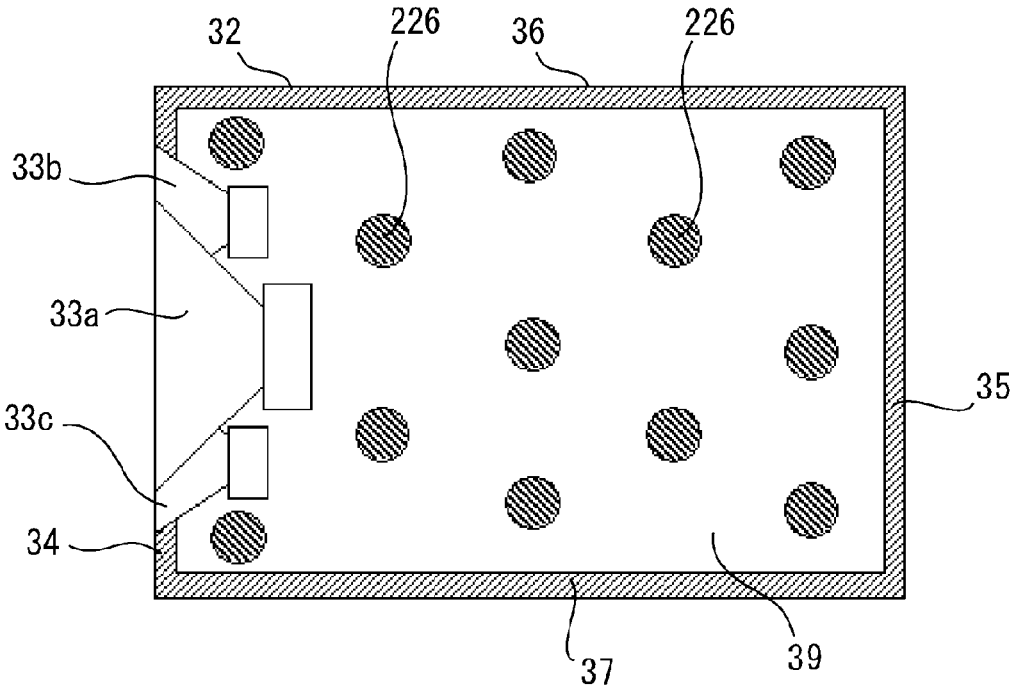
FIG. 33 is a cross-sectional view of FIG. 31 taken along A-A.

FIG. 31 is a perspective view showing a speaker device according to a sixth embodiment of the present invention. FIG. 32 is a perspective view showing the internal configuration of a cabinet of a speaker device. FIG. 33 is a cross-sectional view of FIG. 31 taken along A-A.

As shown in FIG. 31, in a speaker device 31, for example, to a front wall section 34 (baffle plate) of a speaker cabinet 32 (cabinet, housing) that is in the shape of a rectangular parallelepiped, three speakers 33*a*, 33*b* and 33*c* for low-, middle- and high-tone ranges are attached.

The speaker cabinet 32 includes a plurality of bar bodies 226 (sound diffusion bodies) projecting from wall portions into an inner part of the speaker cabinet 32. In the present example, the bar bodies 226 are solid circular columns, which are for example wooden circular columns.

The bar bodies 226 are disposed on the inner surfaces of the front and rear wall portions 34 and 5 and the inner surfaces of the left-hand and right-hand wall portions 36 and 37, among the wall portions facing each other of the speaker cabinet 32, so that the bar bodies 226 run parallel to each other. At the same time, the bar bodies 226 are orderly arranged in the front-back direction in the following pattern; two bar bodies, three bar bodies, two bar bodies, . . . . Both ends of the bar body 226 are screwed into the upper and lower wall portions 38 and 39 of the speaker cabinet 32 and are fixed with an adhesive material or the like.

Figure 34:
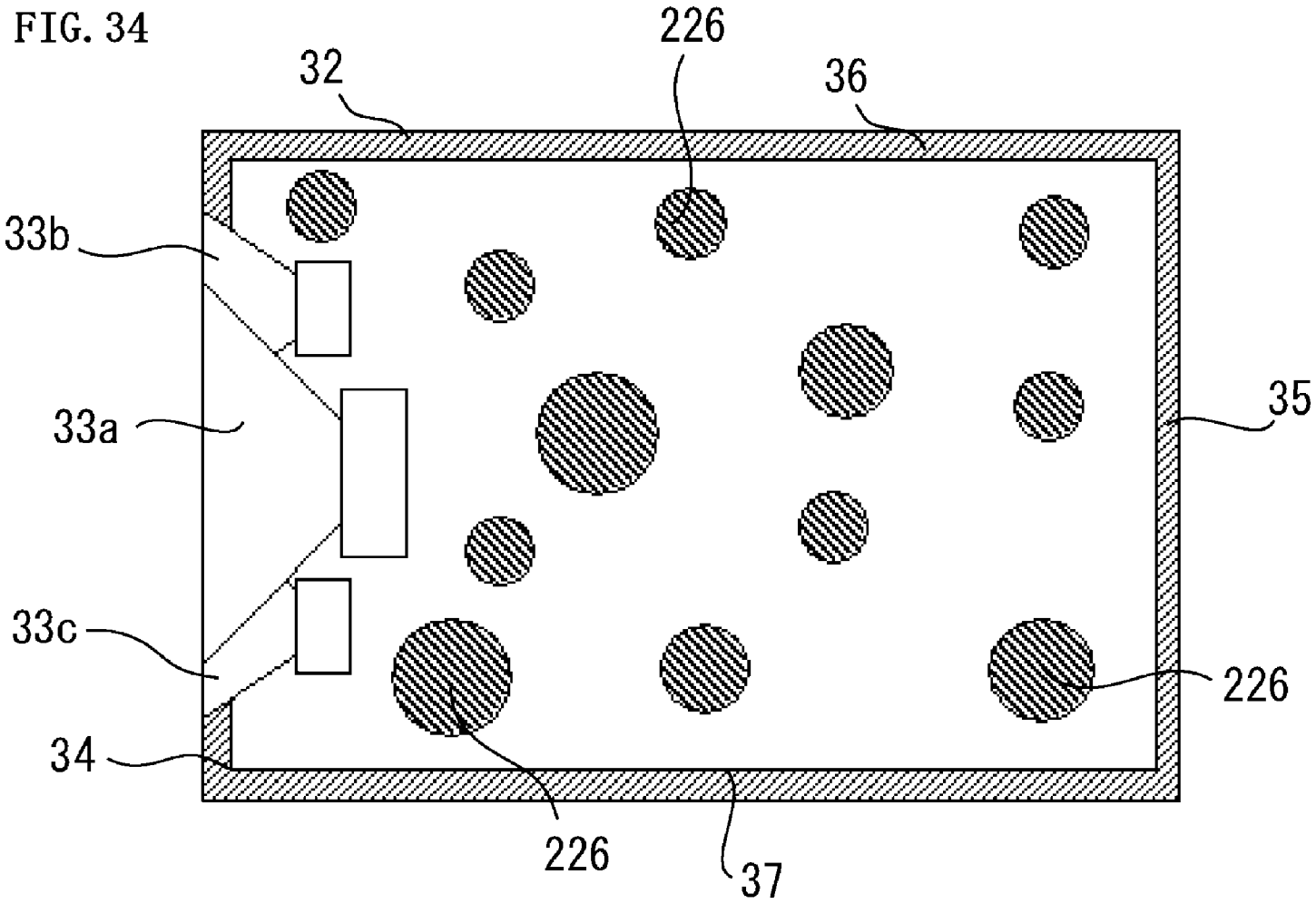
FIG. 34 is a cross-sectional view, which is similar to FIG. 33, showing another example of how bar bodies, provided in a speaker cabinet, are arranged.

Incidentally, as shown in FIG. 34, the bar bodies 226 placed in the speaker cabinet 32 may not be equal in thickness. For example, a row of large-size bar bodies, a row of middle-size bar bodies and a row of small-size bar bodies may be disposed in a multistage fashion. Moreover, the arrangement of the bar bodies 226 may be irregular.

According to the present embodiment, components are formed as described above. As the diaphragm of the speaker 33 (33*a* to 33*c*) vibrates, a sound output from the back side of the speaker 33 is emitted into the speaker cabinet 32. Then, the sound wave enters the surfaces of the bar bodies 226 directly or after being reflected off the inner surfaces of the front, rear, upper, lower, left and right wall portions 34, 35, 36, 37, 38 and 39 of the speaker cabinet 32. The sound wave is diffused by the surfaces of the bar bodies 226 before spreading and passing in every direction.

That is, when such bar bodies 226 are used, it is possible to almost ideally emit again a sound wave that is greater than or equal to a frequency that is proportional to the diameter. Therefore, it is possible to return diffusion sounds evenly across a broader area. The diameter of the bar bodies 226 at a time when a sound wave enters a cylinder has been continuously analyzed. Therefore, it is possible to use the results of the analysis (see Acoustic Engineering Principle, "http://www.acoust.rise.waseda.ac.jp/publications/onkyou/genro n-4.pdf," for example). Thus, it is possible to diffuse all sound waves of a frequency associated with the radius of the bar bodies 226.

Inside the limited space of the speaker cabinet 32, multiple reflection takes place, and the phase of a diffuse sound wave breaks almost randomly. Therefore, even for a frequency band in which uniform diffusion does not take place, which is for example a low-tone range, it is possible to obtain the effect of diffusion. Therefore, in a broadband frequency, it is possible to reduce standing waves.

Accordingly, it is possible to reduce standing waves caused by the reflection of sound that takes place between the inner surfaces of the front and rear wall portions 34 and 35 of the speaker cabinet 32, between the inner surfaces of the upper and lower wall portions 36 and 37, and between the inner surfaces of the left and right wall portions 38 and 39.

The above method is simple because the means to reduce standing waves are the bar bodies 226. The bar bodies 226 can be easily attached to the speaker cabinet 32.

According to the above embodiment, the bar bodies 226 that are equal in thickness to each other are arranged in an orderly manner in the speaker cabinet 32. However, as shown in FIG. 34, the bar bodies 226 may not be equal in thickness; for example, a row of large-size bar bodies, a row of middle-size bar bodies and a row of small-size bar bodies may be disposed in a multistage fashion. Moreover, the arrangement of the bar bodies 226 may be irregular.

In that manner, even when the bar bodies 226 that are different in thickness are arranged in an irregular pattern, it is possible to prevent standing waves from occurring in a wide band because the sound emitted from the speaker 33 (33*a* to 33*c*) into the speaker cabinet 32 is diffused by the surfaces of the bar bodies 226.

Seventh Embodiment

Figure 35:
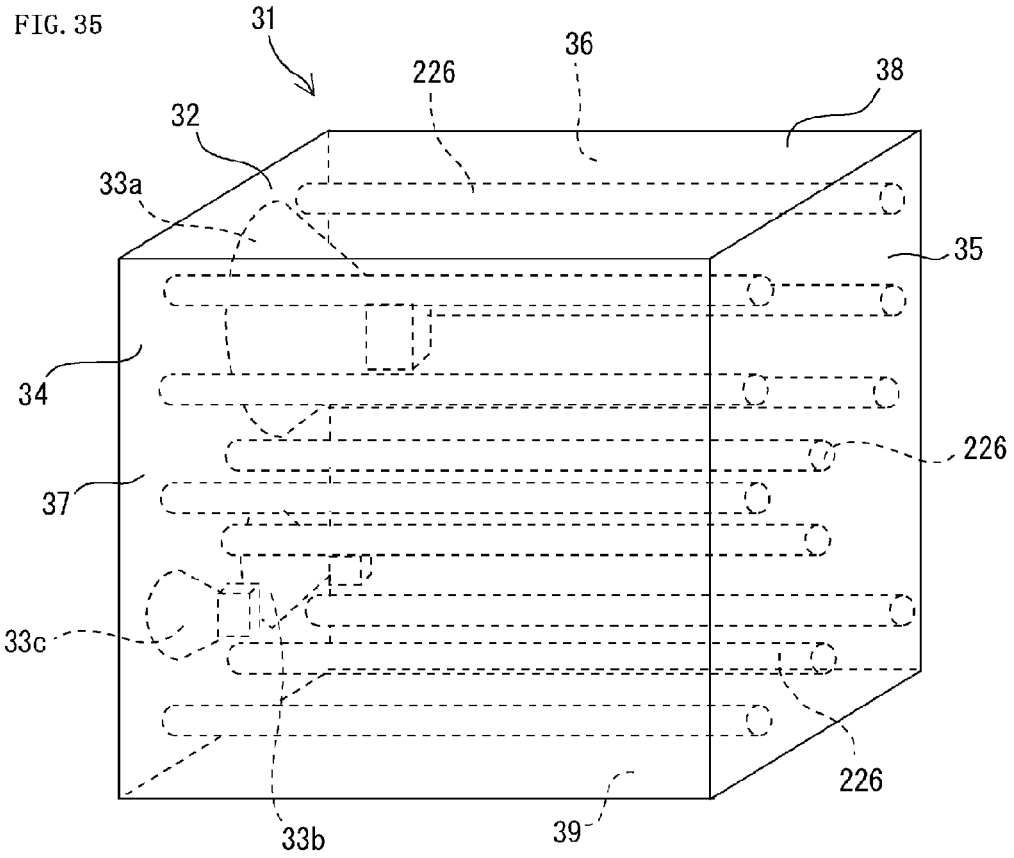
FIG. 35 is a perspective view showing the internal configuration of a cabinet of a speaker device according to a seventh embodiment of the present invention.

FIG. 35 shows a speaker device according to a seventh embodiment of the present invention. According to the seventh embodiment, in a speaker cabinet 32, a plurality of bar bodies 226 is disposed in an orderly manner on the inner surfaces of the left and right wall portions 36 and 37 of the speaker cabinet 32 and the inner surfaces of the upper and lower wall portions 38 and 39 so as to run parallel to each other. Both ends of the bar bodies 226 are fixed to the front and rear wall sections 34 and 35 of the speaker cabinet 32.

Incidentally, the bar bodies 226 may be changed so as to have a plurality of thicknesses or be disposed in an irregular pattern.

Even in the case of the seventh embodiment, it is possible to similarly prevent standing waves from occurring in a wide band because the sound emitted from the speaker 33 (33*a* to 33*c*) into the speaker cabinet 32 is diffused by the surfaces of the bar bodies 226.

Eighth Embodiment

Figure 36:
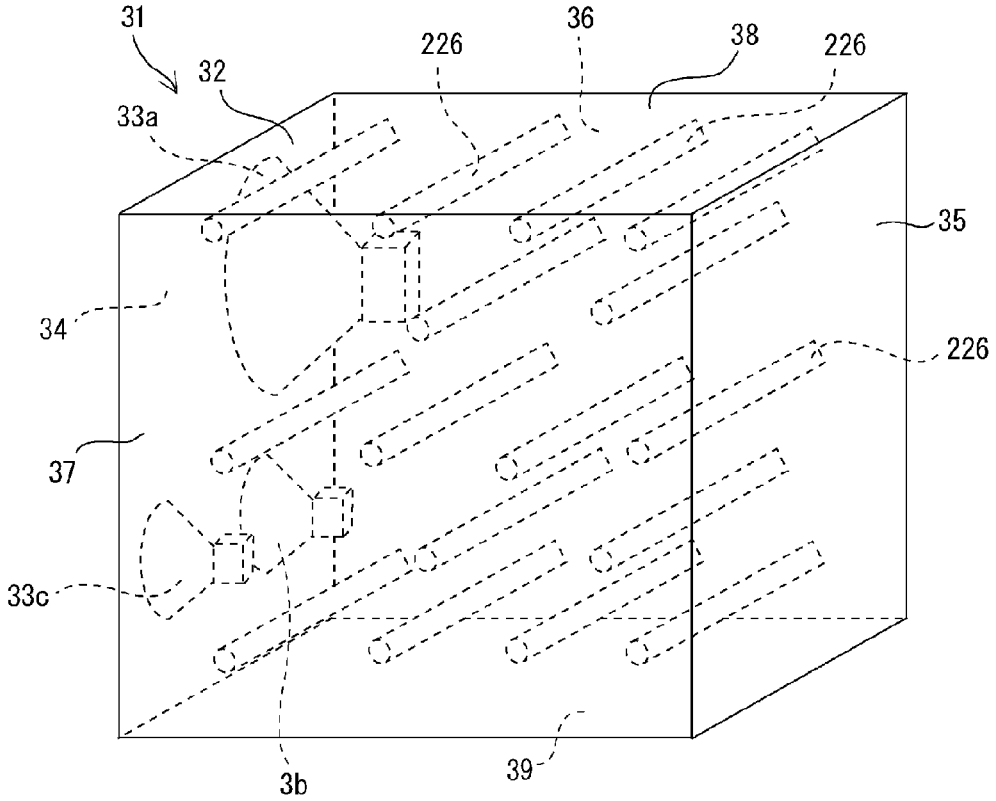
FIG. 36 is a perspective view showing the internal configuration of a cabinet of a speaker device according to an eighth embodiment of the present invention.

FIG. 36 shows a speaker device according to an eighth embodiment of the present invention. According to the eighth embodiment, in a speaker cabinet 32, a plurality of bar bodies 226 is disposed in an orderly manner on the inner surfaces of the front and rear wall portions 34 and 35 of the speaker cabinet 32 and the inner surfaces of the upper and lower wall portions 38 and 39 so as to run parallel to each other. Both ends of the bar bodies 226 are fixed to the left and right wall sections 36 and 37 of the speaker cabinet 32.

Incidentally, the bar bodies 226 may be changed so as to have a plurality of thicknesses or be disposed in an irregular pattern.

Even in the case of the eighth embodiment, it is possible to similarly prevent standing waves from occurring in a wide band because the sound emitted from the speaker 33 (33*a* to 33*c*) into the speaker cabinet 32 is diffused by the surfaces of the bar bodies 226.

According to the above first to eight embodiments, a plurality of bar bodies 226 is disposed on the inner surfaces of the speaker cabinet 32 so as to run parallel to each other. However, the present invention is not limited to the above. Some or all of the bar bodies 226 may be disposed only on the inner surfaces of one pair of wall portions, among three pairs of wall sections facing each other of the speaker cabinet 32, so as to run parallel to each other, while being disposed on the inner surfaces of the remaining two pairs of wall sections so as not to run parallel to each other.

Furthermore, in the case of a ninth embodiment of the present invention described below, some or all of the bar bodies 226 may be disposed on the inner surfaces of three pairs of wall sections facing each other of the speaker cabinet 32 so as not to run parallel to each other.

Ninth Embodiment

Figure 37:
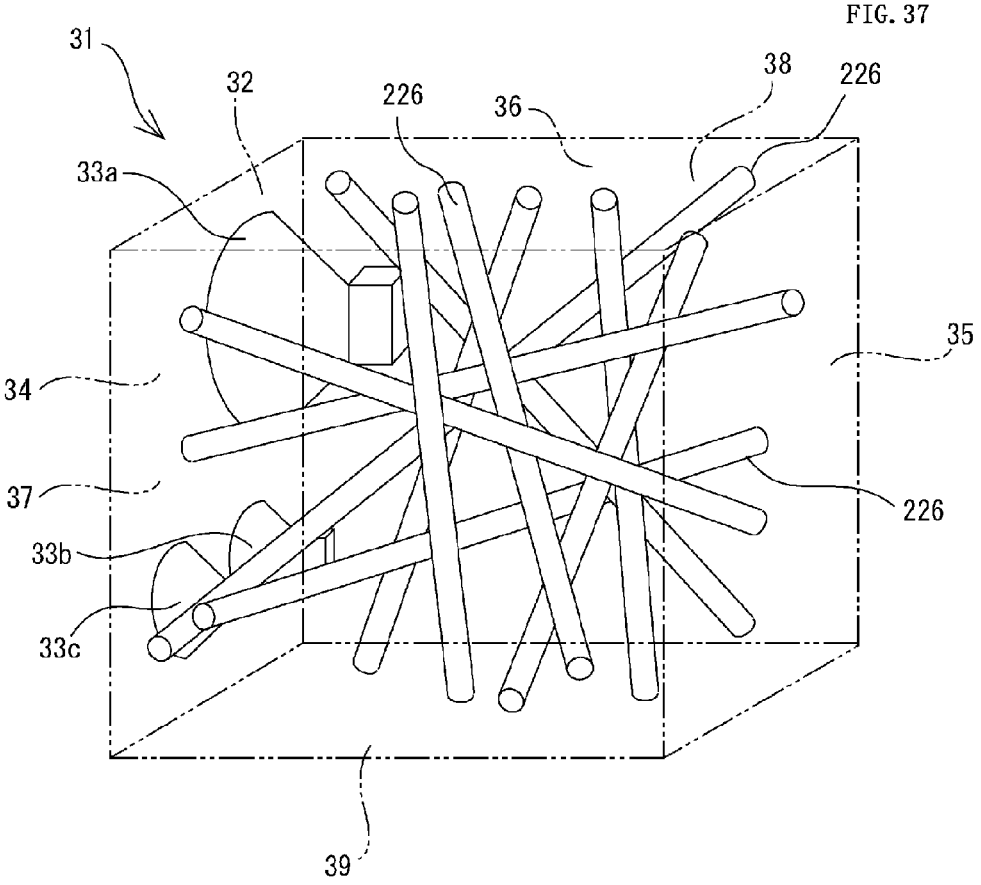
FIG. 37 is a perspective view showing the internal configuration of a cabinet of a speaker device according to a ninth embodiment of the present invention.

FIG. 37 shows a speaker device according to a ninth embodiment of the present invention. According to the ninth embodiment, in a speaker cabinet 32, a plurality of bar bodies 226 is disposed in a random manner on the inner surfaces of the front and rear wall portions 34 and 35 of the speaker cabinet 32, the inner surfaces of the left and right wall portions 36 and 37, and the inner surfaces of the upper and lower wall portions 38 and 39 so as not to run parallel to each other.

Incidentally, the bar bodies 226 may be changed so as to have a plurality of thicknesses.

Even in the case of the ninth embodiment, it is possible to similarly prevent standing waves from occurring in a wide band because the sound emitted from the speaker 33 (33*a* to 33*c*) into the speaker cabinet 32 is diffused by the surfaces of the bar bodies 226.

Tenth Embodiment

Figure 38:
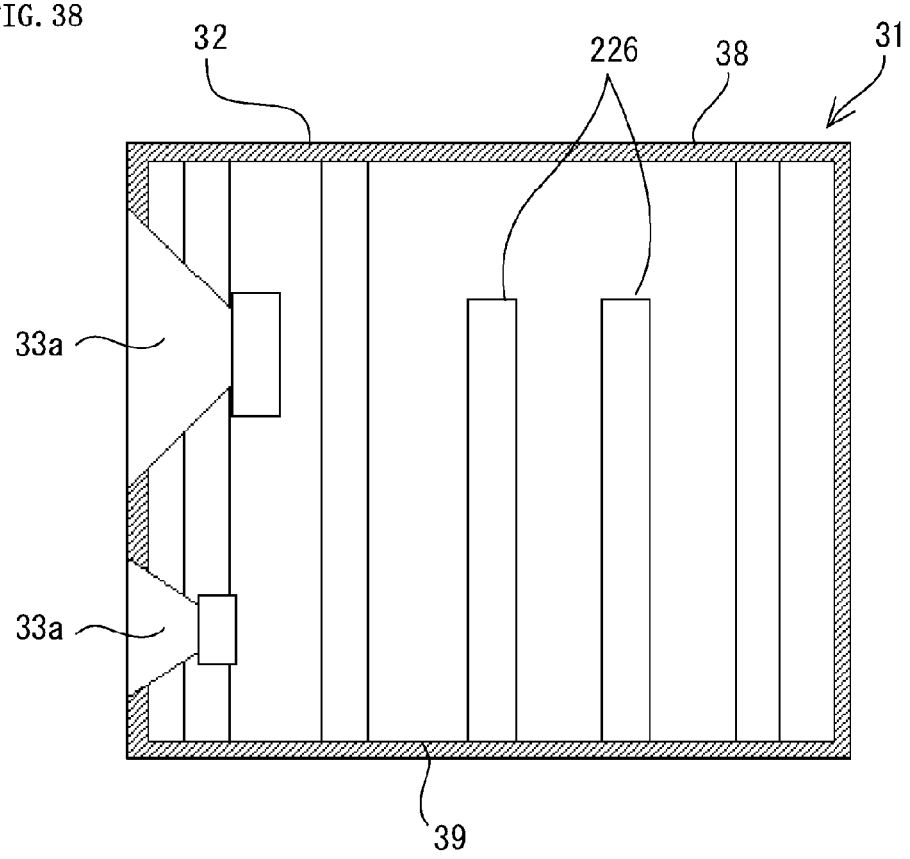
FIG. 38 is a perspective view showing the internal configuration of a cabinet of a speaker device according to a tenth embodiment of the present invention.

FIG. 38 shows a speaker device according to a tenth embodiment of the present invention. According to the above sixth to ninth embodiments, the bar bodies 226 are long enough that both ends of the bar bodies 226 reach the inner surfaces of the speaker cabinet 32. However, as shown in FIG. 38, all that is required is for bar bodies 226 to project from a wall portion of the speaker cabinet 32, which is for example the lower wall portion 39, into the inner part of the speaker cabinet 32. The tips of some or all of the bar bodies 226 may not reach a wall portion on an axis-line direction of the bar bodies 226, which is the inner surface of the upper wall portion 38 in the present example; the bar bodies 226 may be provided so as to float in a space inside the speaker cabinet 32 (with one end being supported).

Even in the case of the tenth embodiment, it is possible to similarly prevent standing waves from occurring in a wide band because the sound emitted from the speaker 33 (33*a* to 33*c*) into the speaker cabinet 32 is diffused by the surfaces of the bar bodies 226.

Figure 39:
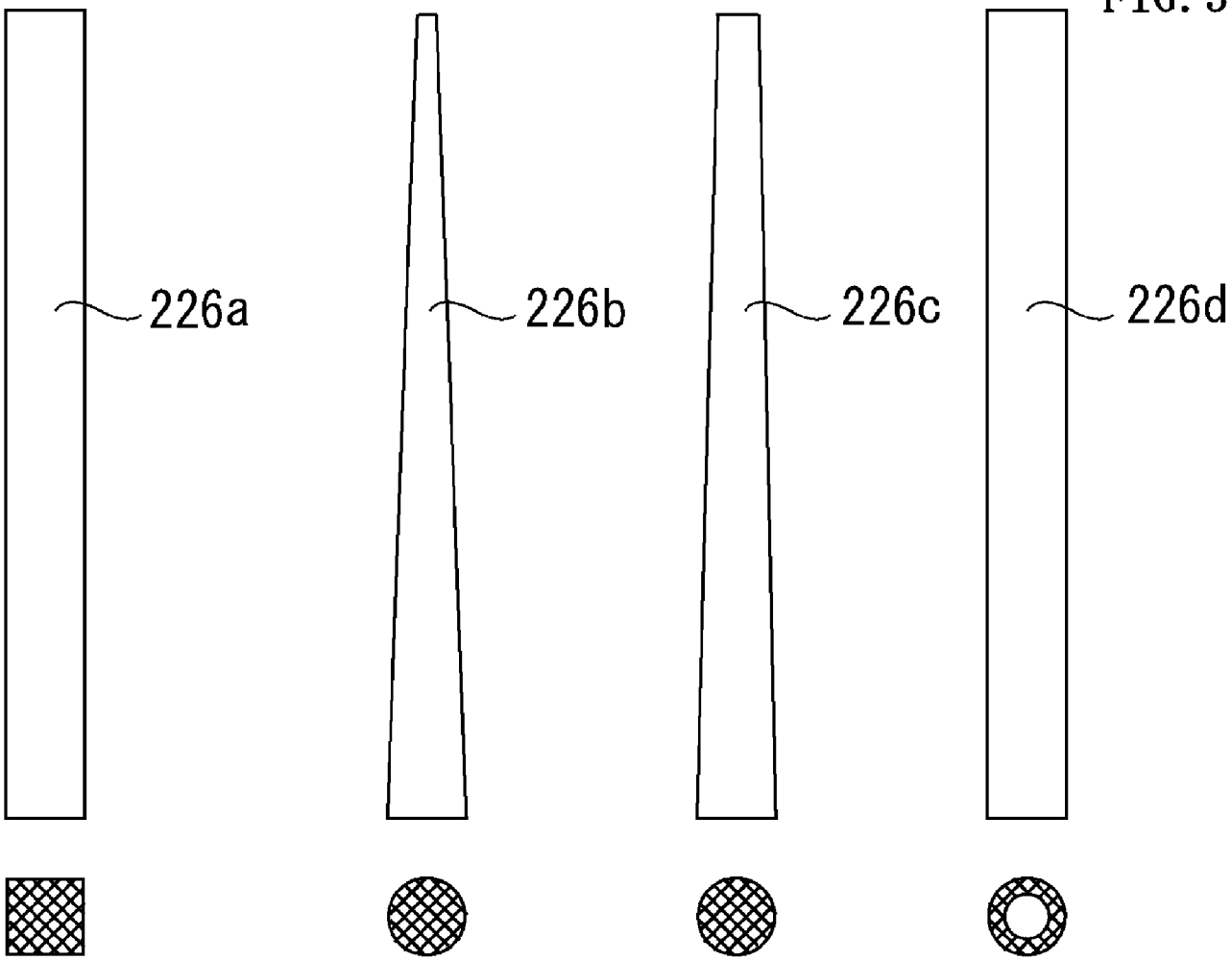
FIG. 39 is an explanatory diagram showing other examples of a bar body that can be used in the present invention.

According to the above sixth to tenth embodiments, the bar bodies 226 are solid circular columns made of wood. However, the bar bodies 226 may be in the shape of an elliptic column or any other column with a curved surface on the outside. Furthermore, as shown in FIG. 39, the bar bodies 226 may be in a prismatic column, such as a square-pillar bar body 226*a*; in the shape of a cone, such as a circular-cone bar body 226*b*; or in the shape of a frustum of a cone, such as a circular-truncated-cone bar body 226*c*. The bar bodies 226 may have a thicker central portion like "entasis." The bar bodies 226 may be formed into a shape with a plurality of bumps like a stick of dumplings.

Moreover, the bar bodies 226 are solid. Instead, a tubular hollow body 10*d* may be used. When the bar bodies 226 are hollow and disposed in such a way that the tips of the bar bodies 226 are floating in the space in the speaker cabinet 32, the tips of the bar bodies 226 can be opened. Since the bar bodies 226 resonate at a predetermined frequency, it is possible to reduce standing waves that are less than or equal to a frequency at which diffusion takes place at the bar bodies 226, particularly standing waves of a low-tone range. Moreover, in order to present resonance in the bar bodies 226, the tips of the bar bodies 226 can be closed by means of caps or the like.

Moreover, the speaker cabinet 32 may be of a type that lacks a partial or entire area of the rear wall portion 35 facing the front wall portion 34 to which the speaker 33 is attached. With a resonance port provided on the front wall portion 34 of the speaker cabinet 32, the speaker cabinet 32 may be of a bass reflex type that allows the back surface-side sound of the speaker 33 to flow out into the front side of the speaker 33 after inverting amplification. In any case, by the bar bodies 226 provided in the speaker cabinet 32, it is possible to prevent standing waves from occurring in a wide band in the speaker cabinet 32.

As described above, the frequency of a diffuse sound is proportional to the diameter of the bar bodies 226. In particular, in order to diffuse standing waves of a low-tone range, it is desirable that the bar bodies 226 with a larger diameter be placed. However, when it is difficult to place large bar bodies 226 in the cabinet, the speaker cabinet 32 may be processed into other shapes, for example, so that the back side of the speaker cabinet 32 is in a circular shape. Therefore, it is possible to prevent standing waves from occurring as diffusion and radiation take place even for a low-pitched sound. Moreover, it is possible to adjust the diffusion of a low-tone range by providing glass wool, zircon sand or the like that particularly absorbs a low-pitched sound.

Eleventh Embodiment

The following describes an arrangement method at a time when bar bodies 226 are disposed on the basis of calculation. In the above embodiments, the bar bodies 226 are disposed in a predetermined arrangement pattern. Meanwhile, if the speaker cabinet 32 is in a shape for which standing waves can be easily calculated, such as a parallelepiped that is larger in size than a predetermined level, it is possible to arrange the bar bodies 226 in a way that more effectively diffuses standing waves to make output sound magnificent.

The following describes in detail a method of arranging the bar bodies 226 to achieve the above advantageous effect.

Firstly, with reference to FIG. 40, the following provides a more detailed description of where the bar bodies 226 are disposed as to locations associated with a cycle for the speaker cabinet 32. In FIG. 40, the length of a portion sandwiched between arbitrary two walls of the speaker cabinet 32 is indicated by L.

Figure 40A:
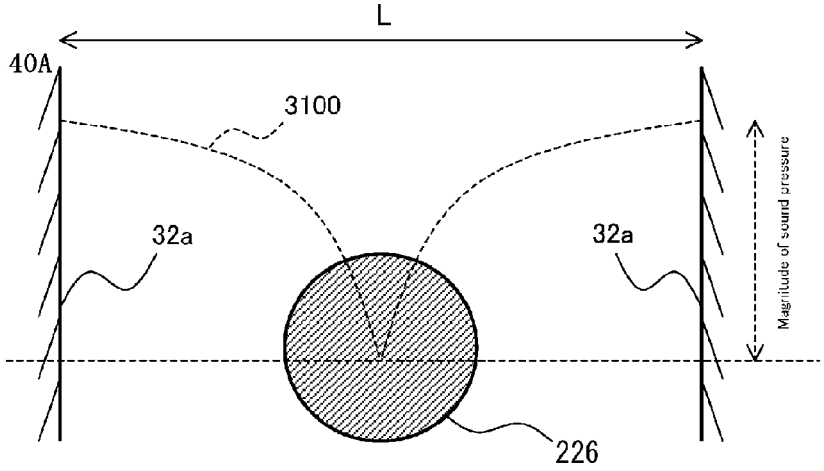
FIG. 40A, FIG. 40B, and FIG. 40C are conceptual diagrams showing the sound pressure of a standing wave of a speaker device and a location where a bar body is disposed, according to an eleventh embodiment of the present invention.

In this case, FIG. 40A shows the sound pressure distribution of a standing wave at a time when the cycle comes to 1. That is, since the standing wave is a sound wave, the strength of the wave goes up and down between two walls 2*a* of the speaker cabinet 32, creating nodes; the sound pressure goes up beyond the nodes. With respect to the sound pressure distribution of the standing wave, it is known that the particle velocity of air associated with sound increases at a point where the sound pressure is at the lowest level.

After having worked hard to conduct experiments and examinations, the inventors of the present invention have found that the bar bodies 226 disposed at a site where the particle velocity is large are effective. The reason is that since the front-back motion of air is large at the site where the particle velocity of the standing wave is at the highest level, it is possible to prevent standing waves from occurring as well as to diffuse the standing waves by disposing the bar bodies 226 at the site where the particle velocity is large in order to interfere with the motion of the air.

That is, the node of the standing wave is a point where the sound pressure is at the lowest level and the particle velocity is large. Therefore, it is preferred that the bar bodies 226 be disposed at the nodes of the standing wave. FIG. 40A shows an example in which the bar body 226 is disposed in the nodes of the standing wave as described above.

In this case, with the standing wave containing integral multiples of an overtone, the standing wave is recognized by a listener. Therefore, what is important is to dispose the bar body 226 with the existence of such an overtone taken into consideration.

Figure 40B:
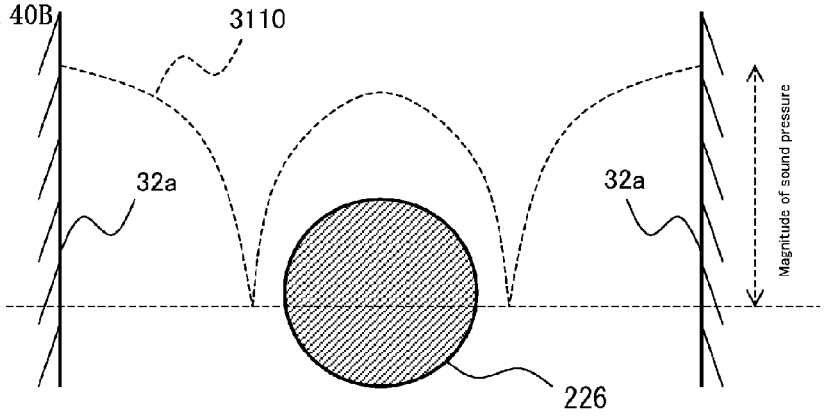

With reference to FIG. 40B, the cycle is one-half of that shown in FIG. 40A. That is, FIG. 40B shows an overtone having double the frequency. In this case, as shown in FIG. 40B, even when the bar body 226 is disposed at the same position as in the case of FIG. 40A, being a state of large sound pressure=small particle velocity is observable.

Figure 40C:
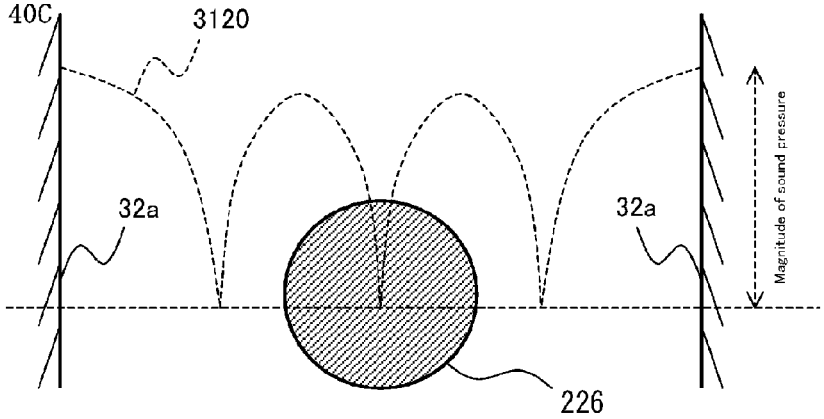

With reference to FIG. 40C, there is an overtone which frequency is three times as large as the frequency of the standing wave shown in FIG. 40A. In this case, as like FIG. 40B, even when the bar body 226 is disposed at the same position as in the case of FIG. 40A, a state that low sound pressure=large particle velocity.

In this manner, even for an overtone multiplied by an odd number, the bar body 226 is disposed at the same place. Therefore, the sound pressure distribution of the standing wave is disposed at the lowest point. Therefore, even for the sound multiplied by an odd number, it is preferred that the bar body 226 be disposed at the location where the advantageous effect can be obtained. Moreover, when the bar body 226 is additionally disposed at the position of a sound multiplied by an even number as shown in FIG. 40B, diffusion takes place more effectively.

It is known that a conventional sound-absorption material such as glass wool that is put into a speaker cabinet does not work well in absorbing sound for a standing wave of a middle- and low-tone range, for example, of 200 Hz to 1,000 Hz. For example, as the results of experiments on glass wool with a thickness of 25 mm, it is found that the sound absorption rate is about 0.8 at 10,000 Hz; about 0.6 at 1,000 Hz; and about 0.05 at 100 Hz.

Therefore, in the speaker cabinet 32, for example, it is desirable that the bar body 226 be disposed at a location corresponding to a node of a standing wave whose frequency is 200 to 1,000 Hz.

Figure 41:
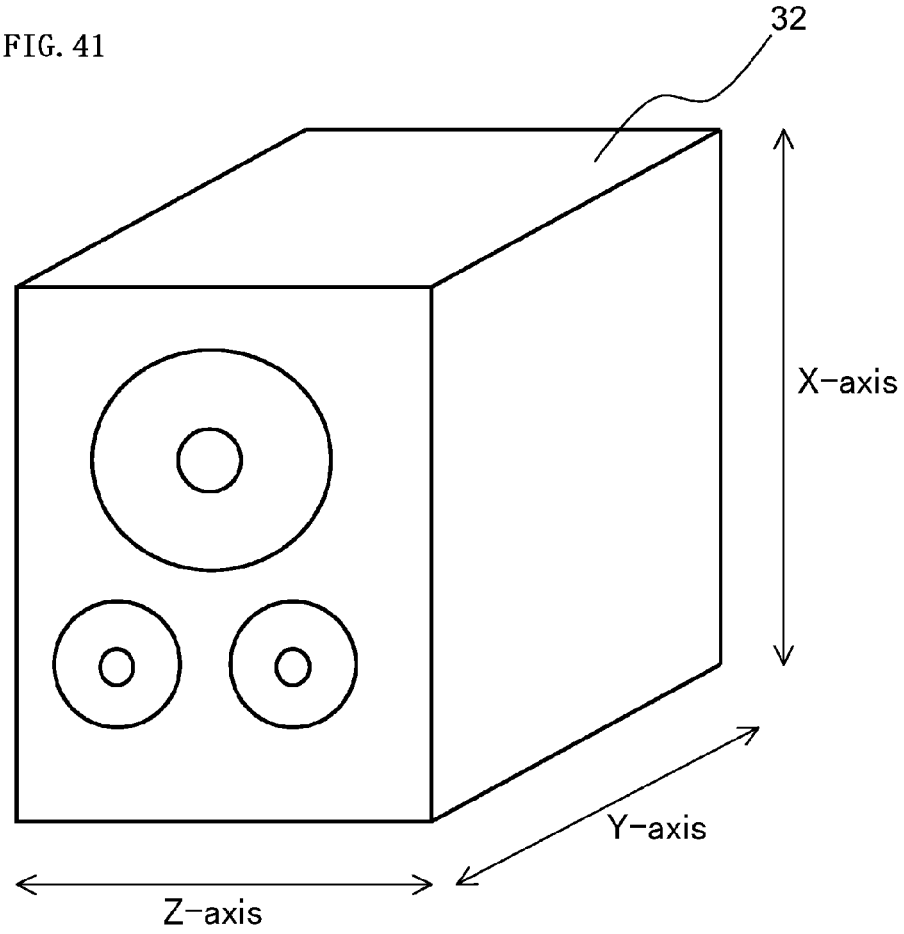
FIG. 41 is a conceptual diagram showing the directions of coordinates of a speaker device according to the eleventh embodiment of the present invention.

The following description is based on FIG. 41. As shown in FIG. 41, when the x-, y- and z-axis direction cycles of the speaker cabinet 32 are input into the following equation (2), a characteristic frequency (resonance frequency, fundamental resonance frequency) of each axis direction can be calculated:

$$f=C/2\mathrm{SQRT}((nx/X)^2+(ny/Y)^2+(nz/Z)^2) \qquad \text{Equation (2)}$$

In the above equation (2), nx, ny and nz represent the length of x-axis direction, y-axis direction and z-axis direction of the speaker cabinet 32, respectively.

Moreover, X, Y and Z represent division numbers of cycle of X-axis, Y-axis and Z-axis, respectively. That is, for example, when the division number of the cycle of X is 1, it is possible to calculate a characteristic frequency of one cycle with respect to the length of nx. When the division number of the cycle of X is 2, i.e. when the cycle is one-half, it is possible to calculate a characteristic frequency of one-half cycle with respect to the length of nx.

Incidentally, the characteristic frequency never becomes a 0 cycle. Therefore, when X, Y and Z are all 0, calculation is performed with nx/X, ny/Y and nz/Z all set at 0.

Moreover, C is a constant number, which can be calculated with the use of a sound speed of 25 degrees Celsius, for example. Moreover, SQRT( ) means a square root.

The characteristic frequency calculated with the use of the above equation (2) turns out to be the frequency of a standing wave for the cycle. That is, based on the relationship between the characteristic frequency and cycle of the speaker cabinet, it is possible to calculate the frequency of the standing wave at each of the X-, Y- and Z-axis cycles.

For example, suppose that the dimensions of the speaker cabinet 32 shown in FIG. 41 are as follows: nx=0.7 m, ny=0.4 m and nz=0.5 m. In this case, (X, Y, Z)=(1, 0, 0), i.e. a standing wave of cycle 1 of X-axis direction, is substituted into the equation (2), the result of calculation is as follows: $f^x_1$=242 Hz. Similarly, in the case of the standing wave of (X, Y, Z)=(2, 0, 0), $f^x_2$=485 Hz. Similarly, in the case of the standing wave of (X, Y, Z)=(3, 0, 0), $f^x_3$=728 Hz.

Furthermore, in the case of (X, Y, Z)=(0, 1, 0), i.e. a standing wave of cycle 1 of Y-axis direction, with the equation (2), $f^y_1$=425 Hz. Similarly, in the case of the standing wave of (X, Y, Z)=(0, 2, 0), $f^y_2$=850 Hz. Similarly, in the case of the standing wave of (X, Y, Z)=(0, 3, 0), with the equation (2), $f^y_3$=1275 Hz.

Moreover, in the case of (X, Y, Z)=(0, 0, 1), i.e. a standing wave of cycle 1 of Z-axis direction, with the equation (2), $f^z_1$=340 Hz. Similarly, in the case of the standing wave of (X, Y, Z)=(0, 0, 2), $f^z_2$=680 Hz. Similarly, in the case of the standing wave of (X, Y, Z)=(0, 0, 3), with the equation (2), $f^z_3$=1020 Hz.

In this manner, at the cycle of each of the axial directions, when the division number corresponding to the cycle is doubled, a standing wave appears at double the characteristic frequency. The above overtone appears at double the characteristic frequency.

The standing wave at the characteristic frequency of the speaker cabinet 32 actually contains an overtone whose frequency is multiple times higher than each frequency. With the standing wave containing an overtone multiplied by an integral number, it is possible for a listener to recognize. Therefore, the bar body 226 needs to be disposed in a way that diffuses the standing wave.

Incidentally, what is described in the above example is the characteristic frequency in a model of a simple parallelepiped like the equation (2). However, another model can be used to calculate the following: each cycle when a more complex shape, or a division plate as in Conventional Technology 3, is added; or the frequency of a standing wave at each location in the speaker cabinet 32.

That is, given the frequency of a standing wave of each cycle calculated by the above equation (2), it is preferred that the bar body 226 be disposed at a location where the particle velocity is high, which is for example a node of a standing wave of 200 to 1,000 Hz.

The following describes the diameter at a time when the bar body 226 is actually disposed.

As described above, the bar body 226 is placed at each cycle on the basis of the dimensions of the speaker cabinet 32. It is possible to calculate the frequency of a standing wave.

Therefore, the bar body 226 of a diameter corresponding to the frequency of the standing wave is disposed, and it is therefore possible to further increase the effects of diffusing and reducing standing waves.

Example

Here, with reference to FIGS. 42 and 43, an experiment on the effect of diffusing standing waves by means of a bar body 226 with a different diameter will be described in detail.

Figure 42:
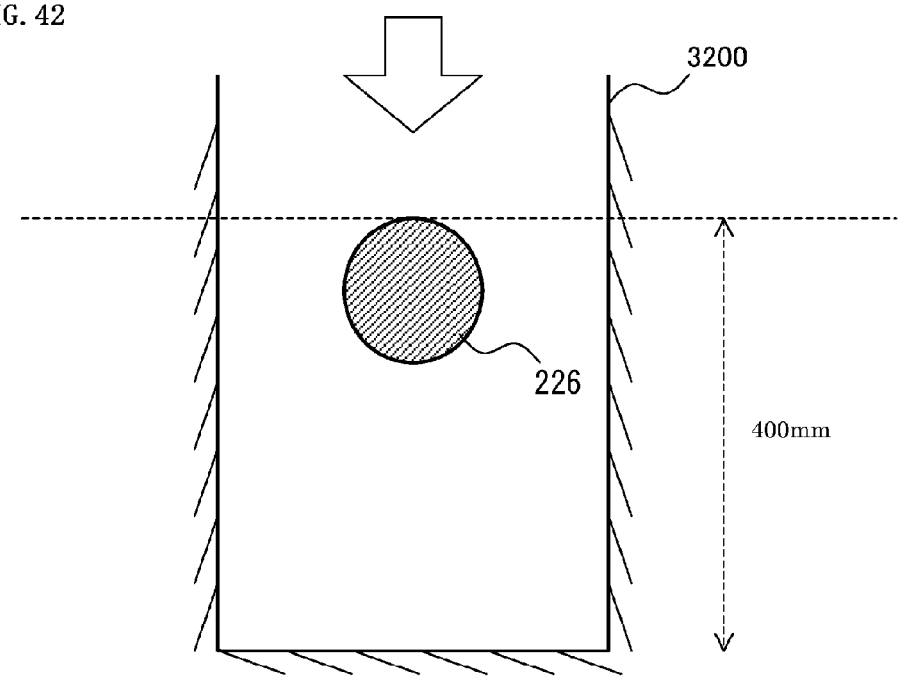
FIG. 42 is a conceptual diagram illustrating an experiment in an example of a speaker device according to the eleventh embodiment of the present invention.

With reference to FIG. 42, in the experiment, sound waves of various frequencies, which turn out to be plane waves, are emitted from a direction indicated by an arrow to a rigid wall 3200, which does not absorb most of the sound waves. As for the sound waves that are reflected off the rigid wall 3200 and diffused by the bar bodies 226, a change in reflectivity of the sound pressure associated with a phase change of the sound waves is measured. In this case, the delay of the phase means that the position of a reflection surface (rigid wall 3200) moves away. The advance of the phase means that reflection does not takes place on the rigid wall 3200 but on the surface of the bar body 226.

The reason is that because of the relationship between the wavelength of an incoming sound wave and the diameter of the bar body, the sound reflected off the surface of the bar body 226 is diffused, and the sound pressure of a standing wave is therefore thought to drop. Moreover, in a frequency band in which a sound wave is diffracted around the bar body 226, the expected advantage is that the phase changes, reducing remarkable standing waves.

Figure 43:
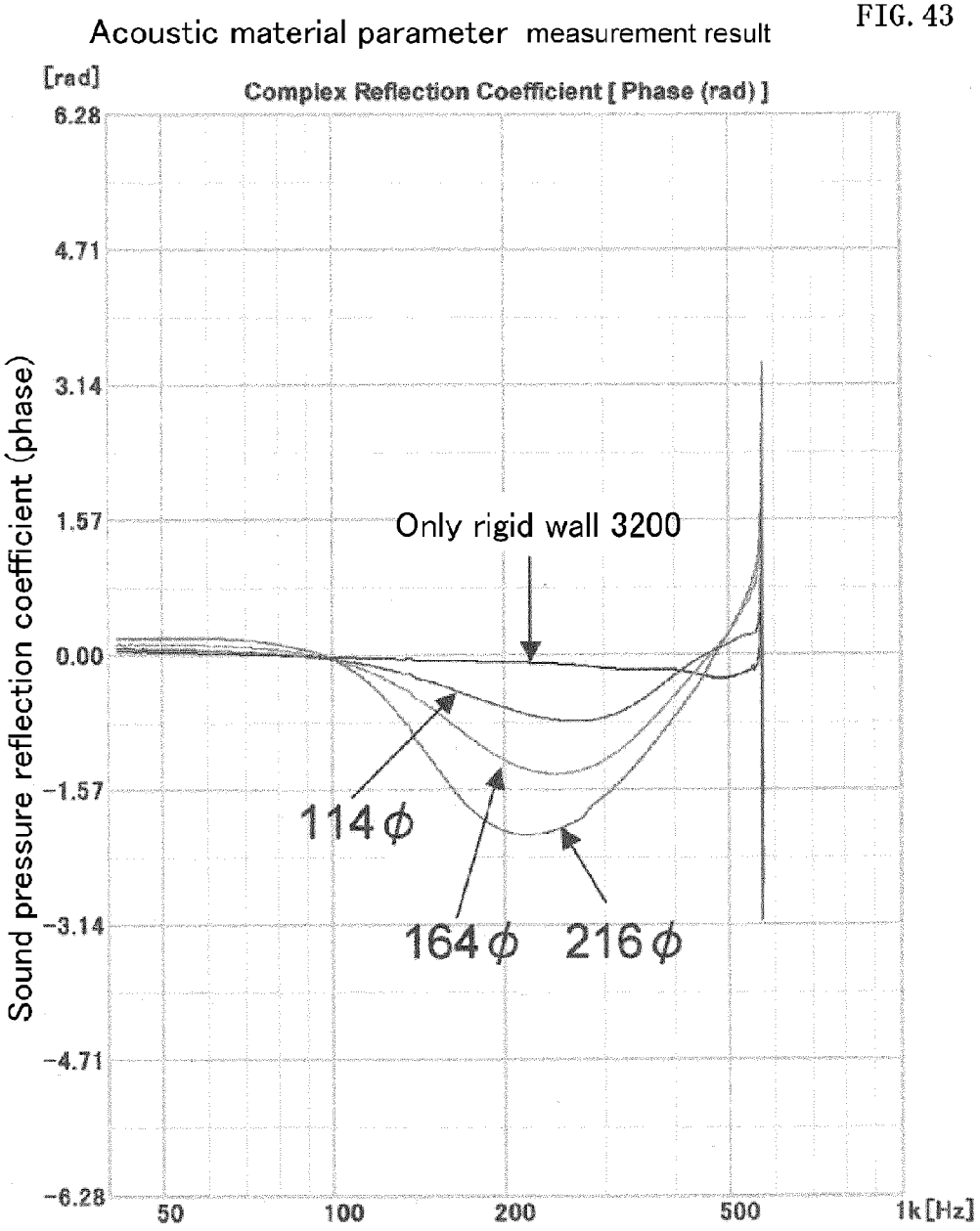
FIG. 43 is a graph of an example of a speaker device according to the eleventh embodiment of the present invention.

FIG. 43 shows the results of measuring the changes in frequency and sound-pressure reflectivity as to the bar bodies 226, which are 114 mm (114 ϕ), 164 mm (164 ϕ), and 216 mm (216 ϕ) in diameter, respectively. The horizontal axis represents frequency, and the vertical axis sound-pressure reflectivity.

It is clear from FIG. 43 that when the diameter of the bar body 226 is large, the frequency directly reflected off the surface tends to be smaller. As the diameter of the bar body 226 increases, the frequency band of the sound wave that is diffracted around the bar body decreases, and the change of the phase becomes larger. In that manner, the diameter of the bar body 226 is set so as to correspond to each frequency, it is possible to reduce standing waves that occur in the speaker cabinet 32.

For example, to deal with a standing wave of a frequency greater than or equal to 200 Hz, the use of the bar body 226 that is about 164 mm (164 ϕ) in diameter is effective. In addition, it is desirable that an appropriate sound-absorption material be additionally used.

Moreover, to deal with a standing wave of a frequency greater than or equal to 300 to 350 Hz, the use of the slightly thinner bar body 226 that is about 114 mm (114 ϕ) in diameter is effective.

At a node of a portion corresponding to the cycle of such a standing wave, it is possible to place a bar body 226 of a diameter corresponding to the frequency.

With the above configuration, the following advantageous effects can be obtained.

According to Conventional Technology 3, all that is required is for a division plate to be placed in a speaker cabinet only to reflect an incoming sound wave in a specific direction. Therefore, only the standing wave of the specific frequency is attenuated due to reflection.

On the other hand, according to the speaker device 31 of the embodiment of the present invention, a plurality of bar bodies 226 are provided so as to project from the wall portion of the speaker cabinet 32 into the internal part. Therefore, the sound emitted from the back side of the speaker 33 into the speaker cabinet 32 is diffused by the surfaces of the bar bodies 226.

Therefore, regardless of whether standing waves are of a specific frequency or not, it is possible to reduce the standing waves that occur as a sound is reflected between the internal surfaces of the wall portions facing each other of the speaker cabinet 32.

Moreover, according to Conventional Technology 3, a plurality of division plates needs to be attached to the wall portions of the cabinet so as not to run parallel; that is, the division plates may cross each other. Therefore, the problem is that it is difficult to dispose division plates.

Meanwhile, according to the speaker device of the embodiment of the present invention, the means to suppress standing waves is a bar body 226, which can be easily placed. Moreover, the bar body 226 can be easily attached to the speaker cabinet 32.

When the frequency of a standing wave in the cabinet and the diameter of the bar body 226 are set appropriately, dispersion takes place in a way that causes a reflected wave on the surface of the bar body 226, a diffracted wave on the side surface of the bar body 226, which is delayed in time, a conventional standing wave, and the like. Therefore, what is obtained is the effect of dispersing standing waves in the cabinet.

Moreover, a standing wave that occurs in a typical cabinet is attributable to the resonance effects associated with the dimensions of a main unit of the cabinet. It is widely known that the feature thereof is that the standing wave is formed at a fundamental resonance frequency and the integral multiple thereof. However, a music sound played from a speaker is made up of a fundamental wave and an integral-multiplication sound thereof, which determine a tone color. Therefore, a music sound generated from a speaker and a standing wave in a cabinet interact with each other. Because of the above relation, it is difficult to ignore an effect on the tone color.

On the other hand, according to the present invention, the bar body 226 of an appropriate diameter is placed in a cabinet. Therefore, in addition to the effect of diffusion due to the reflection on the surface of the bar body 226, a sound wave that is diffracted on the side surface of the bar body 226 has an amount of time delay that is dependent on the diameter of the bar body 226; different values are obtained due to the frequency of the sound wave.

Therefore, the time-delay effect at the part of the bar body 226 with respect to the fundamental frequency of the standing wave, and the time-delay effect of the diffracted wave at the side surface of the bar body 226 with respect to the integral-multiplication sound are different. In the result of the bar body 226 being placed, the effect as if sizes of the cabinet vary according to each frequency can be expected.

Therefore, the standing wave that actually occurs does not take the form of the integral-multiple overtone. Thus, as a cabinet for reproducing music, it is possible to improve an auditory effect in a greater manner than a simple plate used against for standing waves as like that of Conventional Technology 3.

Conventional glass wool with a thickness of for example 25 mm, which is used in adjusting standing waves, is effective in adjusting a frequency higher than 1,000 Hz. However, the problem is that the sound-absorption performance decreases at a frequency less than or equal to 1,000 Hz.

Therefore, at a frequency higher than 1,000 Hz, a sound-absorption material attached to the inner part is effective. However, what is required is to design a speaker cabinet 32 that adjusts a frequency less than or equal to 1,000 Hz.

As for coping this, by the speaker cabinet 32 of the embodiment of the present invention in which the bar body 226 that supports a predetermined frequency is provided at a point where the particle velocity is high, it is possible to adjust a standing wave in a frequency band lower than 1,000 Hz.

Moreover, it is originally known that there is a technique of reinforcing a low-pitched sound using a fundamental resonance frequency of a cabinet by the capacity that the cabinet has.

For example, as for a standing wave emitted at a characteristic frequency of a speaker cabinet, if the speaker cabinet is designed well in such a way that a standing wave of a low-tone range is emitted through a hole made on the cabinet as in a "bass reflex port," it is possible to make a low-pitched sound magnificent.

However, if a standing wave is emitted without being changed, the distortion of an acoustic characteristic of a speaker device, i.e. "flaw", is added, remarkably reducing auditory sense. Therefore, it is extremely important to adjust standing waves in order to improve the acoustic characteristic of the speaker device.

Against this, according to the speaker cabinet 32 of the embodiment of the present invention, it is possible to reduce the "flaw" of the acoustic characteristic by standing waves. Thus, it is possible to provide a speaker device having a more natural frequency characteristic. Therefore, it can significantly improve for auditory sense.

Moreover, in a frequency range where diffraction takes place around the bar body 226, the phase changes in a complicated manner; it is possible to obtain the effect of reducing standing waves significantly.

Incidentally, conventionally, the fundamental resonance frequency of the cabinet (box) is determined on the basis of the capacity inside the cabinet, a speaker attachment opening portion of a baffle surface, and a bass reflex port.

On the other hand, when the bar body 226 is placed in the speaker cabinet 32 of the embodiment of the present invention, the capacity of the cabinet decreases as the bar body 226 occupies space in the capacity, leading to an increase in the resonance frequency of the box. That is, it is possible to change the fundamental resonance frequency of the box.

The dimensions of the speaker cabinet 32 are practically designed so as to be a minimum level in size, resulting in a decrease in the capacity of the internal part. To address the above problem, a hollow member is used for the part of the bar body 226, with an air inlet and outlet provided in one portion, enabling the capacity of the internal part to serve as the capacity of the cabinet.

Furthermore, when a sound-absorption material is put into the hollow internal part of the bar body 226, it is possible to make the space inside the bar body 226 act as a resonance adjuster actively.

Incidentally, the configuration and operation of the above embodiments have been described as examples. Needless to say, modifications may be made and executed appropriately without departing from the scope of the present invention.

EXPLANATION OF REFERENCE SYMBOLS

1: Sound diffusion body
2: Sound generation system
3: Sound recording system
10: Tubular diffusion body
20: Columnar diffusion body
25: Sound diffusion body group
30, 33*a* to 33*c*: Speaker
31: Speaker device
32: Speaker cabinet
34 to 39: Wall portion
40: Sound generation device
50: Sound recording device
61: PC
62: Sound field measurement section
63: Input device
64: Display section
65: Printer
66: Speaker stand
110: Upper column
115: Seam
120: Lower column
130: Adjustment section
140: Resonance hole
150: Sound-absorption material
210: Ceiling section
220, 221, 222: Diffusion column
225: Sound diffusion body
226: Bar body
230, 231, 232, 235: Base section
610: Input section
620: Storage section
630: Time calculation section
640: Arrangement calculation section
650: Control section
660: Output section
1200: Direct sound
1300: Early-reflected sound
1310: Front-wall reflection sound
1320: Ceiling reflection sound
1330: Floor reflection sound
1340: Rear-wall reflection sound
1350: Sidewall reflection sound
1355: Diffracted sound
1360: Diffusion reflected sound
1400: Reverberant sound
P: Speaker
L: Listener
X: Sound-field adjusting system

The invention claimed is:

1. A sound generation system, comprising:
a sound source that generates a sound; and
columnar diffusion bodies that adjust an amount of the sound that is diffused and absorbed around the columnar diffusion bodies,
wherein the columnar diffusion bodies adjust a sound field of the sound in middle-tone to high-tone range of frequency over 1000 Hz and are acoustically transparent to low-tone range frequency around several Hz to several hundred Hz; and
wherein the columnar diffusion bodies are arranged so that an average density of the columnar bodies increases in a direction in which the columnar diffusion bodies move away from the sound source.

2. The sound generation system according to claim 1, wherein at least one of the columnar bodies is fixed to or incorporated into the sound source.

3. The sound generation system according to claim 1, wherein the columnar bodies are in combination of different diameters and/or lengths.

4. The sound generation system according to claim 1, wherein the arrangement distances of the columnar bodies are random.

5. A sound generation system, comprising:
a sound source that generates a sound; and
columnar bodies that adjust an amount of the sound that is diffused and absorbed around the columnar bodies, wherein
the columnar bodies are disposed so as to become thicker in diameter in a direction in which the columnar bodies move away from the sound source.

6. A sound recording system, comprising:
a recording device that records a sound; and
columnar bodies that adjust an amount of the sound that is diffused and absorbed around the columnar bodies, wherein
the columnar bodies are arranged so as to be concentrated in a direction in which the columnar bodies move away from the recording device.

7. The sound recording system according to claim 6, wherein at least one of the columnar bodies is fixed to or incorporated into the recording device.

8. The sound recording system according to claim 6, wherein the columnar bodies are in combination of different diameters and/or lengths.

9. The sound recording system according to claim 6, wherein the arrangement distances of the columnar bodies are random.

10. A sound recording system, comprising:
a recording device that records a sound; and
columnar bodies that adjust an amount of the sound that is diffused and absorbed around the columnar bodies, wherein
the columnar bodies are disposed so as to become thicker in diameter in a direction in which the columnar bodies move away from the recording device.

11. A sound generation method, comprising the steps of:

placing columnar diffusion bodies around a sound source; and adjusting how much a sound is diffused and absorbed, wherein the columnar diffusion bodies adjust a sound field of the sound in middle-tone to high-tone range of frequency over 1000 Hz and are acoustically transparent to low-tone range frequency around several Hz to several hundred Hz; and wherein the columnar diffusion bodies are arranged so that an average density of the columnar bodies increases in a direction in which the columnar bodies move away from the sound source.

12. A sound recording method, comprising the steps of:

placing a columnar body around a recording device; and adjusting how much a sound is diffused and absorbed, wherein the columnar bodies are arranged so as to be concentrated in a direction in which the columnar bodies move away from the recording device.

* * * * *